United States Patent [19]

Kashio

[11] Patent Number: 4,590,838

[45] Date of Patent: May 27, 1986

[54] ELECTRONIC MUSICAL INSTRUMENT

[75] Inventor: Toshio Kashio, Tokyo, Japan

[73] Assignee: Casio Computer Co., Ltd., Tokyo, Japan

[21] Appl. No.: 706,904

[22] Filed: Mar. 1, 1985

Related U.S. Application Data

[60] Continuation of Ser. No. 320,768, Nov. 13, 1981, abandoned, which is a division of Ser. No. 215,024, Dec. 10, 1980, abandoned, which is a continuation of Ser. No. 20,749, Mar. 15, 1979, abandoned.

[30] Foreign Application Priority Data

| | | | |
|---|---|---|---|
| Mar. 18, 1978 | [JP] | Japan | 53-31369 |
| Apr. 17, 1978 | [JP] | Japan | 53-45528 |
| Apr. 20, 1978 | [JP] | Japan | 53-46836 |
| Jun. 13, 1978 | [JP] | Japan | 53-71064 |

[51] Int. Cl.[4] ..... G10H 1/00

[52] U.S. Cl. ..... 84/1.01; 84/1.24; 84/DIG. 4

[58] Field of Search ..... 84/1.01, 1.03, 1.24, 84/1.19, 1.25, 1.28, DIG. 4

[56] References Cited

U.S. PATENT DOCUMENTS

| | | | |
|---|---|---|---|
| 3,515,792 | 6/1970 | Deutsch . | |
| 3,610,799 | 10/1971 | Watson | 84/1.01 |
| 3,809,786 | 5/1974 | Deutsch | 84/1.01 |
| 3,816,637 | 6/1974 | Whitefield | 84/1.24 |
| 3,908,504 | 9/1975 | Deutsch | 84/1.26 X |
| 3,978,755 | 9/1976 | Woron | 84/1.24 |
| 3,982,460 | 9/1976 | Obayashi et al. | 84/1.01 X |
| 4,003,003 | 1/1977 | Haeberlin | 84/1.01 X |
| 4,030,395 | 6/1977 | Kugisawa . | |
| 4,079,650 | 3/1978 | Deutsch et al. | 84/1.26 |
| 4,079,673 | 3/1978 | Deutsch . | |
| 4,083,285 | 4/1978 | Chibana . | |
| 4,085,644 | 4/1978 | Deutsch et al. | 84/1.01 |
| 4,114,496 | 9/1978 | Deutsch | 84/1.27 X |
| 4,135,422 | 1/1979 | Chibana | 84/1.01 |
| 4,144,789 | 3/1979 | Deutsch | 84/1.27 X |
| 4,145,943 | 3/1979 | Luce | 84/1.01 |
| 4,145,946 | 3/1979 | Deutsch | 84/1.26 |
| 4,179,972 | 12/1979 | Hiyoshi et al. | 84/1.17 |
| 4,184,403 | 1/1980 | Whitefield | 84/1.26 |
| 4,257,303 | 3/1981 | Nagai et al. . | |
| 4,348,928 | 9/1982 | Sakashita et al. | 84/1.01 |

FOREIGN PATENT DOCUMENTS

| | | |
|---|---|---|
| 1935306 | 9/1975 | Fed. Rep. of Germany . |
| 2543143 | 4/1976 | Fed. Rep. of Germany . |
| 2711511 | 9/1977 | Fed. Rep. of Germany . |
| 52-93315 | 8/1977 | Japan . |
| 1245678 | 9/1971 | United Kingdom . |
| 1317385 | 5/1973 | United Kingdom . |
| 1395376 | 5/1975 | United Kingdom . |
| 1525597 | 9/1978 | United Kingdom . |

*Primary Examiner*—Forester W. Isen

*Attorney, Agent, or Firm*—Frishauf, Holtz Goodman & Woodward

[57] ABSTRACT

An electronic musical instrument employs a novel technique to produce a musical sound. A major part of a musical sound producing section of the electronic musical instrument is constructed by digital circuitry which is well adapted for an LSI fabrication. The electronic musical instrument comprises a volume control means to digitally perform a volume control to increase or decrease a performance volume, a period counting means to count one cycle of a musical sound wave by a plurality of counting steps in order to form a musical sound wave under digital control, a period control means to control the period counting means in accordance with the scale represented by a depressed performance key, and a means to instruct the rise and the fall of a musical sound wave by a value which is an integral multiple of a control value of the volume control means, for each block including a predetermined number of counting steps.

4 Claims, 57 Drawing Figures

FIG. 5A

| | LOGICAL SYMBOL OF THIS INVENTION | LOGICAL EQUATION | TRUTH-VALUE TABLE | ORDINARY LOGICAL SYMBOL |
|---|---|---|---|---|
| OR GATE | 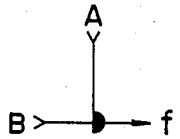  | $f=A+B$ | A B f<br>0 0 0<br>1 0 1<br>0 1 1<br>1 1 1 | 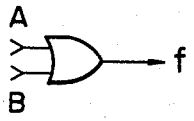  |
| | 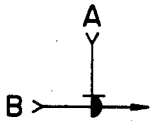  | $f=\bar{A}+B$ | INPUT: A B; OUTPUT: f<br>0 0 1<br>1 0 0<br>0 1 1<br>1 1 1 | 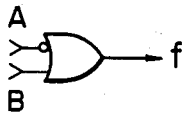  |
| INVERTER | 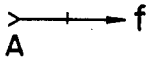  | $f=\bar{A}$ | INPUT: A; OUTPUT: f<br>0 1<br>1 0 | 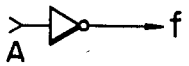  |
| EXAMPLES OF COMBINED LOGICAL CIRCUIT | 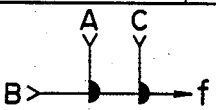  $f=A+B+C$ | | 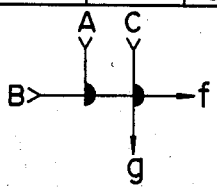  $f=A+B+C$<br>$g=C$ | 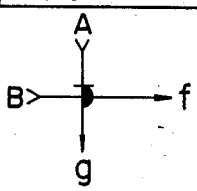  $f=\bar{A}+B$<br>$g=A$<br>(INVERTER IS AVAILABLE ONLY FOR CORRESPONDING GATE) |

FIG. 5B

| | LOGICAL SYMBOL OF THIS INVENTION | LOGICAL EQUATION | TRUTH-VALUE TABLE | ORDINARY LOGICAL SYMBOL |
|---|---|---|---|---|
| AND GATE | 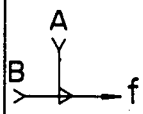  $f=A\cdot B$ | $f=A\cdot B$ | INPUT: A, A; OUTPUT: f<br>0 0 0<br>1 0 0<br>0 1 0<br>1 1 1 | 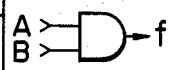  |
| INHIBIT GATE (1) | 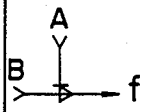  | $f=\bar{A}\cdot B$ | INPUT: A, B; OUTPUT: f<br>0 0 0<br>1 0 0<br>0 1 1<br>1 1 0 | 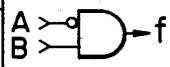  |
| INHIBIT GATE (2) | 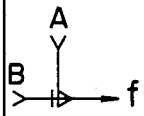  | $f=A\cdot\bar{B}$ | INPUT: A, B; OUTPUT: f<br>0 0 0<br>1 0 1<br>0 1 0<br>1 1 0 | 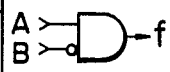  |
| INVERTED AND GATE | 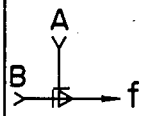  | $f=\bar{A}\cdot\bar{B}$ | INPUT: A, B; OUTPUT: f<br>0 0 1<br>0 1 0<br>1 0 0<br>1 1 0 | 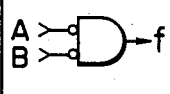  |
| EXAMPLES OF COMBINED LOGICAL CIRCUIT | 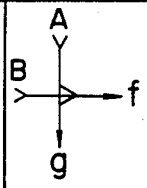  $f=A\cdot B$ $g=A$ | 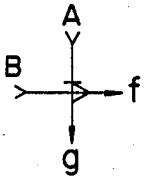  $f=\bar{A}\cdot B$ $g=A$ | 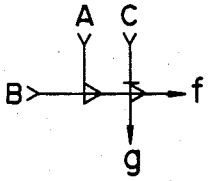  $f=A\cdot B\cdot\bar{C}$ $g=C$ (INVERTER IS AVAILABLE ONLY FOR CORRESPONDING GATE) | 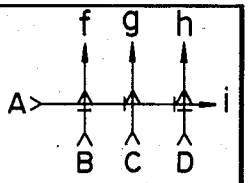  $f=A\cdot\bar{B}$ $g=\bar{A}\cdot C$ $h=\bar{A}\cdot\bar{D}$ $i=A$ |

FIG. 5C
| | LOGICAL SYMBOL OF THIS INVENTION | EQUIVALENT CIRCUIT | LOGICAL EQUATION | TRUTH-VALUE TABLE | ORDINARY LOGICAL SYMBOL |
|---|---|---|---|---|---|
| EXCLUSIVE-OR GATE | 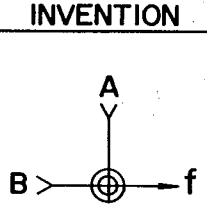  | 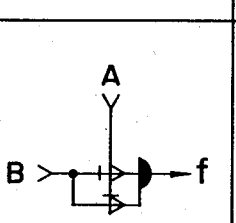  | $f=\bar{A}B+A\bar{B}$ | INPUT A B: 0 0, 1 0, 0 1, 1 1<br>OUT-PUT f: 0, 1, 1, 0 | 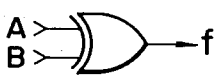  |
FIG. 6
| | |
|---|---|
| FIG. 7C-1 | FIG. 7C-2 |
| FIG. 7D-1 | FIG. 7D-2 |
| FIG. 7B-1 | FIG. 7B-2 |
| FIG. 7A-1 | FIG. 7A-2 |

| | LOGICAL SYMBOL OF THIS INVENTION | LOGICAL EQUATION | ORDINARY LOGICAL SYMBOL |
|---|---|---|---|
| AND-FUNCTIONING MATRIX CIRCUIT |   | $m = A \cdot B \cdot C$<br>$l = \bar{A} \cdot B \cdot C$<br>$k = A \cdot \bar{B} \cdot C$<br>$j = \bar{A} \cdot \bar{B} \cdot C$<br>$i = A \cdot B \cdot \bar{C}$<br>$h = \bar{A}\ B\ \bar{C}$<br>$g = A \cdot \bar{B} \cdot \bar{C}$<br>$f = \bar{A} \cdot \bar{B} \cdot \bar{C}$ |   |

FIG. 5E

| | LOGICAL SYMBOL OF THIS INVENTION | LOGICAL EQUATION | ORDINARY LOGICAL SYMBOL |
|---|---|---|---|
| OR-FUNCTIONING MATRIX CIRCUIT | 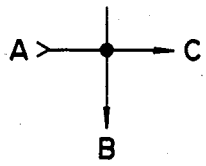  | B = A<br>C = A | 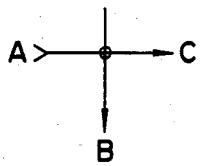  |
| EXAMPLE | 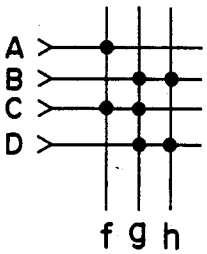  | f = A + C<br>g = B + C + D<br>h = B + D | |

FIG. 5F

| | | |
|---|---|---|
| AND-OR MATRIX CIRCUIT | 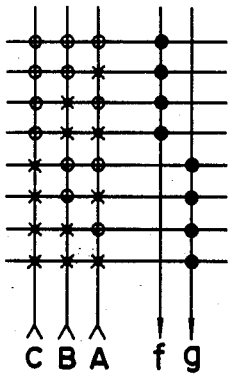  | $f = \bar{A}\cdot\bar{B}\cdot C + A\cdot\bar{B}\cdot C + \bar{A}\cdot B\cdot C + A\cdot B\cdot C$<br>$g = \bar{A}\cdot\bar{B}\cdot C + A\cdot\bar{B}\cdot\bar{C} + \bar{A}\cdot B\cdot\bar{C} + A\cdot B\cdot\bar{C}$ |

FIG. 10

| SCALE \ BLOCK ADDRESS | | 0 | 1 | 2 | 3 | 4 | 5 | 6 | 7 | 8 | 9 | 10 | 11 | 12 | 13 | 14 | 15 | NUMBER OF STEPS |
|---|---|---|---|---|---|---|---|---|---|---|---|---|---|---|---|---|---|---|
| ① | C | 10 | 8 | 8 | 8 | 8 | 8 | 8 | 8 | 8 | 8 | 8 | 8 | 8 | 8 | 8 | 8 | 130 |
| ② | B | 10 | 9 | 8 | 9 | 8 | 9 | 8 | 9 | 8 | 9 | 8 | 9 | 8 | 9 | 8 | 9 | 138 |
| ③ | A# | 10 | 9 | 9 | 9 | 9 | 9 | 9 | 9 | 10 | 9 | 9 | 9 | 9 | 9 | 9 | 9 | 146 |
| ④ | A | 10 | 10 | 9 | 10 | 10 | 10 | 9 | 10 | 9 | 10 | 9 | 10 | 10 | 10 | 9 | 10 | 155 |
| ⑤ | G# | 10 | 10 | 11 | 10 | 10 | 10 | 11 | 10 | 10 | 10 | 11 | 10 | 10 | 10 | 11 | 10 | 164 |
| ⑥ | C | 10 | 11 | 11 | 11 | 11 | 11 | 11 | 11 | 10 | 11 | 11 | 11 | 11 | 11 | 11 | 11 | 174 |
| ⑦ | F# | 10 | 12 | 12 | 12 | 11 | 12 | 11 | 12 | 12 | 12 | 11 | 12 | 11 | 12 | 11 | 12 | 184 |
| ⑧ | F | 10 | 12 | 13 | 12 | 12 | 12 | 13 | 12 | 13 | 12 | 13 | 12 | 12 | 12 | 13 | 12 | 195 |
| ⑨ | E | 10 | 13 | 13 | 13 | 14 | 13 | 13 | 13 | 13 | 13 | 13 | 13 | 14 | 13 | 13 | 13 | 207 |
| ⑩ | D# | 10 | 14 | 14 | 14 | 14 | 14 | 14 | 14 | 13 | 14 | 14 | 14 | 14 | 14 | 14 | 14 | 219 |
| ⑪ | D | 10 | 15 | 15 | 15 | 14 | 15 | 15 | 15 | 14 | 15 | 15 | 15 | 14 | 15 | 15 | 15 | 232 |
| ⑫ | C# | 10 | 16 | 15 | 16 | 16 | 16 | 15 | 16 | 16 | 16 | 15 | 16 | 16 | 16 | 15 | 16 | 246 |

CONTENTS OF INSTRUCTION FOR COMBINING VOLUME CURVES α, β

| α INSTRUCTION | | | β INSTRUCTION | | | α INSTRUCTION | | | β INSTRUCTION | | | α INSTRUCTION | | | β INSTRUCTION | | |
|---|---|---|---|---|---|---|---|---|---|---|---|---|---|---|---|---|---|
| A | D | R | A | D | R | A | D | R | A | D | R | A | D | R | A | D | R |
| 1 | 0 | 1 | 1 | 0 | 1 | 1 | 1 | 1 | 1 | 0 | 1 | 0 | 0 | 1 | 1 | 0 | 1 |
| | | | 1 | 0 | 0 | | | | 1 | 0 | 0 | | | | 1 | 0 | 0 |
| | | | 1 | 1 | 0 | | | | 1 | 1 | 0 | | | | 1 | 1 | 0 |
| | | | 1 | 1 | 1 | | | | 1 | 1 | 1 | | | | 1 | 1 | 1 |
| | | | 0 | 1 | 1 | | | | 0 | 1 | 1 | | | | 0 | 1 | 1 |
| | | | 0 | 1 | 0 | | | | 0 | 1 | 0 | | | | 0 | 1 | 0 |
| | | | 0 | 0 | 1 | | | | 0 | 0 | 1 | | | | 0 | 0 | 1 |
| 1 | 0 | 0 | 1 | 0 | 1 | 0 | 1 | 1 | 1 | 0 | 1 | | | | | | |
| | | | 1 | 0 | 0 | | | | 1 | 0 | 0 | | | | | | |
| | | | 1 | 1 | 0 | | | | 1 | 1 | 0 | | | | | | |
| | | | 1 | 1 | 1 | | | | 1 | 1 | 1 | | | | | | |
| | | | 0 | 1 | 1 | | | | 0 | 1 | 1 | | | | | | |
| | | | 0 | 1 | 0 | | | | 0 | 1 | 0 | | | | | | |
| | | | 0 | 0 | 1 | | | | 0 | 0 | 1 | | | | | | |
| 1 | 1 | 0 | 1 | 0 | 1 | 0 | 1 | 0 | 1 | 0 | 1 | | | | | | |
| | | | 1 | 0 | 0 | | | | 1 | 0 | 0 | | | | | | |
| | | | 1 | 1 | 0 | | | | 1 | 1 | 0 | | | | | | |
| | | | 1 | 1 | 1 | | | | 1 | 1 | 1 | | | | | | |
| | | | 0 | 1 | 1 | | | | 0 | 1 | 1 | | | | | | |
| | | | 0 | 1 | 0 | | | | 0 | 1 | 0 | | | | | | |
| | | | 0 | 0 | 1 | | | | 0 | 0 | 1 | | | | | | |

FIG. 14

| BLOCK ADDRESS | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| DIFFERENTIAL COEFFICIENT | | +4 | +2 | +1 | 0 | −2 | −2 | −4 | −1 | −2 | −1 | 0 | +2 | +1 | 0 | +2 |
| SELECTION OF VOLUME CURVE TYPE | | Ω | Ω | β | β | β | Ω | Ω | β | β | Ω | Ω | β | Ω | Ω | β |

FIG. 17

| OUTPUT OF ENVELOPE COUNTER | | | | | | ADDER INPUT IN CASE (1) | | | | | | ADDER INPUT IN CASE (2) | | | | | | | ADDER INPUT IN CASE (4) | | | | | | | |
|---|---|---|---|---|---|---|---|---|---|---|---|---|---|---|---|---|---|---|---|---|---|---|---|---|---|---|
| | 1 | 2 | 4 | 8 | 16 | 1 | 2 | 4 | 8 | 16 | | 1 | 2 | 4 | 8 | 16 | 32 | | | 1 | 2 | 4 | 8 | 16 | 32 | 64 |
| 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | 1 | 0 | 0 | 0 | 0 | 1 | 0 | 0 | 0 | 0 | 2 | 0 | 1 | 0 | 0 | 0 | 0 | 4 | 0 | 0 | 1 | 0 | 0 | 0 | 0 | 0 |
| 2 | 0 | 1 | 0 | 0 | 0 | 0 | 1 | 0 | 0 | 0 | 4 | 0 | 0 | 1 | 0 | 0 | 0 | 8 | 0 | 0 | 0 | 1 | 0 | 0 | 0 | 0 |
| 3 | 1 | 0 | 0 | 0 | 0 | 1 | 1 | 0 | 0 | 0 | 6 | 0 | 1 | 1 | 0 | 0 | 0 | 12 | 0 | 0 | 1 | 1 | 0 | 0 | 0 | 0 |
| 4 | 0 | 0 | 1 | 0 | 0 | 0 | 0 | 1 | 0 | 0 | 8 | 0 | 0 | 0 | 1 | 0 | 0 | 16 | 0 | 0 | 0 | 0 | 1 | 0 | 0 | 0 |
| 5 | 1 | 0 | 1 | 0 | 0 | 1 | 0 | 1 | 0 | 0 | 10 | 0 | 1 | 0 | 1 | 0 | 0 | 20 | 0 | 0 | 1 | 0 | 1 | 0 | 0 | 0 |
| 6 | 0 | 1 | 1 | 0 | 0 | 0 | 1 | 1 | 0 | 0 | 12 | 0 | 0 | 1 | 1 | 0 | 0 | 24 | 0 | 0 | 0 | 1 | 1 | 0 | 0 | 0 |
| 7 | 1 | 1 | 1 | 0 | 0 | 1 | 1 | 1 | 0 | 0 | 14 | 0 | 1 | 1 | 1 | 0 | 0 | 28 | 0 | 0 | 1 | 1 | 1 | 0 | 0 | 0 |
| 8 | 0 | 0 | 0 | 1 | 0 | 0 | 0 | 0 | 1 | 0 | 16 | 0 | 0 | 0 | 0 | 1 | 0 | 32 | 0 | 0 | 0 | 0 | 0 | 1 | 0 | 0 |
| 9 | 1 | 0 | 0 | 1 | 0 | 1 | 0 | 0 | 1 | 0 | 18 | 0 | 1 | 0 | 0 | 1 | 0 | 36 | 0 | 0 | 1 | 0 | 0 | 1 | 0 | 0 |
| 10 | 0 | 1 | 0 | 1 | 0 | 0 | 1 | 0 | 1 | 0 | 20 | 0 | 0 | 1 | 0 | 1 | 0 | 40 | 0 | 0 | 0 | 1 | 0 | 1 | 0 | 0 |
| 11 | 1 | 1 | 0 | 1 | 0 | 1 | 1 | 0 | 1 | 0 | 22 | 0 | 1 | 1 | 0 | 1 | 0 | 44 | 0 | 0 | 1 | 1 | 0 | 1 | 0 | 0 |
| 12 | 0 | 0 | 1 | 1 | 0 | 0 | 0 | 1 | 1 | 0 | 24 | 0 | 0 | 0 | 1 | 1 | 0 | 48 | 0 | 0 | 0 | 0 | 1 | 1 | 0 | 0 |
| 13 | 1 | 0 | 1 | 1 | 0 | 1 | 0 | 1 | 1 | 0 | 26 | 0 | 1 | 0 | 1 | 1 | 0 | 52 | 0 | 0 | 1 | 0 | 1 | 1 | 0 | 0 |
| 14 | 0 | 1 | 1 | 1 | 0 | 0 | 1 | 1 | 1 | 0 | 28 | 0 | 0 | 1 | 1 | 1 | 0 | 56 | 0 | 0 | 0 | 1 | 1 | 1 | 0 | 0 |
| 15 | 1 | 1 | 1 | 1 | 0 | 1 | 1 | 1 | 1 | 0 | 30 | 0 | 1 | 1 | 1 | 1 | 0 | 60 | 0 | 0 | 1 | 1 | 1 | 1 | 0 | 0 |
| 16 | 0 | 0 | 0 | 0 | 1 | 0 | 0 | 0 | 0 | 1 | 32 | 0 | 0 | 0 | 0 | 0 | 1 | 64 | 0 | 0 | 0 | 0 | 0 | 0 | 1 | 0 |
| 17 | 1 | 0 | 0 | 0 | 1 | 1 | 0 | 0 | 0 | 1 | 34 | 0 | 1 | 0 | 0 | 0 | 1 | 68 | 0 | 0 | 1 | 0 | 0 | 0 | 1 | 0 |
| 18 | 0 | 1 | 0 | 0 | 1 | 0 | 1 | 0 | 0 | 1 | 36 | 0 | 0 | 1 | 0 | 0 | 1 | 72 | 0 | 0 | 0 | 1 | 0 | 0 | 1 | 0 |
| 19 | 1 | 1 | 0 | 0 | 1 | 1 | 1 | 0 | 0 | 1 | 38 | 0 | 1 | 1 | 0 | 0 | 1 | 76 | 0 | 0 | 1 | 1 | 0 | 0 | 1 | 0 |
| 20 | 0 | 0 | 1 | 0 | 1 | 0 | 0 | 1 | 0 | 1 | 40 | 0 | 0 | 0 | 1 | 0 | 1 | 80 | 0 | 0 | 0 | 0 | 1 | 0 | 1 | 0 |
| 21 | 1 | 0 | 1 | 0 | 1 | 1 | 0 | 1 | 0 | 1 | 42 | 0 | 1 | 0 | 1 | 0 | 1 | 84 | 0 | 0 | 1 | 0 | 1 | 0 | 1 | 0 |
| 22 | 0 | 1 | 1 | 0 | 1 | 0 | 1 | 1 | 0 | 1 | 44 | 0 | 0 | 1 | 1 | 0 | 1 | 88 | 0 | 0 | 0 | 1 | 1 | 0 | 1 | 0 |
| 23 | 1 | 1 | 1 | 0 | 1 | 1 | 1 | 1 | 0 | 1 | 46 | 0 | 1 | 1 | 1 | 0 | 1 | 92 | 0 | 0 | 1 | 1 | 1 | 0 | 1 | 0 |
| 24 | 0 | 0 | 0 | 1 | 1 | 0 | 0 | 0 | 1 | 1 | 48 | 0 | 0 | 0 | 0 | 1 | 1 | 96 | 0 | 0 | 0 | 0 | 0 | 1 | 1 | 0 |
| 25 | 1 | 0 | 0 | 1 | 1 | 1 | 0 | 0 | 1 | 1 | 50 | 0 | 1 | 0 | 0 | 1 | 1 | 100 | 0 | 0 | 1 | 0 | 0 | 1 | 1 | 0 |
| 26 | 0 | 1 | 0 | 1 | 1 | 0 | 1 | 0 | 1 | 1 | 52 | 0 | 0 | 1 | 0 | 1 | 1 | 104 | 0 | 0 | 0 | 1 | 0 | 1 | 1 | 0 |
| 27 | 1 | 1 | 0 | 1 | 1 | 1 | 1 | 0 | 1 | 1 | 54 | 0 | 1 | 1 | 0 | 1 | 1 | 108 | 0 | 0 | 1 | 1 | 0 | 1 | 1 | 0 |
| 28 | 0 | 0 | 1 | 1 | 1 | 0 | 0 | 1 | 1 | 1 | 56 | 0 | 0 | 0 | 1 | 1 | 1 | 112 | 0 | 0 | 0 | 0 | 1 | 1 | 1 | 0 |
| 29 | 1 | 0 | 1 | 1 | 1 | 1 | 0 | 1 | 1 | 1 | 58 | 0 | 1 | 0 | 1 | 1 | 1 | 116 | 0 | 0 | 1 | 0 | 1 | 1 | 1 | 0 |
| 30 | 0 | 1 | 1 | 1 | 1 | 0 | 1 | 1 | 1 | 1 | 60 | 0 | 0 | 1 | 1 | 1 | 1 | 120 | 0 | 0 | 0 | 1 | 1 | 1 | 1 | 0 |
| 31 | 1 | 1 | 1 | 1 | 1 | 1 | 1 | 1 | 1 | 1 | 62 | 0 | 1 | 1 | 1 | 1 | 1 | 124 | 0 | 0 | 1 | 1 | 1 | 1 | 1 | 0 |

| CYCLE / DUTY | 0 | 1 | 2 | 3 | 4 | 5 | 6 | 7 |
|---|---|---|---|---|---|---|---|---|
| 1 | 1 | 1 | 1 | 1 | 1 | 1 | 1 | 1 |
| 1/2 | 1 | 0 | 1 | 0 | 1 | 0 | 1 | 0 |
| 1/4 | 1 | 0 | 0 | 0 | 1 | 0 | 0 | 0 |
| 1/3 | 0 | 0 | 0 | 1 | X | X | 0 | 0 |

ELAPSE OF TIME

FIG. 21

| SWITCH | MEMORY LINE | CYCLE / MODE | 0 | 1 | 2 | 3 | 4 | 5 | 6 | 7 | DUTY α | DUTY β |
|---|---|---|---|---|---|---|---|---|---|---|---|---|
| α,β ARE NOT SEPARATED | ALL MEMORY LINES | 0 | αβ | αβ | αβ | αβ | αβ | αβ | αβ | αβ | 1 | 1 |
| | | 1 | αβ | | αβ | | αβ | | αβ | | 1/2 | 1/2 |
| | | 2 | αβ | | | | αβ | | | | 1/4 | 1/4 |
| | | 3 | αβ | α | αβ | α | αβ | α | αβ | α | 1 | 1/2 |
| | | 4 | αβ | α | α | α | αβ | α | α | α | 1 | 1/4 |
| | | 5 | αβ | | α | | αβ | | α | | 1/2 | 1/4 |
| | | 6 | αβ | | α | β | | | α | | 1/2 | 1/3 |
| | | 7 | αβ | | β | αβ | | | β | | 1/3 | 1/2,1/3 |
| α,β ARE SEPARATED | EVEN LINE MEMORY | 0 | α | α | α | α | α | α | α | α | 1 | 0 |
| | | 1 | α | | α | | α | | α | | 1/2 | 0 |
| | | 2 | α | | | | α | | | | 1/4 | 0 |
| | | 3 | α | α | α | α | α | α | α | α | 1 | 0 |
| | | 4 | α | α | α | α | α | α | α | α | 1 | 0 |
| | | 5 | α | | α | | α | | α | | 1/2 | 0 |
| | | 6 | α | | α | | | | α | | 1/2 | 0 |
| | | 7 | α | | | α | | | | | 1/3 | 0 |
| | ODD LINE MEMORY | 0 | β | β | β | β | β | β | β | β | 0 | 1 |
| | | 1 | β | | β | | β | | β | | 0 | 1/2 |
| | | 2 | β | | | | β | | | | 0 | 1/4 |
| | | 3 | β | | β | | β | | β | | 0 | 1/2 |
| | | 4 | β | | | | β | | | | 0 | 1/4 |
| | | 5 | β | | | | β | | | | 0 | 1/4 |
| | | 6 | β | | | β | | | | | 0 | 1/3 |
| | | 7 | β | | β | β | | | β | | 0 | 1/2,1/3 |

FIG. 26

| | |
|---|---|
| FIG. 27A-1 | FIG. 27A-2 |
| FIG. 27B-1 | FIG. 27B-2 |

ELECTRONIC MUSICAL INSTRUMENT

This application is a continuation of application Ser. No. 320,768, filed Nov. 13, 1981, abandoned, which is a division of application Ser. No. 215,024 filed Dec. 10, 1980, abandoned, which is a continuation of Ser. No. 020,749, filed Mar. 15, 1979, now abandoned.

BACKGROUND OF THE INVENTION

The invention relates to an electronic musical instrument using a novel technique enabling a major part of a musical sound generating section to be constructed by digital circuitry.

Analog technology has dominantly been used in the field of electronic musical instruments such as electronic organs, electronic pianos and musical synthesizers, but digital technology which has recently made a marked advance, has also been used partly in this field.

A tremendously complicated control is necessary to fabricate a major part (a musical sound wave formation unit, a scale period formation unit, a unit for forming a curve tracing the positive-goings and the negative-goings of volume, and the like) in the music sound producing stage of an electronic musical instrument, by large scale integrated circuit (LSI) technology on the basis of the digital technology. However, no electronic musical instrument with a simple construction, resulting from a full application of the digital technology to the musical instrument construction, has successfully been developed.

In electronic musical instruments, the formation of various musical sound waves is of great importance for the purpose of producing the musical sounds having various timbre. For this, many proposals for designating the musical sound waves have been made. In one of the proposals, sine waves ranging from a fundamental wave to higher harmonics with given orders are stored into a plurality of memories in the form of digital signals representing the amplitudes of the waves. When a musical sound is designated, sine waves with the related orders are selectively and simultaneously read out and then those sine waves read out are synthesized to form a specified waveform of musical sound. Another proposal permanently stores digital signals representing fundamental waves such as a triangle wave, a sine wave, a rectangular wave and a saw-tooth wave in a waveform memory unit. An additional proposal is to store permanently signals representing digitally or analogously given waves of musical sounds in a fixed memory.

In order to obtain an artificial musical sound wave fairly analogous to its original natural musical sound, not only an analogous musical sound is used but also a volume envelope including factors such as wave rises and wave falls must be superposed on the analogous musical sound. However, there have been no proposals to effectively superpose the volume envelope on the sound wave by the digital technology. The conventional superposition of the volume envelope has been made by the analog technology or by using a complex control circuit. Thus, the musical sound wave formation technique by the digital technology, which is well adapted for LSI fabrication, has not yet been established in this field. A waveform dependent on frequency spectrum (for example, a harmonic structure in an ordinary state) and a volume envelope ranging from a wave rise to a wave fall or damping are generally major factors to determine a timbre of a musical sound produced by a natural musical instrument. However, a timbre peculiar to the natural musical instrument is greatly influenced by other various factors, for example, time-variation of the harmonic structure arising from delay of higher harmonic components which are observed at the time of sound producing by the brasses, subtle fluctuation of higher harmonics, noise superposition which is observed at the time of plucking the strings, rapid disappearing of higher harmonics at the damping. Therefore, the time-variation of the harmonic structure must be taken into consideration, in addition to the waveforms and the volume envelope, in order to eliminate dull and bold sound feeling produced by electrical signals of the electronic musical instrument and to obtain natural sound feeling of the electronic musical sound.

In a conventional electronic musical instrument, for example, an electronic organ, the harmonic structure is not changed every sound and a volume envelope is merely superposed on the simple musical sound waves. In another example wherein musical sounds of pianos or cembalos are previously preset, the musical sound wave produced is a single wave previously set. A synthesizer, which is a single sound instrument, changes a filtering frequency band with time through an analog filtering operation by using a voltage controlled type filter (VCF) or the like. The change direction of the frequency band is relatively simple, for example, "low frequency to high frequency" or "high frequency to low frequency". Accordingly, additional sound effect units are further needed for securing more natural sound feeling. The synthesizer of the type enabling a chord performance needs a filter and a sound effect means for each performance key. This leads to complexity and bulky circuit construction of the musical sound instrument, and expensiveness of its manufacturing cost.

The conventional electronic musical instrument employs the analogue technology for the time-variation problem of the higher harmonic structure. Direct application of the technology for the chord performance involves many problems to be solved. Thus, the present state of this art has not provided a satisfactory musical sound wave formation by the digital technology suitable for the LSI and with the harmonic structure being time-variable for each sound.

Let us consider the formation of scale periods. In electronic musical instruments, the sound source frequencies corresponding to performance keys are determined on the basis of a temperament scale. A so-called frequency dividing sound source system is generally used for the formation of the sound source frequencies. In the system, a reference clock frequency is frequency-divided by a plurality of stages of frequency dividing circuits. And the respective sound source frequencies are formed by selecting proper combinations of the frequency dividing ratios among the frequency dividing circuits. A desired waveform is read out from a musical sound wave memory, for example, by the sound source frequency corresponding to an actuated performance key. The conventional electronic music instrument is designed mainly for a single sound. The chord performance by simultaneous actuation of plural performance keys, therefore, requires scale period control circuits each for each performance key for parallel processing purposes. This results in a considerably large circuit construction. An alteration is conceivable in which a single scale period control circuit is used commonly for a number of performance keys and is used in a time-division fashion. In this case, since the resolution is 1/n for n performance keys, one time processing control is performed for n time operations for one performance key. Bear this in mind, when a scale period is set for each performance key and a musical sound is produced, the circuit construction design is considerably complicated. Thus, there has been no practical scale period control apparatus by digital technology which is simple in construction and well suited for the chord performance. This is also true for the digital processing system permitting the chord performance by plural-key actuation and the time-division dynamic processing in such a case.

Accordingly, an object of the invention is to provide an electronic musical instrument with a novel music sound generating technique implemented by the digital technology.

Another object of the present invention is to provide an electronic musical instrument in which a major part of the circuitry for producing musical sounds is substantially constructed by a digital circuit suitable for an LSI fabrication.

Still another object of the invention is to provide an electronic musical instrument which can form musical sound waves by a digital circuit implementing a novel technique.

A further object of the invention is to provide an electronic musical instrument in which the time-variation of a higher harmonic structure of musical sound is processed by the digital technology thereby to produce a musical sound with attractive timbre.

Still a further object of the invention is to provide an electronic musical instrument by using a novel technique capable of instructing simultaneously different waveforms.

An additional object of the invention is to provide an electronic musical instrument with a novel technique by which different waveforms may be simultaneously instructed and synthesized, and not only different waveforms but also the periods of different waves may be controlled to have M:N relation.

An even further object of the invention is to provide an electronic musical instrument with a novel technique which provides different volume envelope curves for different waveforms thereby to form a great variety of synthesized musical sound waveforms.

Another object of the invention is to provide an electronic musical instrument with a novel technique in which a scale period may be set by a digital counting control.

Yet another object of the invention is to provide an electronic musical instrument in which a chord performance is possible by digital dynamic processing technique.

SUMMARY OF THE INVENTION

To achieve the above and other objects of the invention, there is provided an electronic musical instrument comprising: a volume control means to increase or decrease performance volume in accordance with the lapse of time since the actuation of a performance key; a period counting means for counting one cycle of a musical sound waveform by a plurality of counting steps in order to produce digitally a musical sound wave; a means for dividing the one cycle into m blocks each including one or more courting steps; and a musical sound wave instructing means for instructing the rise and fall of the musical sound wave in each block by a positive or negative value which is an integral multiple of a control value of the volume control means, wherein the one cycle of the musical sound wave is divided into m blocks and these blocks are properly instructed while at the same time a volume control may be made.

With such a construction, an electronic musical instrument or a musical sound forming system by the digital technology is provided in which a musical sound wave may be formed on the basis of an instruction of a musical sound wave in each block and at the same time a volume control is also possible. The system is also applicable for a digital volume control of different volume rise and fall curves as observed in pianos, guitars and the like. A volume change as well as wave form variation may be properly set so that the higher harmonic structure may be greatly varied with time, thereby to provide musical sounds with attractive timbres.

In implementing the chord performance, a dynamic single scale period setting means can be used for a number of performance keys, with independent scale period control. This simplifies the related circuit construction.

With those useful features of the invention, a main control portion of the electronic musical instrument, except for the output sound producing stage, may be fabricated by LSI. Consequently, the invention can provide a versatile and simple electronic musical instrument with a high reliability.

BRIEF DESCRIPTION OF THE DRAWINGS

FIGS. 5A, 5B, 5C, 5D, 5E and 5F show logical symbols used in the embodiments of the invention;

FIG. 6 is a diagram for showing relative positions of FIGS. 7A, 7B, 7C and 7D;

FIG. 10 shows a relation between the number of steps and the scales shown in the FIGS. 7A and 7B;

FIG. 14 is a representation showing contents of instructions for combining volume curves defined by $\alpha$ and $\beta$;

FIG. 17 represents output addition values used in the circuitry shown in FIG. 7C;

FIG. 21 is a representation for explaining an operation of the instrument of this invention in detail with respect to the $\alpha$ mode and the $\beta$ mode;

FIG. 26 is a diagram for showing relative positions of FIGS. 27A and 27B;

DETAILED DESCRIPTION

Figure 1:
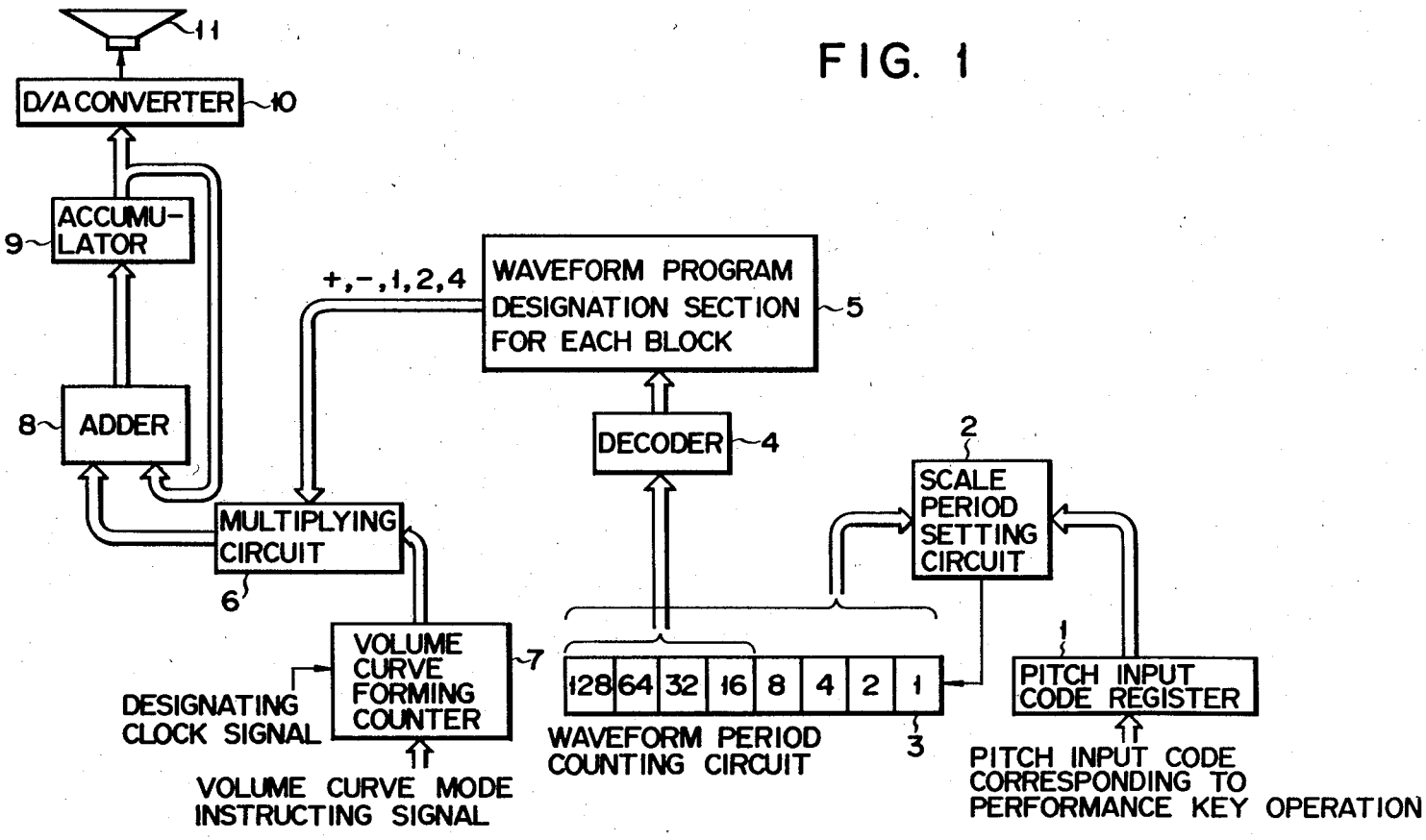
FIG. 1 is a block diagram of an electronic musical instrument constructed by the basic concept of this invention.

The principle of an electronic musical instrument according to the invention will first be given with reference to FIG. 1 illustrating, by way of a block diagram, an overall system of the instrument.

In the figure, a pitch input code register 1 stores pitch input codes correspondingly generated upon depressions of performance keys (not shown) of 48 pitch keys, for example, permitting a basic compass of four octaves each of 12 scales. The pitch input code loaded in the register 1 is applied to a scale period setting circuit 2 to control a scale clock frequency. Upon receipt of the pitch input code, the setting circuit 2 produces a scale clock frequency signal corresponding to the pitch input code applied, which in turn is applied as a count signal to a waveform period counting circuit 3 which counts the period of a basic one cycle of a musical sound waveform in plural counting steps. A binary counter is preferable for the period counting circuit 3. The period counter 3 used in this example is constructed by 8 bits each weighted by "1", "2", "4", "8", "16", "32", "64" and "128", and can count "256" of decimal numbers from "0" to "255". The use of such a counter permits a basic one cycle of the musical sound wave to be expressed by 256 counting steps corresponding to the counts of the scale of 256. The counting steps of "256" are grouped together into m blocks each including one or more count steps. In this example, m=16, that is to say, one cycle of the musical sound is divided into 16 blocks. And each block is expressed by "16" counting steps (corresponding to "0" to "15" of decimal numbers). The counts of the period counting circuit 3, which are represented by 4 bit binary codes having weights of "16", "32", "64" and "128", may be assigned to "16" blocks arranged in time, addresses of the blocks, as shown in Table 1.

TABLE 1

| Counts of Period Counting Circuit | | | | Block | Counts of Period Counting Circuit | | | | Block |
|---|---|---|---|---|---|---|---|---|---|
| 16 | 32 | 64 | 128 | Addresses | 16 | 32 | 64 | 128 | Addresses |
| 0 | 0 | 0 | 0 | 0 | 0 | 0 | 0 | 1 | 8 |
| 1 | 0 | 0 | 0 | 1 | 1 | 0 | 0 | 1 | 9 |
| 0 | 1 | 0 | 0 | 2 | 0 | 1 | 0 | 1 | 10 |
| 1 | 1 | 0 | 0 | 3 | 1 | 1 | 0 | 1 | 11 |
| 0 | 0 | 1 | 0 | 4 | 0 | 0 | 1 | 1 | 12 |
| 1 | 0 | 1 | 0 | 5 | 1 | 0 | 1 | 1 | 13 |
| 0 | 1 | 1 | 0 | 6 | 0 | 1 | 1 | 1 | 14 |
| 1 | 1 | 1 | 0 | 7 | 1 | 1 | 1 | 1 | 15 |

The 8-bit outputs from the respective stages of the period counting circuit 3 are applied to the scale period setting circuit 2 to control the frequency of the scale clock frequency signal corresponding to the pitch input code as will be described later. The upper four bits (the weights "16", "32", "64" and "128") of the period counting circuit 3 are applied as a block address signal of the 16 blocks to a waveform program designation section 5 for each block, through a decoder 4. The waveform program designation section 5 is represented by "0" to "15" of one cycle of a musical sound waveform. A changing amount (the absolute value of "0", "1", "2" or "4" in this example) of the amplitude of a positive going or a negative going waveform at each block address is expressed by a numeral with a sign +(up) or −(down) attached thereto. The changing amount (differential value) of the amplitude is called a differential coefficient. Signals representing a differential coefficient and "+" or "−" which are designed for each block address by the waveform program designation section 5 are sequentially outputted in synchronism with a block address signal transferred from the decoder 4, for transmission to a multiplying circuit 6. The multiplying circuit 6 is supplied with a control amount (counts of the counter) from a volume curve forming counter 7 (referred to as an envelope counter 7) for digitally performing a volume control to increase or decrease a performance volume with the lapse of time from the depression of a performance key. Thus, the multiplying circuit 6 multiplies the differential coefficient from the waveform program designation section 5 by the control amount in accordance with the designation of "+" or "−" and in synchronism with the block address. The envelope counter 7 counts up or down a designation clock (called as an envelope clock), along a volume control curve including attack, decay and release sections to be described later, in accordance with a selected one of various volume curve modes (referred to as envelopes) to also be described later. The counts of the envelope counter 7 are integer values from "0" to "31" and are each called as an envelope coefficient (represented by E). An example of the envelope mode is illustrated in FIG. 2.

Figure 4A:
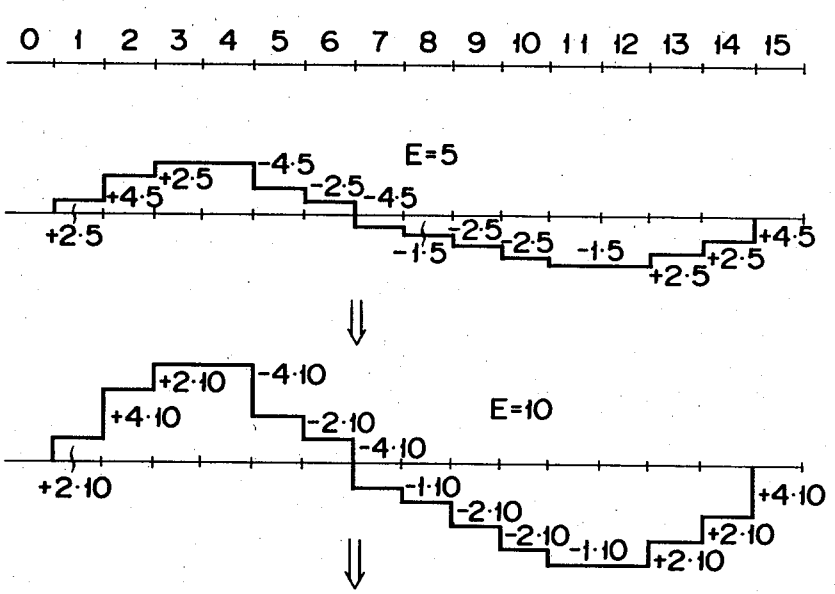
FIGS. 4A, 4B and 4C show relative changes among the musical sound waves according to a value of an envelope coefficient.
Figure 2:
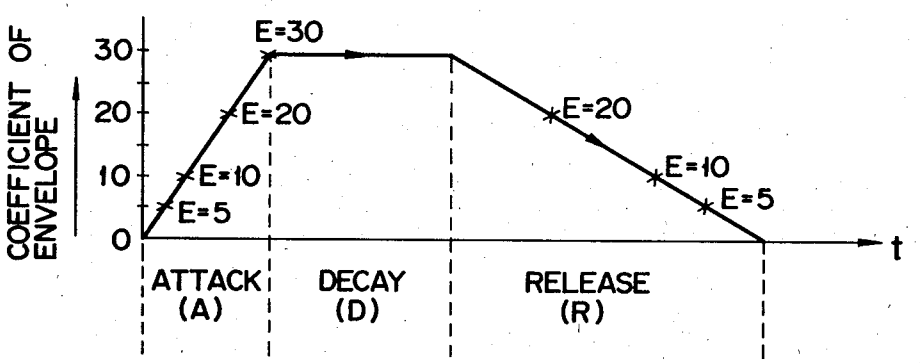
FIG. 2 is a graph for explaining an envelope mode used in the instrument shown in FIG. 1.
Figure 3:
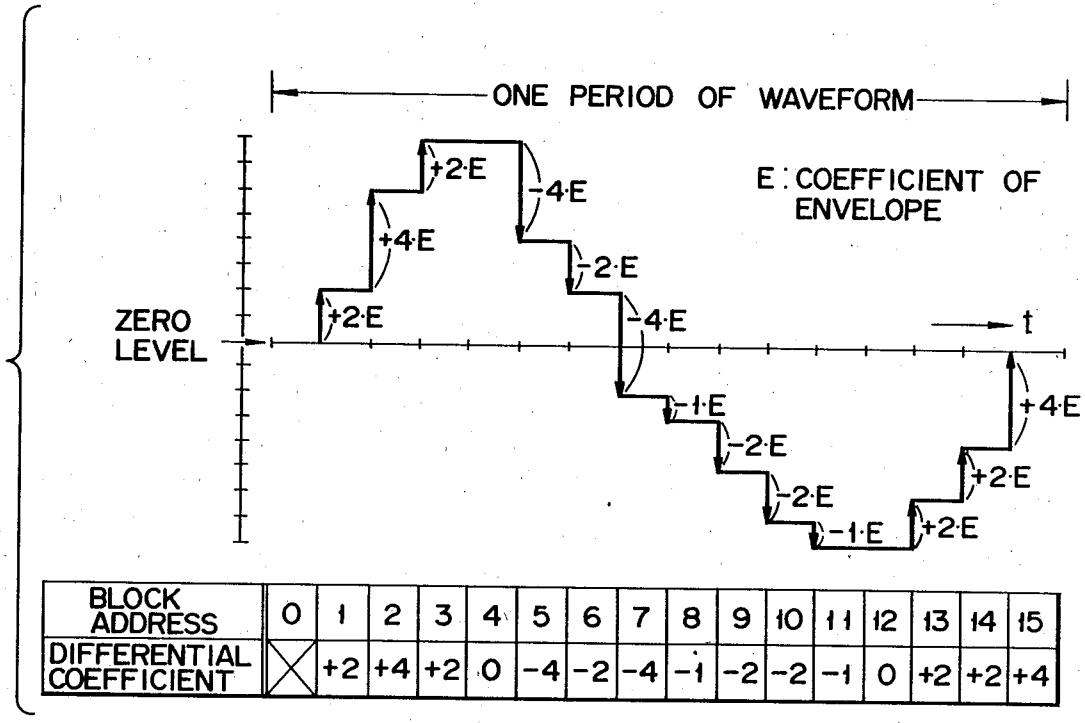
FIG. 3 is a graph for explaining the basic operation of the instrument shown in FIG. 1 for designating a musical sound wave.
Figure 4B:
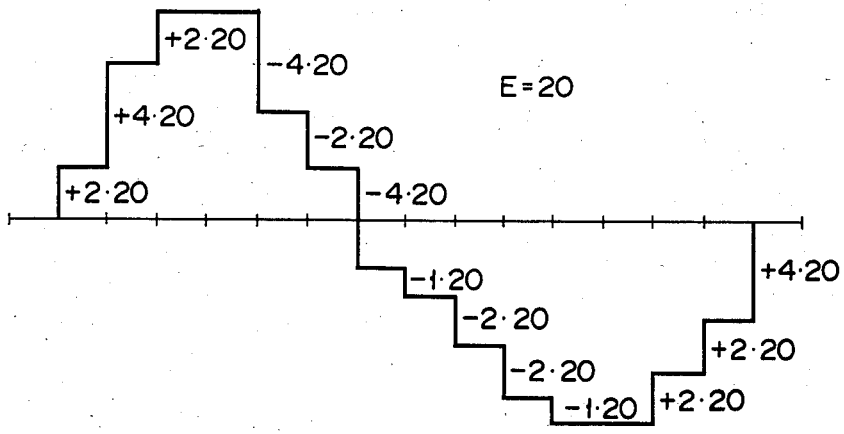
Figure 4C:
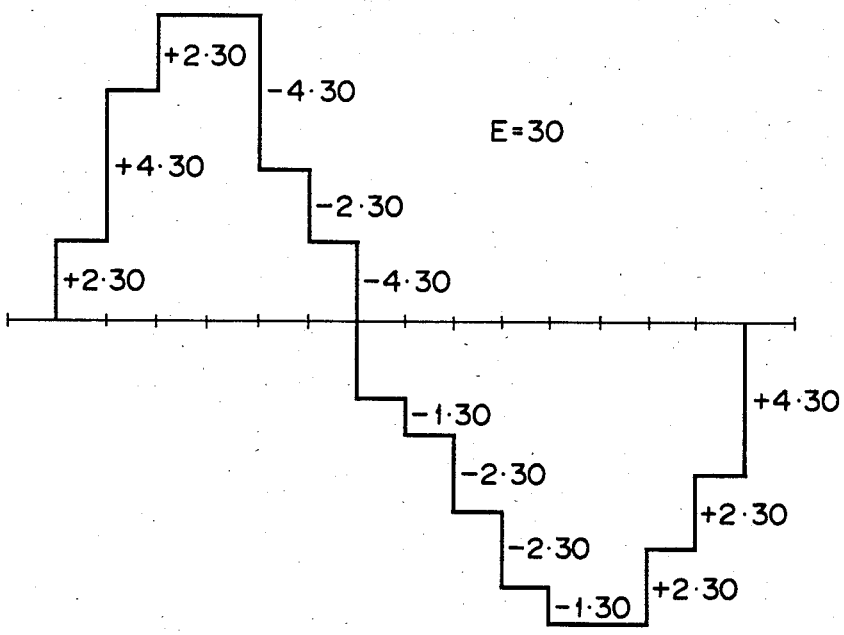
Figure 5D:
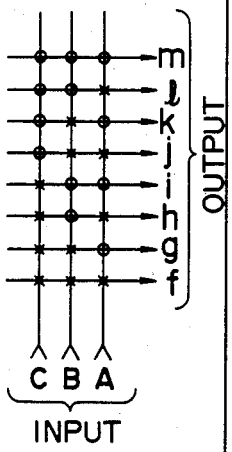
Figure 5D:
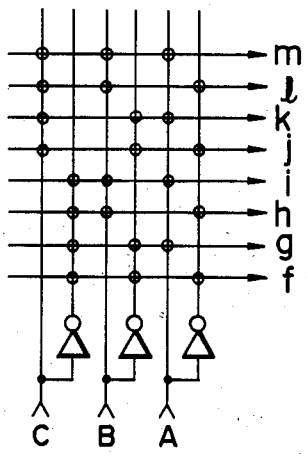

The differential coefficient previously designated every block address by the waveform program designation section 5 is represented by an integer multiple of the corresponding envelope coefficient E shown in FIG. 2, which is affixed by symbols "+" or "−". It is for this reason that the multiplying circuit 6 executes the + operation or the − operation (differential coefficient x envelope coefficient E). An example of it is diagramatically illustrated in FIG. 3. As shown, there is illustrated a relation of the envelope coefficient value E to the differential values of the blocks at the block addresses "0" to "15" during one period of the musical sound waveform. The variations of the relative magnitudes of the musical sound waveforms, including volume control values at the time points where the envelope coefficient values E in the envelope mode shown in FIG. 2 is "5", "10", "20" and "30", accordingly become as shown in FIGS. 4A, 4B and 4C. These time points correspond to the points indicated by symbols x in FIG. 2. The relative variation of the musical sound waveform of course, changes successively with the envelope coefficient value E also changing with time. In this example, only in the block address "0", no designation of the differential coefficient, "+" and "−" is carried out and the relative variation of the musical sound waveform is always zero.

The output signal of the multiplying circuit 6 is applied to one of the input sides of an adder 8 of which the output signal is fed back to the other input side of the adder 8, through an accumulator 9. With this circuit connection, a variation amount which is the multiplier output value of the present block is accumulated to the multiplier output value of the preceding block. The musical sound waveforms shown in FIG. 3 and FIGS. 4A, 4B and 4C are taken out of the accumulator 9. The output signal of the accumulator 9 is applied through a digital to analog (D-A) converter 10 to a loud-speaker 11 which in turn sounds with the pitch corresponding to the performance key operated.

Before entering the detailed description of the present invention, logic symbols used in the description of the invention to be detailed hereinafter will first be presented in FIGS. 5A, 5B, 5C, 5D and 5E where logical formulas, truth value tables, general logic symbols and combined circuits are illustrated. Notable here is that inverter symbols attached to input lines of OR gates and AND gates are effective only for the gates with such symbols attached thereto. For further details of this, reference is made to the combined circuits in the respective drawings related.

Figures 1, 7A:
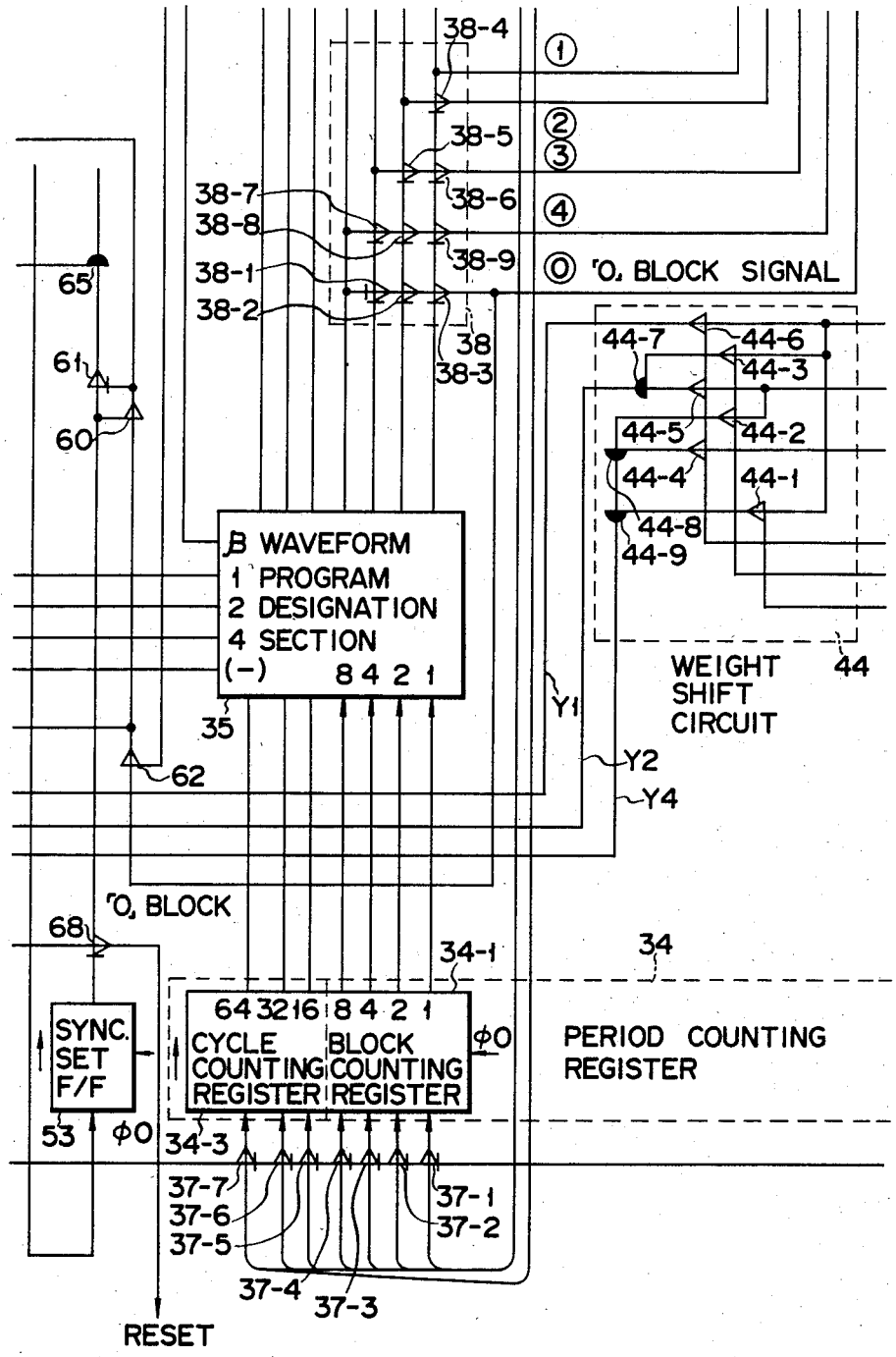
FIGS. 7A, 7B, 7C and 7D show a circuit diagram of a concrete circuit arrangement of a major part of the instrument of this invention.
Figures 2, 7A:
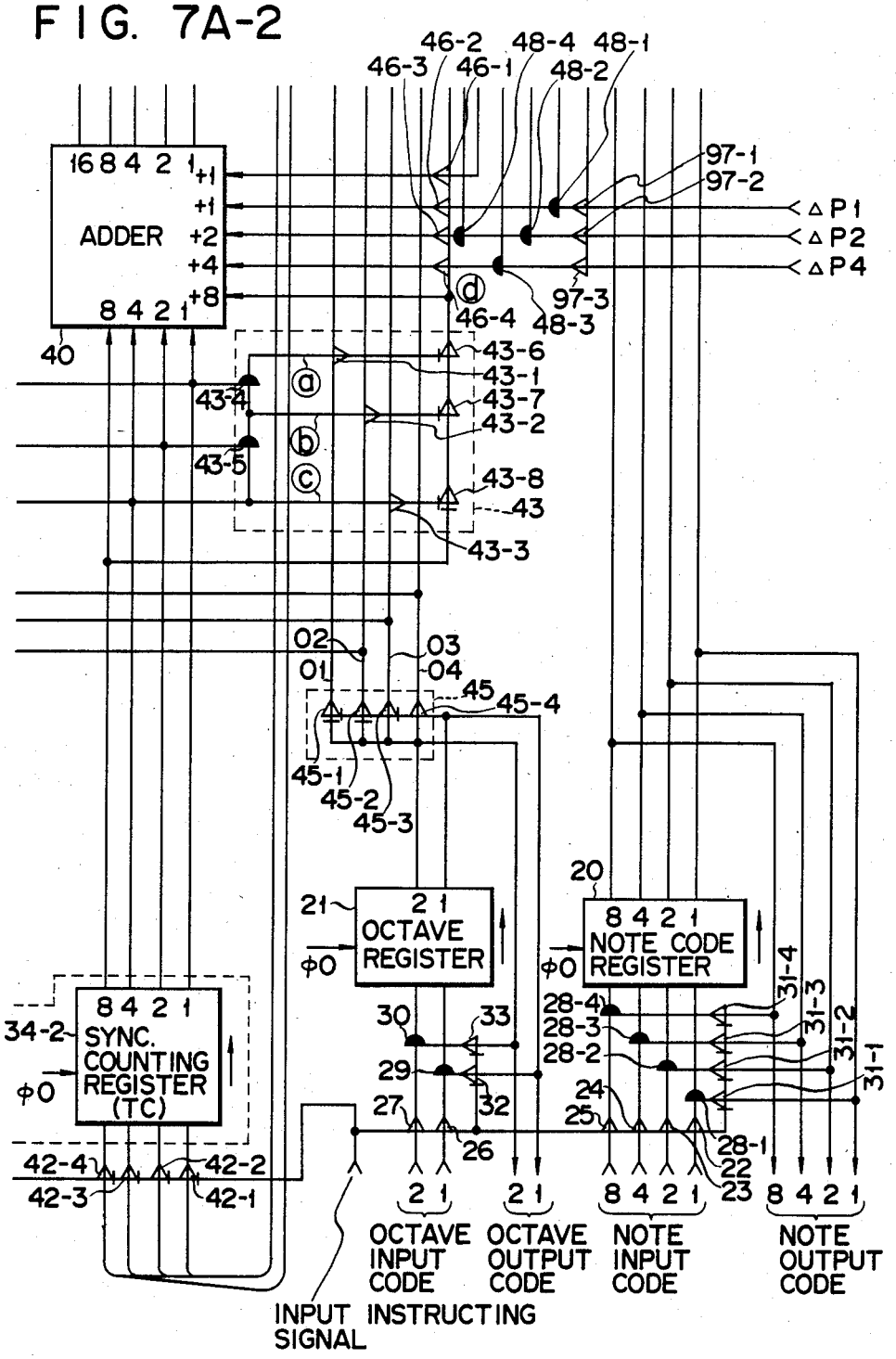

FIG. 6 shows an overall arrangement of the drawings of FIGS. 7A, 7B, 7C and 7D. In FIG. 7A, a scale or note code register 20 has input terminals of 4 bits ("1", "2", "4", "8" weights) and 8 line memories permitting 4 bits to shift in parallel in an arrow direction. An octave code register 21 has input terminals of 2 bits ("1" and "2" weights) 8 line memories permitting 2 bits to shift in parallel in an arrow direction. Those registers store scale input codes and octave input codes delivered from performance keys actuated. More specifically, in synchronism with the generation of an input instructing signal relating to the actuation of a performance key to be described later, the corresponding scale input code and octave input code are inputted to the scale code register 20 and the octave code register 21, through AND gates 22 to 27, OR gates 28-1 to 28-4 and OR gates 29 and 30. The scale code and the octave code (referred to as a pitch code) are shifted successively and parallelly in an arrow direction in response to a shift pulse $\phi_0$ (a basic clock of the present system). After 8 $\phi_0$ shift time lapse, those codes are returned to the corresponding registers through inhibit gates 31-1 to 31-4 and 32 and 33. In this manner, those codes are subjected to a so-called dynamic shift operation. In synchronism with a new input indication signal, those inhibit gates 31-1 to 31-4 and 32 to 33 are closed so that the pitch codes stored in the respective registers 20 and 21 are erased.

As described above, the scale code register 20 and the octave code register 21 have each 8 line memories. Accordingly, if 8 different performance keys are simultaneously depressed, these registers accept the corresponding scale input codes and octave input codes at proper timings in synchronism with the input instructing signal and permit the dynamic shift recirculation of those codes. That is to say, eight sounds are controlled in a time-division manner. The scale code and octave code in the present system are shown in Tables 2 and 3.

TABLE 2

| Name of Scale | Scale Code 8 | 4 | 2 | 1 |
|---|---|---|---|---|
| C | 1 | 1 | 1 | 1 |
| B | 1 | 1 | 1 | 0 |
| A# | 1 | 0 | 1 | 1 |
| A | 1 | 0 | 1 | 0 |
| G# | 1 | 0 | 0 | 1 |
| G | 1 | 0 | 0 | 0 |
| F# | 0 | 1 | 1 | 1 |
| F | 0 | 1 | 1 | 0 |
| E | 0 | 0 | 1 | 1 |
| D# | 0 | 0 | 1 | 0 |
| D | 0 | 0 | 0 | 1 |
| C# | 0 | 0 | 0 | 0 |

TABLE 3

| Octave Order | Octave Code 2 | 1 |
|---|---|---|
| $0_1$ | 0 | 0 |
| $0_2$ | 0 | 1 |
| $0_3$ | 1 | 0 |
| $0_4$ | 1 | 1 |

A period counting register 34 period-counts one cycle of a musical sound wave in accordance with the pitch codes recirculatingly stored in the registers 20 and 21. Like the registers 20 and 21, the period counting register 34 is provided with 8 line memories for effecting successive dynamic shifting by a shift pulse $\phi 0$ in an arrow direction. The register 34 is comprised of a block counting register 34-1, a synchronizing counting register (TC register) 34-2 and a cycle number register 34-3. In order to divide one cycle of a musical sound wave into "16" blocks with time lapse, the register 34-1 is of 4-bit, hexadecimal type (corresponding to the block addresses of "16" blocks from "0" to "15" shown in Table 1) for storing the address of each block. The synchronizing counting register (TC register) 34-2 is of 4-bit, hexadecimal for controlling the number of counting steps for each block to be described in detail, for producing a summing timing signal to instruct the clock counting. The cycle number register 34-3 is of 3-bit, octal type which operates every cycle of the block counting register 34-1. The counting contents of each line memory generated from each output of the cycle number register 34-3 passes directly through the waveform program designation unit 35 for each block to be described later, and is recirculatingly held in an adder 36 shown in FIG. 7B through the recirculation gates such as the inhibit gates 37-1 to 37-7. In the recirculating cycle, the adder 36 which is operated in binary mode is subjected to "+1" step of counting at the adding timing signal generation mentioned above. The 4-bit output ("1", "2", "4", and "8" weights) (see FIG. 8A) is applied to a block state detecting circuit 38 for detecting a specified block address in the block addresses of "16". The circuit 38 produces from the output 0 a "0" block address signal shown in FIG. 8B, and from the outputs ①, ②, ③, and ④ output signals shown in FIG. 8C are obtained. The output signals ① to ④ are applied to a scale step matrix circuit 39 for determining a step correction number for each scale to be referred to later. The output signal from the output ⓪ is a ⓪ block address signal under a condition "$\bar{1}$, $\bar{2}$, $\bar{4}$, $\bar{8}$" in which weights "1", "2", "4" and "8" are all "0", with a series connection of an inverted AND gate 38-1, and inhibit gates 38-2 and 38-3. The output signal from the output ① is directly taken out from the circuit 38 and is an odd number block address signal. The output ② provides "2", "6", "10" and "14" block address signals through an inhibit gate 38-4 with a condition "$\bar{1}\cdot 2$" in which the weight "1" is "0" and the weight "2" is "1". The output ③ provides "4" and "12" block address signals, with a series connection of inhibit gates 38-5 and 38-6 for satisfying a condition "$4\cdot 2\cdot \bar{1}$" in which the weight "4" is "1" and the weights "2" and "1" are both "0". The output ④ provides an "8" block address signal, with a series connection inhibit gates 38-7 to 9 for satisfying a condition "$8\cdot\bar{4}\cdot\bar{2}\cdot\bar{1}$" in which the weight "8" is "1" and the weights "4", "2" and "1" are "0".

Figure 9:
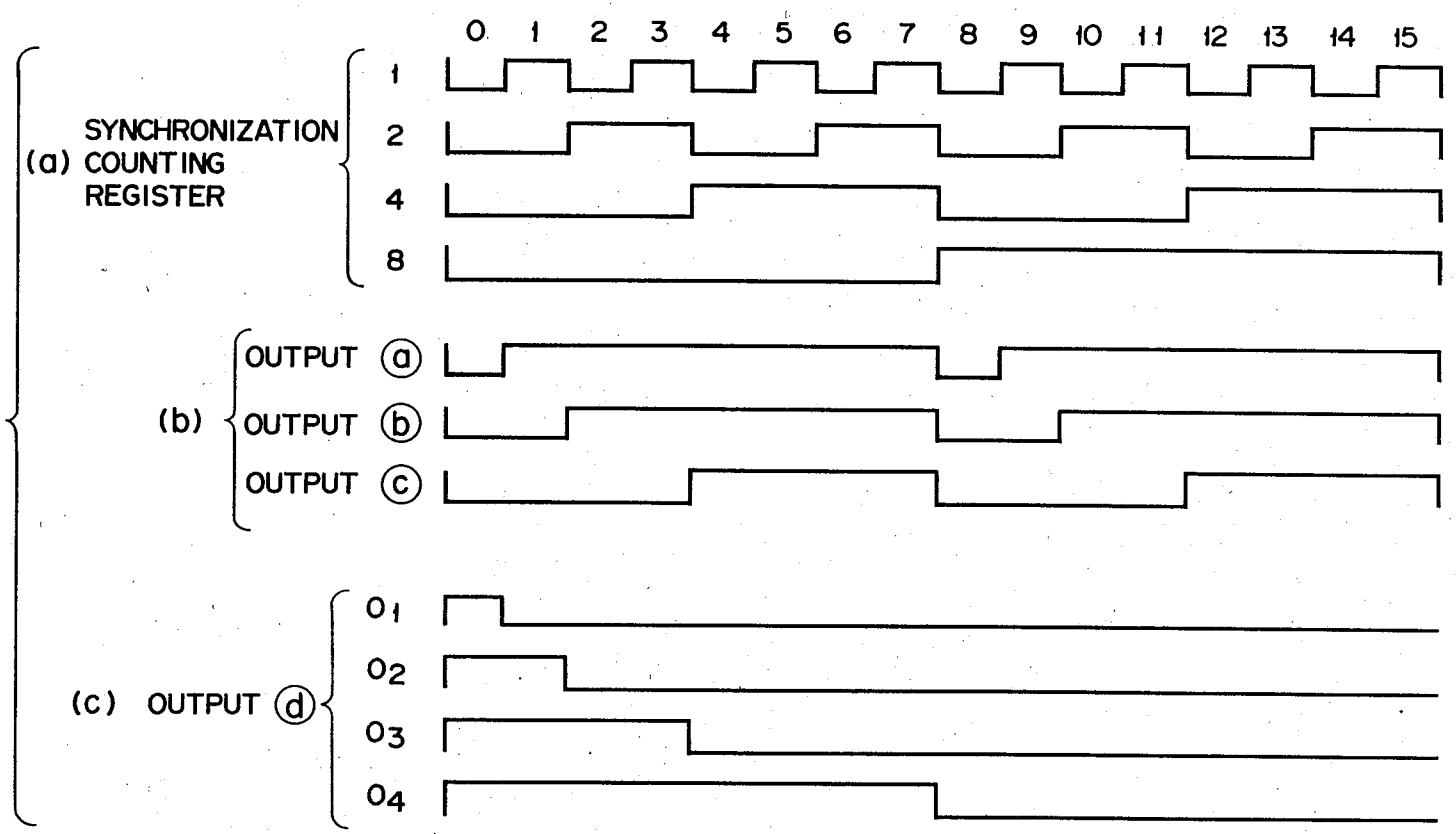
FIG. 9 is a time chart showing a timing of addition timing outputs of respective octaves relating to the operation of the synchronizing register shown in FIG. 7A.

The outputs of 4 bits of the synchronizing counting register (TC register) 34-3 is coupled with the input of an adder 40. The respective 5-bit outputs of the adder 40 are coupled with a subtracter 41. The 4-bit outputs of the subtracter 41 are returned to the corresponding inputs, through recirculating control gates such as inhibit gates 42-1 to 42-4. The outputs of the synchronizing counting register 34-2 are coupled with the addition timing generator 43 which produces the addition timing signal to the adder 36 in accordance with the respective octaves. The three bits outputs of "1", "2" and "4" weights of the register 34-2 are applied to a weight shift circuit 44. Applied to the addition timing generating circuit 43 and the weight shift circuit 44 are the output signals of an octave code decoder 45 which produces first to fourth octave signals ($0_1$ to $0_4$) depending on the state of 2-bit output outputted from the octave code register 21. Specifically, an inverted AND gate 45-1 of the octave code decoder 45 produces a first octave signal $0_1$ when detecting the code state shown in Table 3. Similarly, the inhibit gate 45-2 produces a second octave signal $0_2$; an inhibit gate 45-3 a third octave signal $0_3$; an AND gate 45-4 a fourth octave signal $0_4$. As shown, the octave signals $0_1$ to $0_3$ are supplied to AND gates 43-1 to 43-3; the octave signal $0_2$ to an AND gate 44-1 of the weight shift circuit 44; the octave signal $0_3$ to AND gates 44-2 to 44-3; the octave signal $0_4$ to AND gates 44-4 to 44-6. The output signal of "1", "2" and "4" weights from the synchronizing counting register 34-2 are supplied to the AND gate 43-1 of the addition timing generating circuit 43, through OR gates 43-4 and 43-5. The output signal of "2" and "4" derived from the OR gate 43-4 is applied to the AND gate 43-2; the output signal of "8" weight is coupled with the AND gate 43-3. The outputs of those AND gates are coupled with inhibit gates 43-6 and 43-7 and an inverted AND gate 43-8. The output signal of "8" weight is further applied to the inverted AND gate 43-8. The output of the inverted AND gate 43-8 is coupled with the inhibit gate 43-7 of which the output is connected in series to the inhibit gate 43-6. The addition timing signal is formed on the basis of the output of the inhibit gate 43-6. As seen from the drawing illustrating a counting state (FIG. 9A) of the synchronizing counting register 34-2 in one line memory in FIG. 9, the output signals shown in FIG. 9B outputted onto the output lines (a), (b) and (c) in the addition timing generating circuit 43 are taken out as signals shown in FIG. 9C in synchronism with the generation of the octave signals $0_1$ to $0_4$ from the octave code decoder 45. Specifically, it is produced as the addition timing signal from the addition timing signal generator 43 only when the synchronizing counting register 34-2 has "0" for the first octave signal $0_1$, only when it counts "0" and "1" for the second octave signal $0_2$, only when it counts "0" to "7" for the third octave signal $0_3$, and only when it counts "0" to "7" for the fourth octave signal $0_4$. The addition timing signal thus obtained is applied as an "+8" addition command signal to the adder 40; it as a gate release signal to AND gates 46-1 to 46-4' it as a "+1" addition command signal to the adder 36 shown in FIG. 7B.

Figures 1, 7B:
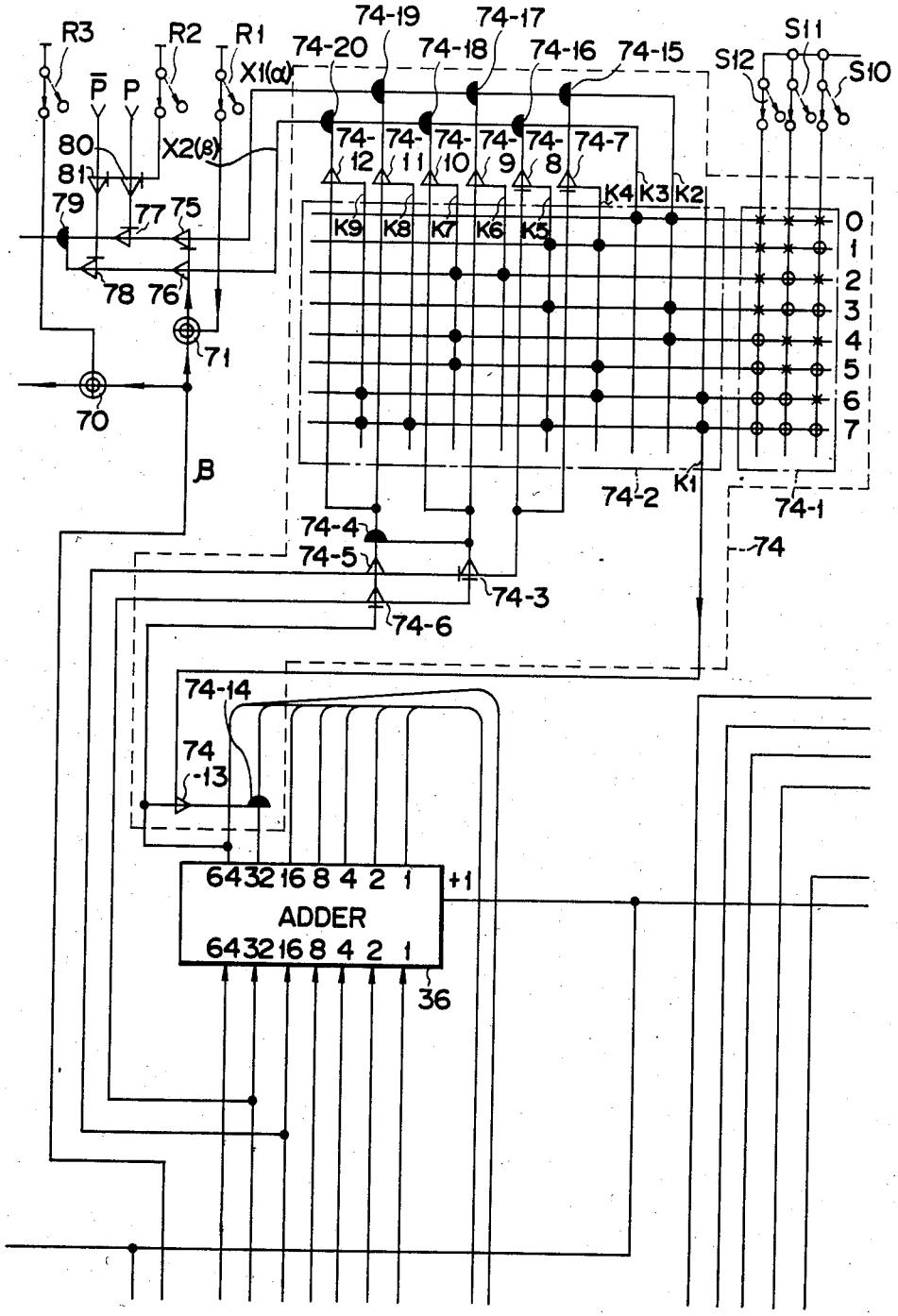
Figures 2, 7B:
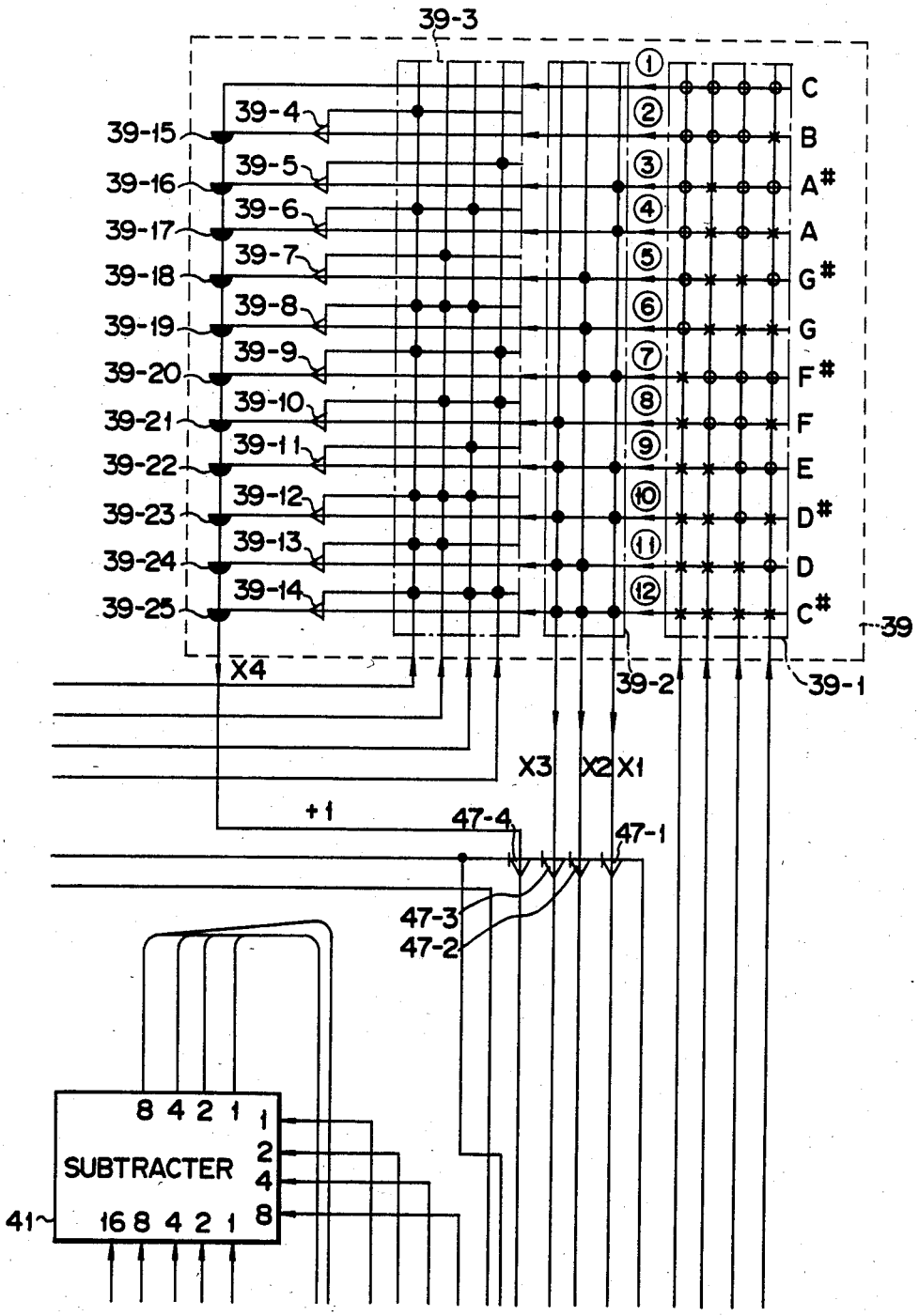
Figure 8:
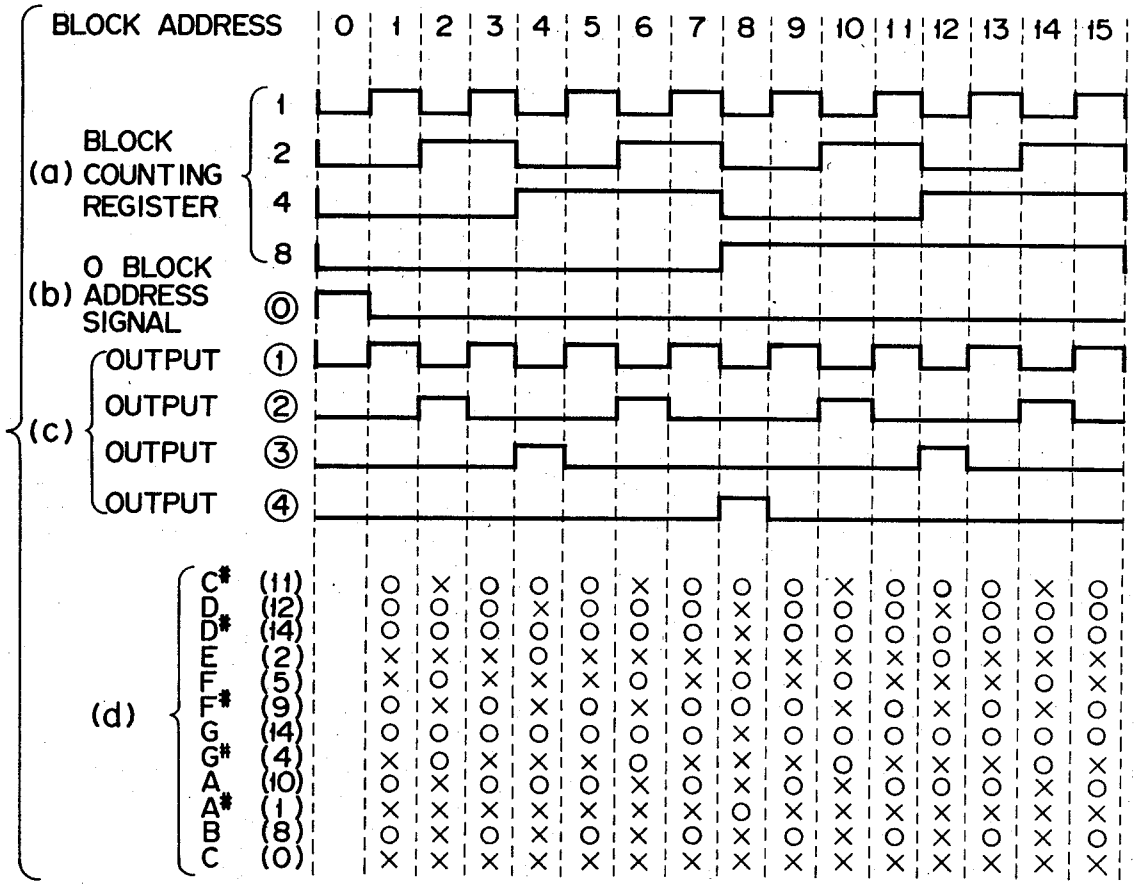
FIG. 8 is a time chart showing a timing of a selectively outputting state in accordance with a scale relating to the state of a block address shown in FIGS. 7A and 7B.

The octave signals $0_1$ to $0_4$ outputted from the octave code decoder 45 are applied as "−1", "−2", "−4" and "−8" command signals to the subtracter 41 shown in FIG. 7B, through the addition timing generating circuit 43. Accordingly, in a recirculating loop of synchronizing counting register 34-2→adder 40→subtracter 41→synchronizing counting register 34-2, the adder 40 adds "+8" to the contents of the synchronizing counting register 34-2, in synchronism with the addition timing signal. Subtracted from the result of the addition is a value ("−1" from the octave signal $0_1$, "−2" for the octave signal $0_2$, "−4" for the octave signal $0_3$ and "−8" for the octave signal $0_4$) in accordance with the octave signals $0_1$ to $0_4$. Supplied to the adder 40 is a step correction number corresponding to the scale from the AND gates 46-1 to 46-4 which are released in synchronism with the generation of the addition timing signal from the scale step matrix circuit 39 in accordance with a block counting state of the block counting register 34-1. That is, one cycle of a musical sound wave is comprised of "16" blocks with respect to time and each block address is comprised of clocks (more than eight times of a basic clock period) which is eight times or more of the basic clock $\phi_0$. A single basic clock $\phi_0$ corresponds to one step of the musical sound wave and therefore each clock address has eight steps or more. When each of the "16" block addresses of one cycle of the musical sound wave includes 8 steps and a total of 128 steps are included in one cycle, the total step number corresponds to the highest pitch in this system (actually, 130 steps corresponds to the highest pitch ($C_\#$) in this system, as seen from the description to be given later). By increasing the number of steps between adjacent scales from the highest pitch to the pitch below one octave so as to be related by $\sqrt[12]{2}$, the period of the wave becomes longer in accordance with the scale so that a low sound is obtained. A step correction number for the period setting in accordance with the scale is assembled into the scale step matrix circuit 39.

The scale step matrix circuit shown in FIG. 7B basically stores a control value for effecting a period control in accordance with the scale in the form of coarse and fine numbers into which a period setting value by the count-up (+) in the period counting register 34. The circuit 39 is supplied with the output signals from the outputs ①, ②, ③ and ④ of the block state detecting circuit 38, and the 4-bit output of the scale code register 20. The scale step matrix circuit 39 is provided with an AND fuction matrix circuit 39-1 for detecting code states of 12 scales shown in Table 2. The circuit 39-1 is provided with output lines ① to ⑫ (C scale detecting line to C# scale detecting line shown in the drawing) corresponding to the scales. Those output lines are coupled with AND gates 39-4 to 39-14, through a first OR function matrix circuit 39-2 and a second OR function matrix circuit 39-3. The first OR function matrix circuit 39-2 produces a step addend number in terms of a code through output lines $X_1$ to $X_3$, for controlling fine numbers "0, 0, 1, 1, 2, 2, 3, 4, 5, 5, 6, 7" in the order of C to C# for each scale. The step addend is added to each of "16" blocks, as shown in Table 4.

TABLE 4

| Scale | | Output Code $X_1$ | $X_2$ | $X_3$ | Step Addend |
|---|---|---|---|---|---|
| 1 | C | 0 | 0 | 0 | 0 |
| 2 | B | 0 | 0 | 0 | 0 |
| 3 | A# | 1 | 0 | 0 | 1 |
| 4 | A | 1 | 0 | 0 | 1 |
| 5 | G# | 0 | 1 | 0 | 2 |
| 6 | G | 0 | 1 | 0 | 2 |
| 7 | F# | 1 | 1 | 0 | 3 |
| 8 | F | 0 | 0 | 1 | 4 |
| 9 | E | 1 | 0 | 1 | 5 |
| 10 | D# | 1 | 0 | 1 | 5 |
| 11 | D | 0 | 1 | 1 | 6 |
| 12 | C# | 1 | 1 | 1 | 7 |

The second OR function matrix circuit 39-3 is used to apply a step correction addend, in accordance with the coarse number, to the respective scale in one cycle of the musical sound wave. In this case, in order to apply uniformly the step correction addend at the timing of the block addresses, the output signals derived from the outputs ① to ④ of the block state detecting circuit 38 are selected in accordance with the respective scales, and the block addresses with ◯ marks are selected in accordance with the scale, as shown in FIG. 8D. Those selected plural block addresses serve as the control timing for the coarse number. The selected signal is applied to the AND gates 39-4 to 39-14 in accordance with the scale. The outputs of the AND gates 39-4 to 39-14 are coupled with the series circuit of OR gates 39-15 to 39-25, and the output line $X_4$ of the final OR gate 39-25 provides for each scale a "+1" correction signal to the block address selected of those "1" to "15". In other words, the step correction number outputted from the scale step matrix circuit 39 becomes a period control value (step addend for controlling the fine number+step addend in accordance with the coarse number). The output signal from the output lines $X_1$, $X_2$, $X_3$ and $X_4$ of the scale step matrix circuit 39 is applied to inhibit gates 47-1 to 47-4 which are enabled at the time other than the generation of the "0" block address signal outputted through the output lines $X_1$, $X_2$, $X_3$ and $X_4$ of the scale step matrix circuit 39. The output signals from the inhibit gates 47-1 to 47-3 are applied respectively through OR gates 48-1 to 48-3 to AND gates 46-2 to 46-4. The output signal from the inhibit gate 47-4 is coupled with the AND gate 46-1. Accordingly, at the time other than the generation of the "0" block address signal, the step addend for each block address and a step correction addend by which "+1" is applied to the selected block address, together with "+8", are applied as addition signals to the adder 40, in synchronism with the generation of the addition timing signal. At the time of generation of a "0" block address signal outputted from the block address state detecting circuit 38, a "+2" correction value is applied through the OR gate 48-4 and the AND gate 46-2 to the adder 40 and is added in synchronism with the generation of the addition timing signal, together with the "+8" addition. Accordingly, an addition value by the scale for each address supplied to the adder 40 is the highest octave (the fourth octave signal $0_4$), as shown in FIG. 10, and this value corresponds to the step number (number of the basic clocks) within each block address. The step number of one cycle of the musical sound wave of each scale is shown in the right column of FIG. 10. As shown, the number of steps between adjacent scales are related by $\sqrt[12]{2}$. Of course, different addition timings supplied to the adder 40 are used for the respective octave signals $0_1$ to $0_4$ and the value subtracted in the subtracter 41 also is different for the octave signals $0_1$ to $0_4$. As the octave becomes lower (toward the octave signal $0_1$), the period of one cycle of the musical sound wave becomes longer. The period counting register 34, the scale code register 20, the octave code register 21 are each provided with 8 line memories. One cycle of the arrow directional operation of each register is completed by 8 $\phi_0$ shift pulses. For this, the sound waveform is controlled on the basis of this one circulation. Since the system of the invention uses a shift memory to be given later, it is possible to control waveforms at a proper position within one circulation of the register. More specifically, the system is provided with 8 line memories in an arrow direction at the output sound producing stage (preceding to a D-A converting circuit) shown in FIG. 7C and with a shift memory 49 which shifts by the basic clock $\phi_0$. The shift memory 49 is so designed that one of the 8 line memories is addressed by the code expressed by 3 bits ("1", "2" and "4" weights) outputted from the weight shift circuit 44 in FIG. 7A. Addresses "0" to "7" are assigned to the line memories in such a manner that the address "0" is assigned to the line memory closest to the output side of shift memory 49 and the address "7" to the line memory furthest from the output side. By this address designation, 8 $\phi_0$ shift time delay at maximum is possible. The address of the shift memory 49 is designated only when the addition timing signal outputted from the addition timing generating circuit 43 is applied through AND gates 50 and 51 shown in FIG. 7C. The output signal from the AND gate 51 applied to the shift memory 49 is called an enable signal.

The weight "1" signal from the synchronizing counting register 34-2 is applied to the AND gates 44-1, 44-3 and 44-6 in the weight shift circuit 44 shown in FIG. 7A; the weight "4" output to the AND gate 44-4; the weight "2" output to the AND gates 44-2 and 44-5. The AND gate 44-6 is coupled with the output line $Y_1$; the AND gates 44-3 and 44-5 to the output line $Y_2$ through the OR gate 44-7; the AND gates 44-4 and 44-5 to the output line $Y_4$ through the OR gate 44-9 to which the output signals of the OR gate 44-8 and the AND gate 44-1 are applied. Thus, 3 bit outputs fed through the output lines $Y_1$, $Y_2$ and $Y_4$ are applied as an address designation code to the shift memory 49. The output signal from the synchronizing counting register 34-2 becomes an address designation signal shown in Table 5 in accordance with the octave signals $0_1$ to $0_4$. As will be described later, the output signal from the adder 52 is shifted up by the $\phi_0$ pulse through the addressed line memory and is taken out from the shift memory 49.

TABLE 5

| Synchronizing Counting Register | | | | | Address Designation of Shift Memory | | | | | | | | | | | | | | | |
|---|---|---|---|---|---|---|---|---|---|---|---|---|---|---|---|---|---|---|---|---|
| | | | | | $0_4$ | | | | $0_3$ | | | | $0_2$ | | | | $0_1$ | | | |
| Output | 1 | 2 | 4 | 8 | | 1 | 2 | 4 | | 1 | 2 | 4 | | 1 | 2 | 4 | | 1 | 2 | 4 |
| 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | 1 | 0 | 0 | 0 | 1 | 1 | 0 | 0 | 2 | 0 | 1 | 0 | 4 | 0 | 0 | 1 | | | | |
| 2 | 0 | 1 | 0 | 0 | 2 | 0 | 1 | 0 | 4 | 0 | 0 | 1 | 0 | 0 | 0 | 0 | | | | |
| 3 | 1 | 1 | 0 | 0 | 3 | 1 | 1 | 0 | 6 | 0 | 1 | 1 | 4 | 0 | 0 | 1 | | | | |
| 4 | 0 | 0 | 1 | 0 | 4 | 0 | 0 | 1 | 0 | 0 | 0 | 0 | 0 | 0 | 0 | 0 | | | | |
| 5 | 1 | 0 | 1 | 0 | 5 | 1 | 0 | 1 | 2 | 0 | 1 | 0 | 4 | 0 | 0 | 1 | | | | |
| 6 | 0 | 1 | 1 | 0 | 6 | 0 | 1 | 1 | 4 | 0 | 0 | 1 | 0 | 0 | 0 | 0 | | | | |
| 7 | 1 | 1 | 1 | 0 | 7 | 1 | 1 | 1 | 6 | 0 | 1 | 1 | 4 | 0 | 0 | 1 | | | | |
| 8 | 0 | 0 | 0 | 1 | 0 | 0 | 0 | 0 | 0 | 0 | 0 | 0 | 0 | 0 | 0 | 0 | | | | |
| 9 | 1 | 0 | 0 | 1 | 1 | 1 | 0 | 0 | 2 | 0 | 1 | 0 | 4 | 0 | 0 | 1 | | | | |
| 10 | 0 | 1 | 0 | 1 | 2 | 0 | 1 | 0 | 4 | 0 | 0 | 1 | 0 | 0 | 0 | 0 | | | | |
| 11 | 1 | 1 | 0 | 1 | 3 | 1 | 1 | 0 | 6 | 0 | 1 | 1 | 4 | 0 | 0 | 1 | | | | |
| 12 | 0 | 0 | 1 | 1 | 4 | 0 | 0 | 1 | 0 | 0 | 0 | 0 | 0 | 0 | 0 | 0 | | | | |
| 13 | 1 | 0 | 1 | 1 | 5 | 1 | 0 | 1 | 2 | 0 | 1 | 0 | 4 | 0 | 0 | 1 | | | | |
| 14 | 0 | 1 | 1 | 1 | 6 | 0 | 1 | 1 | 4 | 0 | 0 | 1 | 0 | 0 | 0 | 0 | | | | |
| 15 | 1 | 1 | 1 | 1 | 7 | 1 | 1 | 1 | 6 | 0 | 1 | 1 | 4 | 0 | 0 | 0 | 0 | 0 | 0 | 0 |

Figure 11A:
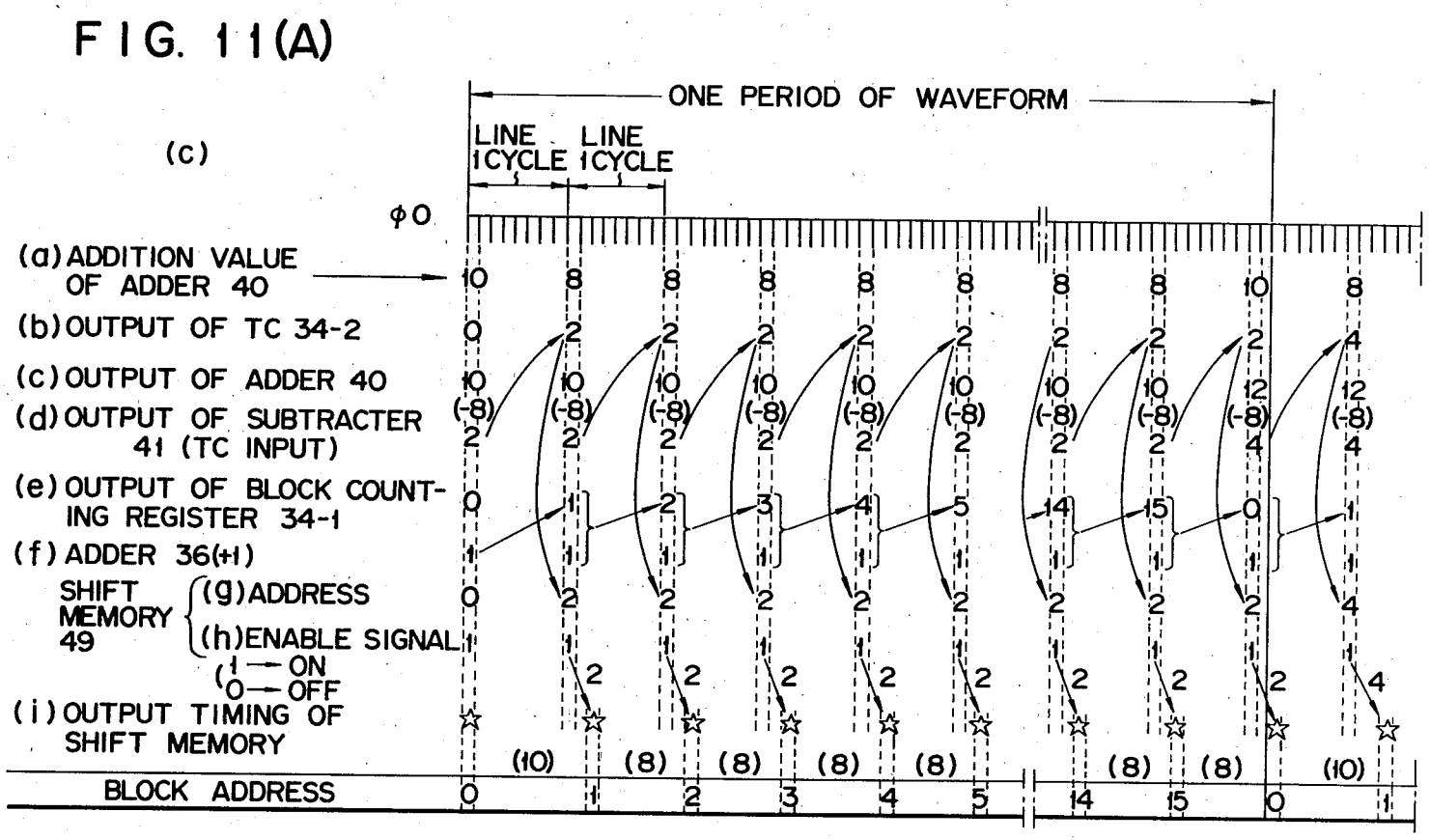
FIGS. 11A, 11B and 11C are a time chart for explaining the waveform period of the respective scales used in an embodiment of this invention.
Figure 11B:
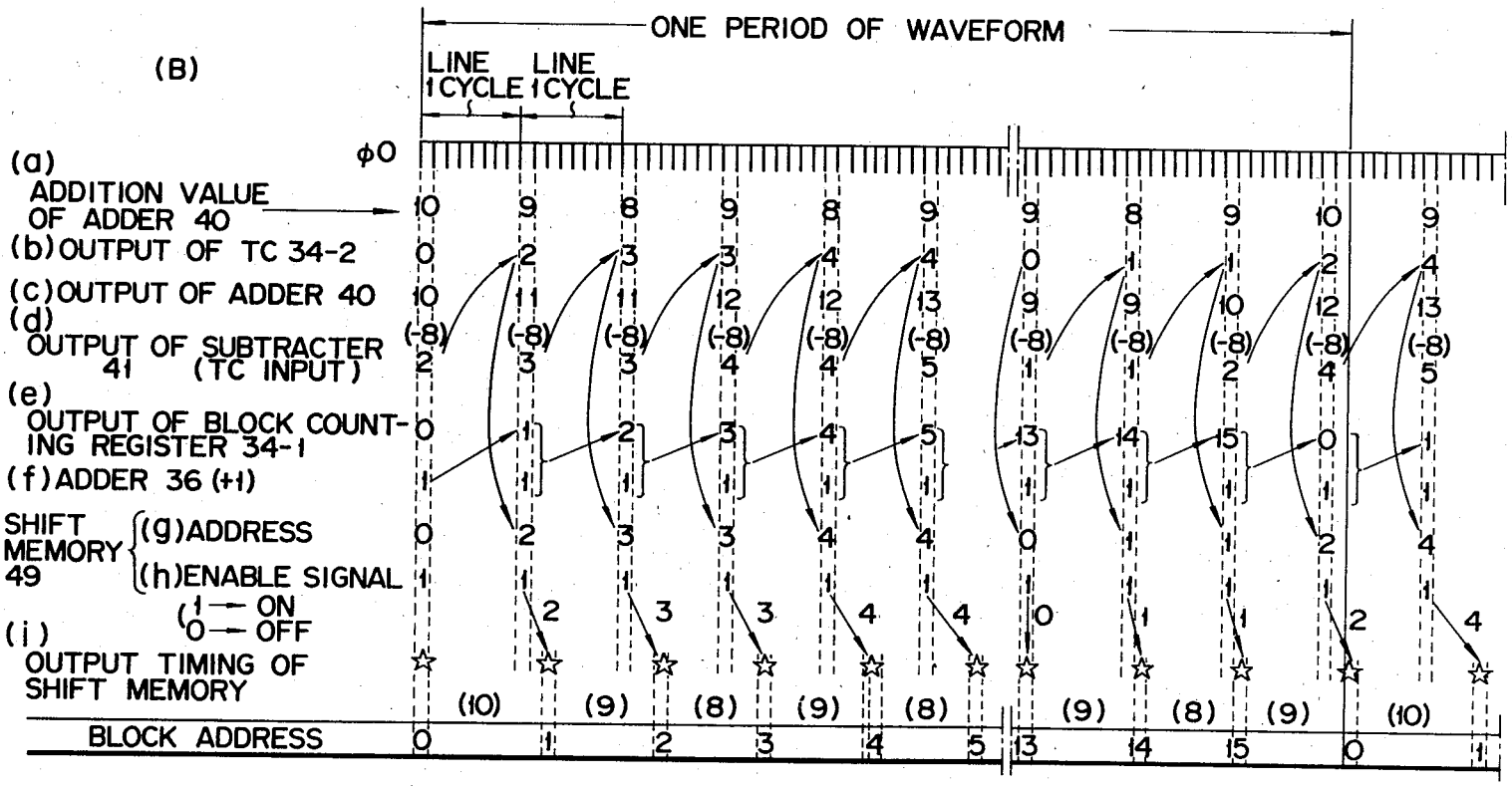
Figure 11C:
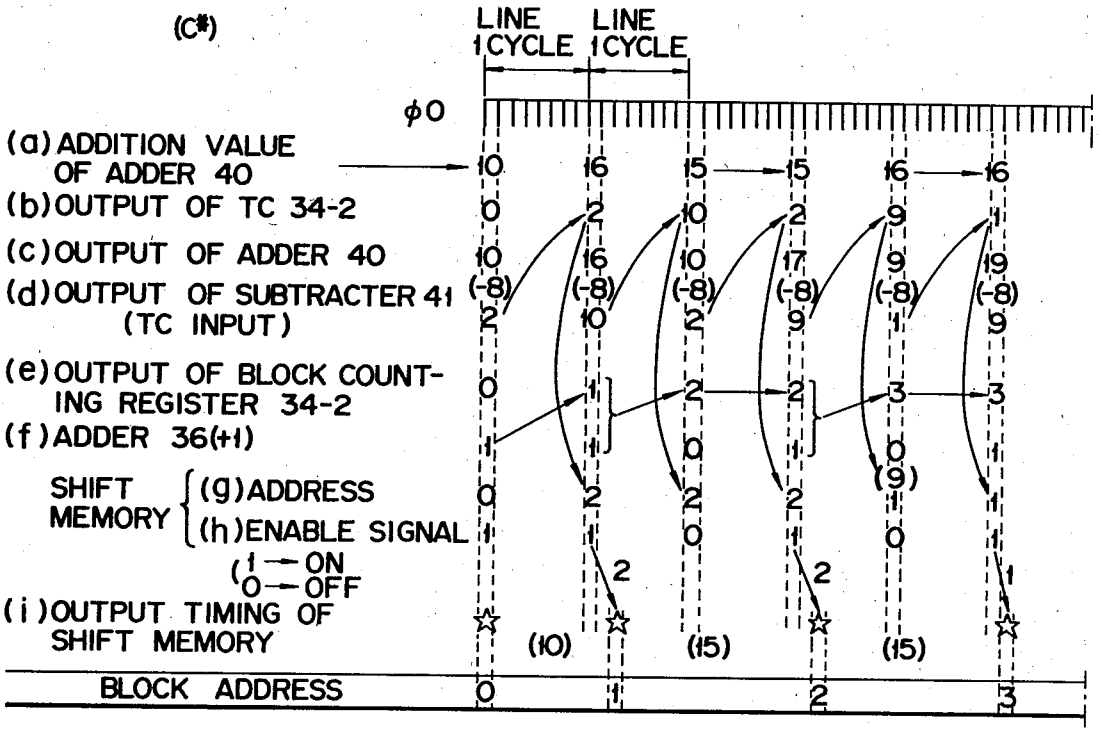

As described above, one cycle of the musical sound waveform for each scale is segmented by steps each of a basic clock pulse $\phi_0$, with different numbers of steps for the respective scales. For a better understanding of the period formation for each scale, the operation will be described with reference to FIG. 11A. The operation shown in FIG. 11A relates to a case where the highest octave is $0_4$ and the name of the scale is "C". At the time that the period counting register 34 is at the initial state of "0", the addition timing signal is produced from the addition timing generating circuit 43. Accordingly, in synchronism with the "0" block address signal produced from the block state detecting circuit 38, the "+2" correction value, together with the "+8" addition command, is applied to the adder 40 and then addition (0+10) is carried out in the adder 40. In the subtracter 41, "−8" is subtracted from the addition value "10" in response to the fourth octave signal $0_4$. The subtraction output value "2" is fed back to the synchronizing register 34-2. The addition timing signal is supplied as a "+1" addition command to the adder 36 and as an enable signal to the shift memory 49 shown in FIG. 7C. At this time, the address of the shift memory 49 is "0". Under this condition, the line memory "0" of the shift memory 49 is in an output timing state ready for allowing the output value of the adder 52 to be produced as described later. After the $8\phi_0$ shift time, the synchronizing register 34-2 produces "2" and the block counting register 34-1 produces "1" (see FIGS. 11A, 11B and 11E). At this time, the output signal from the block counting register 34-1 is "1" so that the (1) output signal from the block state detecting circuit 38 is applied to the scale step matrix circuit 39. In the case of the scale "C", the matrix circuit 39 produces no output signal and thus no step correction value is applied to the adder 40. Only the "+8" command is applied to the adder 40, in synchronism with the addition timing signal, with the result that the addition (2+8) is carried out therein. Further, the subtracter 41 performs a "−8" subtraction and finally the result value of the subtraction "2" is fed back to the synchronizing counting register 34-2. In synchronism with the addition timing signal, a "+1" signal is applied to the adder 36 and the addition value "2" is fed back to the block counting register 34-1. The addition timing signal is applied as an enable signal to the shift memory 49 and the output value "2" from the synchronizing counting register (TC) 34-2 is supplied to the weight shift circuit 44. Accordingly, a signal "1" is taken out through the output line $Y_2$. As seen from Table 5, it designates the address "2" of the shift memory 49. As a result, the output timing signal of the block address "1" is outputted from the shift memory 49, lagging by $2\phi_0$ shift time, as seen from (i) of FIG. 11A. That is, when the block addresses are "0" and "1", the space therebetween is divided into 10 steps. Then, a similar operation is repeated. In the case of the scale "C", the adjacent block addresses are spaced with 8 steps and, as shown in FIG. 10, one cycle of the musical sound waveform has 130 steps. The operations of the scales "B" and "C#" at the fourth octave signal $0_4$ are illustrated in FIGS. 11B and 11C, like the state diagram of FIG. 11A.

Figures 1, 7C:
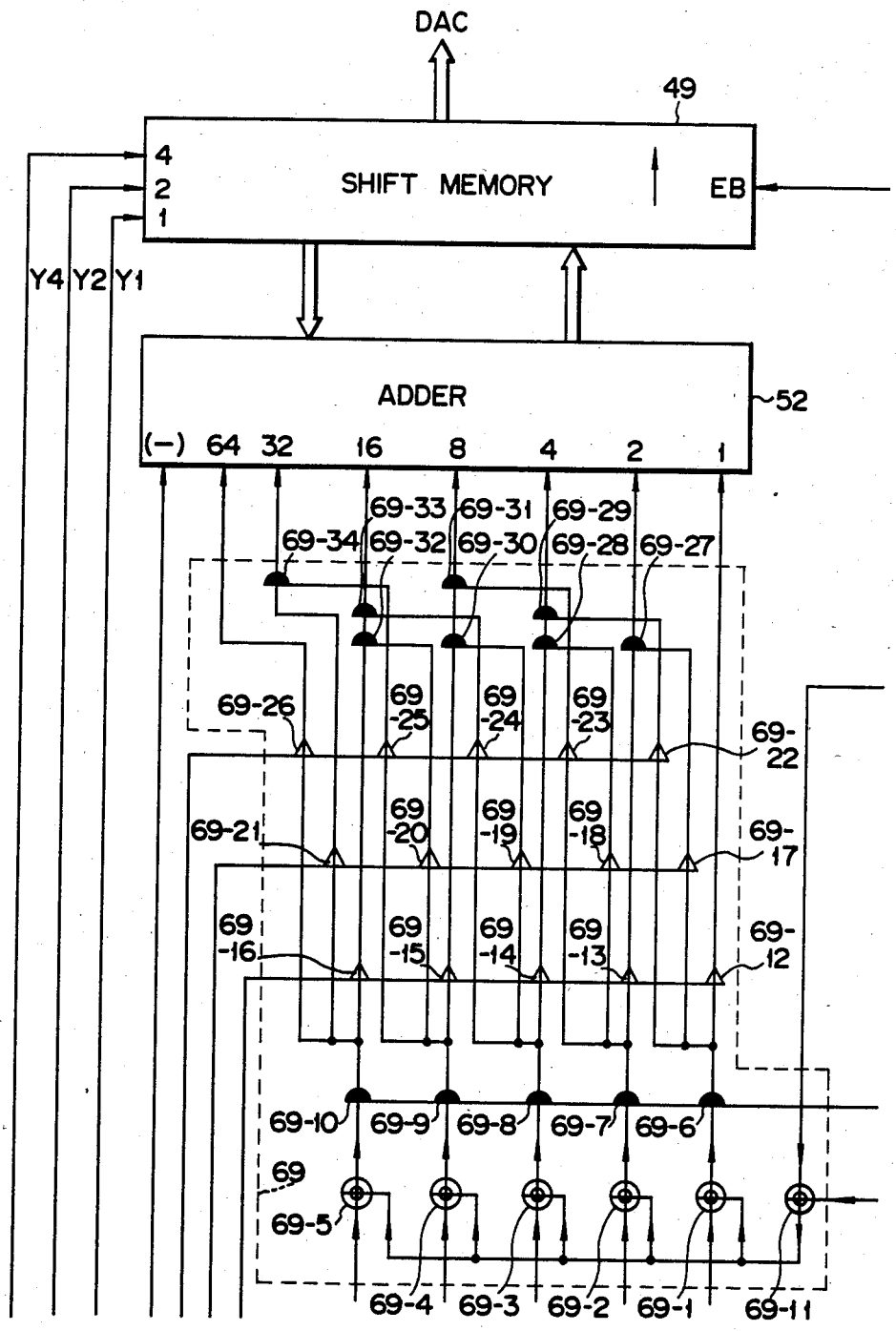
Figures 2, 7C:
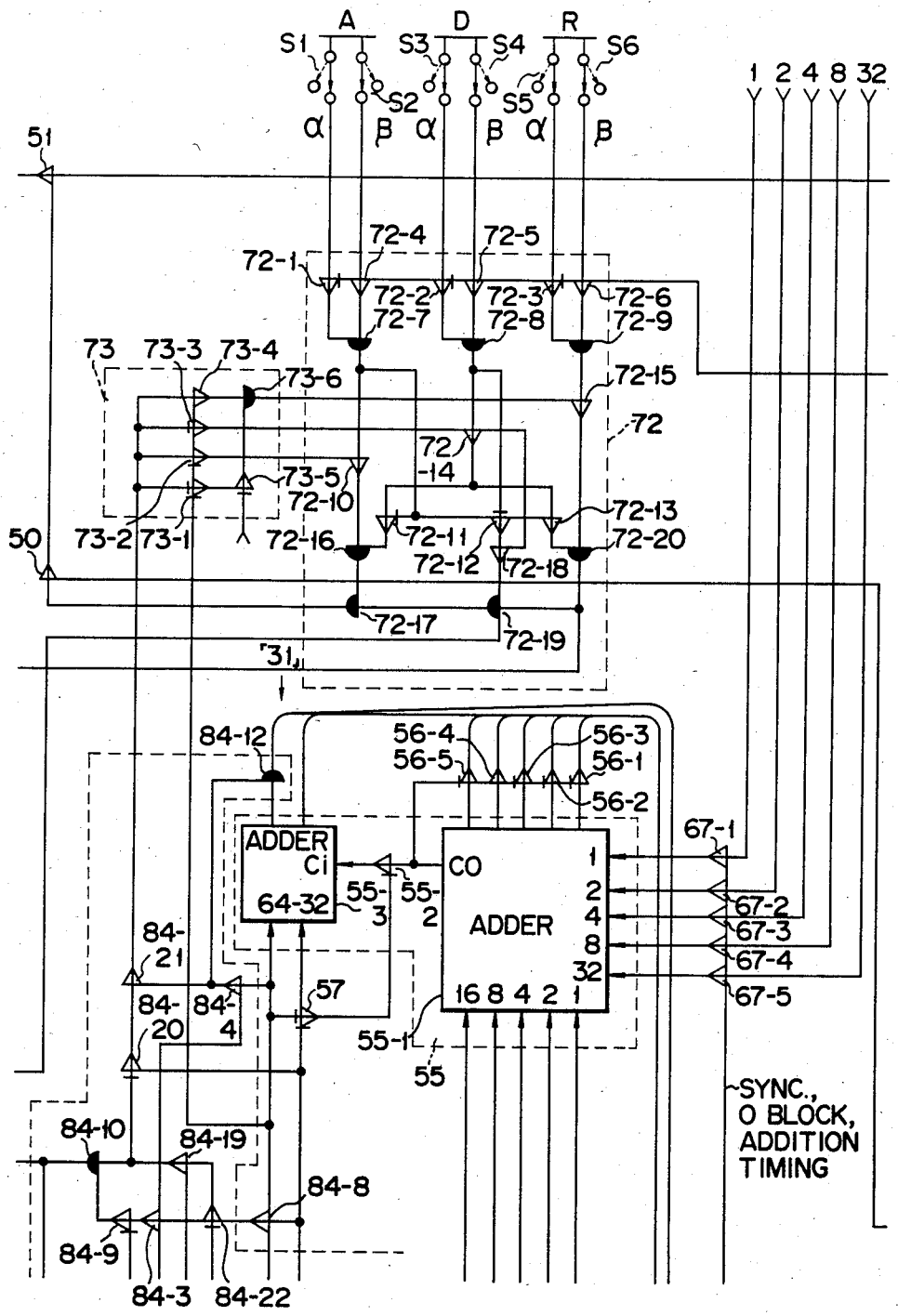
Figure 12:
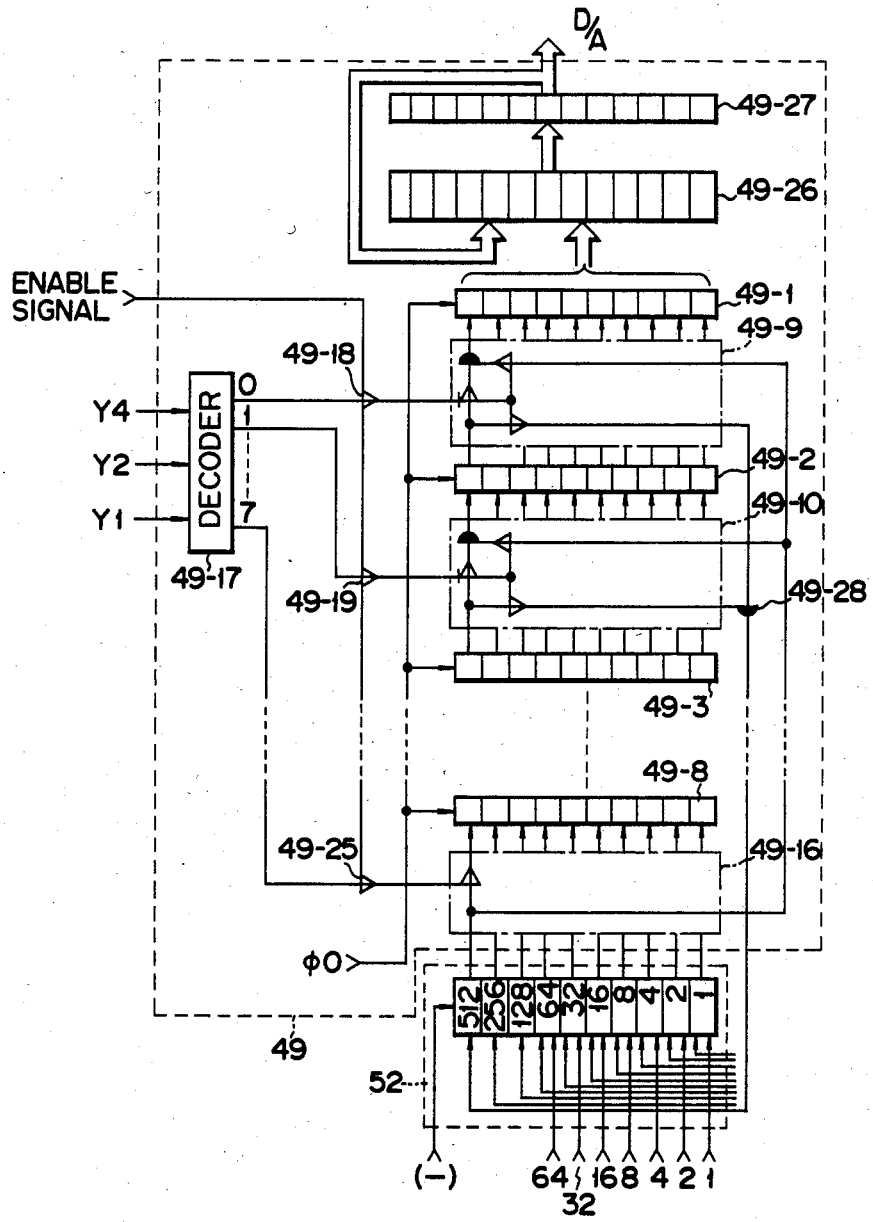
FIG. 12 is a block circuit diagram showing the detailed construction of a shift memory shown in FIG. 7C.

The details of the shift memory 49 and the adder 52 shown in FIG. 7C are illustrated in FIG. 12. The reference numerals 49-1 to 49-8 designate 8 line memories (line memories 49-4 to 49-7 are omitted in the drawing) each of 10 bits. Those line memories are shifted by the basic clock signal $\phi_0$. Input control circuits 49-9 to 49-16 are provided at the input sides of the line memories 49-1 to 49-8. In the drawing, only a gate circuit for one bit is illustrated for simplicity. In fact, similar gates are used for all the remaining bits. An address designation signal of three bits delivered through the lines $Y_1$, $Y_2$ and $Y_4$ from the weight shift circuit 44 shown in FIG. 7A is applied to the decoder 49-17 of the shift memory 49 where the addresses "0" or "7" are designated. The line memories 49-1 to 49-8 correspondingly assigned to the addresses "0" to "7", respectively. The designation signals of the addresses "0" to "7" are applied to the AND gates 49-18 to 49-25 to which an enable signal is applied. The outputs of those gates are coupled with the input control circuits 49-9 to 49-16. The input control circuits 49-9 to 49-16 permit the output from the adder 52 to enter the line memory specified and cause the entered signal to shift therethrough. The output signal from the line memory 49-1 is applied to a D-A converter (see FIG. 1), through an output adder 49-26 and a latch circuit 49-27. The output signal from the latch circuit 49-27 is recirculated through the output adder 49-26 so that it is accumulated. The output signal from the line memory just preceding to the output from the specified line memories 49-1 to 49-8 is applied to the weight stage corresponding to the adder 52, through the OR gate 49-28 (illustrated only for one bit).

A synchronizing set register 53 shown in FIG. 7A is comprised of 8 line memories each of one bit connected in series. An envelope register 54 is comprised of 8 line memories which are connected in parallel in an arrow direction and each is a 7-bit line memory (having "1", "2", "4", "8", "16", "32" and "64" weights). In operation, both registers 53, 54 are shifted in an arrow direction, in synchronism with the shift pulse $\phi_0$. The scale code register 20, the octave code register 21, the period counting register 34, the synchronizing set register 53 and the envelope register 54 are made to correspond to the line memories. For the pitch code outputted from the octave code register 21 and the scale code register 20, the control output signals corresponding to those are produced from the period counting register 34, the synchronizing set register 53, and the envelope register 54. The envelope coefficient is instructed by 32 counting values from "0" to "31" which are expressed by 5 bits with weights "1", "2", "4", "8" and "16" from the envelope register 54. 2 bits of "32" and "64" weights indicate four envelope states of attack, decay, release and clear. Thus, the outputs at the 7 bits output stages of the envelope register 54 are applied to the corresponding weight input terminals of the adder 55. The respective bits outputs from the adder 55-1 for counting the envelope control value in the adder 55 are circulatingly applied to the input terminals of "1", "2", "4", "8" and "16" of the envelope register 54, through inhibit gates 56-1 to 56-5 for inhibiting the outputting when a carry signal from the adder 55-1 appears, respectively. The carry signal produced from the adder 55-1 is applied to the carry input terminal of an adder 55-3 for the state counting, through the inhibit gate 55-2 driven by the output signal from the inverted AND gate 57 which detects a clear state "OC" by the state detecting weights "32" and "64" of the envelope register 54. In other words, the adder 55-3 accepts the carry output signal when the envelope state is in states other than the clear. The output signal of the adder 55-3 is recirculatingly held at the weight input terminals of "32" and "64" of the envelope register 54, through the inhibit gates 58-1 and 58-2. The performance key input indication signal shown in FIG. 7A is applied to the input side of the "32" weight stage of the envelope register 54, through the OR gate 59 so that, when the input indication signal is produced, the envelope state becomes immediately the attack state. The relationship between the envelope state and the code state of the weight stages of "32" and "64" of two bits is tabulated in Table 6.

TABLE 6

| Weight | | |
|---|---|---|
| 32 | 64 | State of Envelope |
| 0 | 0 | Key release clear |
| 1 | 0 | Attack |
| 0 | 1 | Decay |
| 1 | 1 | Release |

The output signal from the synchronizing set register 53 shown in FIG. 7A is applied to one of the input terminals of each gate 60 and 61. The AND gate 60 is connected at the other input terminal in receiving relation to the output of the AND gate 62 for obtaining logical product of the "0" block address signal and the addition timing signal outputted from the addition timing generator 43. The synchronizing set register 53 is set by applying to the input side thereof the clock signal (referred to as an envelope clock) produced from the inhibit gate 63 to be given later, through the OR gates 64 and 65. The inhibit gate 63 is supplied with the output signal from a series connection of the inhibit gates 66-1 to 66-5 for detecting the all-0 state of the envelope register 54 and the inverted AND gate 66-5. For this, at the all-0 state, the envelope clock is prevented from passing through the inhibit gate 63. When a "1" signal is set in the synchronizing set register 53, the AND gate 60 is enabled in synchronism with the addition timing signal of the "0" block from the AND gate 62. Then, the addition timing signal to the adder 55 is produced while at the same time the output from the inhibit gate 61 is inhibited. As a result, a "0" signal is loaded into the synchronizing set register 53 to release the set state thereof. The addition timing signal outputted from the AND gate 60 is applied as a gate enabling signal to the AND gates 67-1 to 67-5, thereby permitting an addition value to the adder 55 for envelope to be described later to pass therethrough. As a result, the envelope shifts with time in attack, decay, and release states. That is, the synchronizing set register 53 is used to synchronize an addition value applied to the adder 55 for envelope with the "0" block address of the musical sound waveform. When the output of the synchronizing register 53 is "0" and the envelope register 54 is at all-0 state, the inhibit gate 68 produces a reset signal to be described later. The 5-bit signal of "1", "2", "4", "8" and "16" weights produced from the envelope register 54 are applied respectively to the exclusive OR gates 69-1 to 69-5 of the weight shift register 69.

Figure 13:
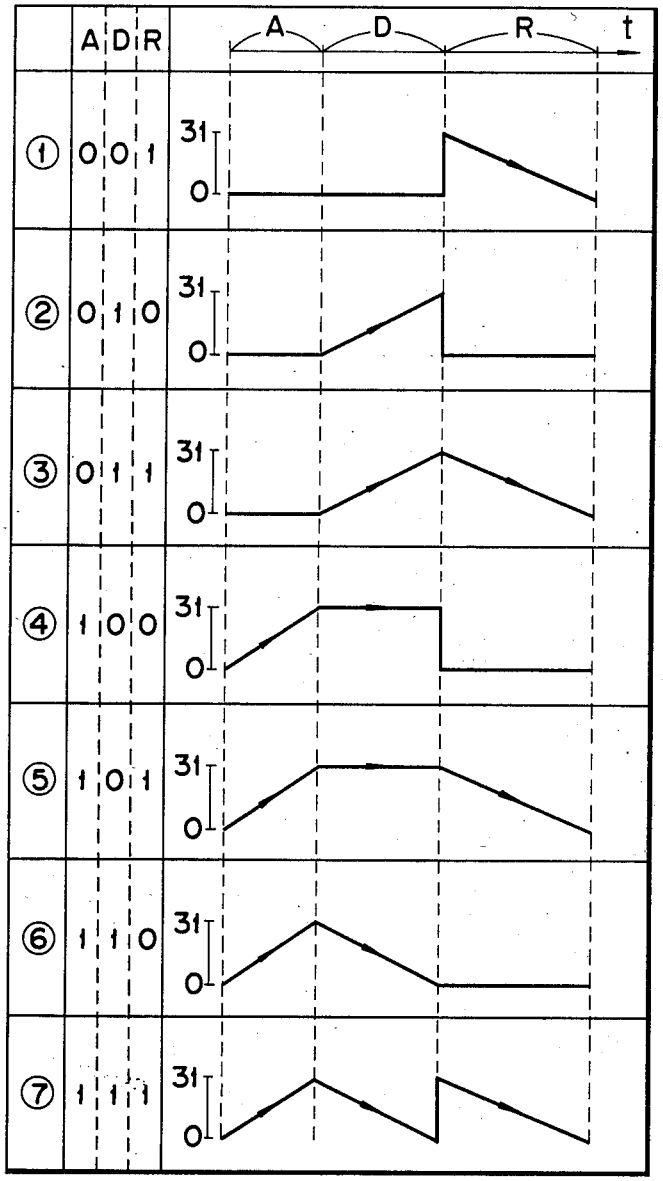
FIG. 13 shows the kinds of types of volume envelopes used in this invention.
Figure 15:
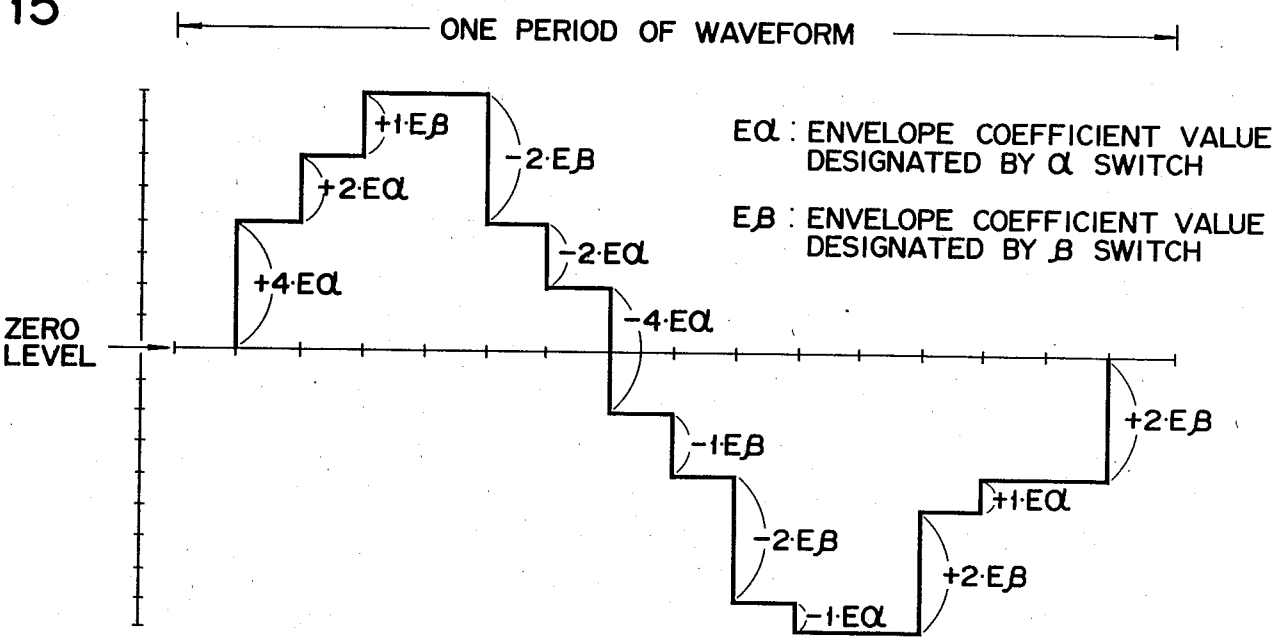
FIG. 15 is a musical sound wave defined by block addresses designated by $\alpha$ and $\beta$.
Figure 16A:
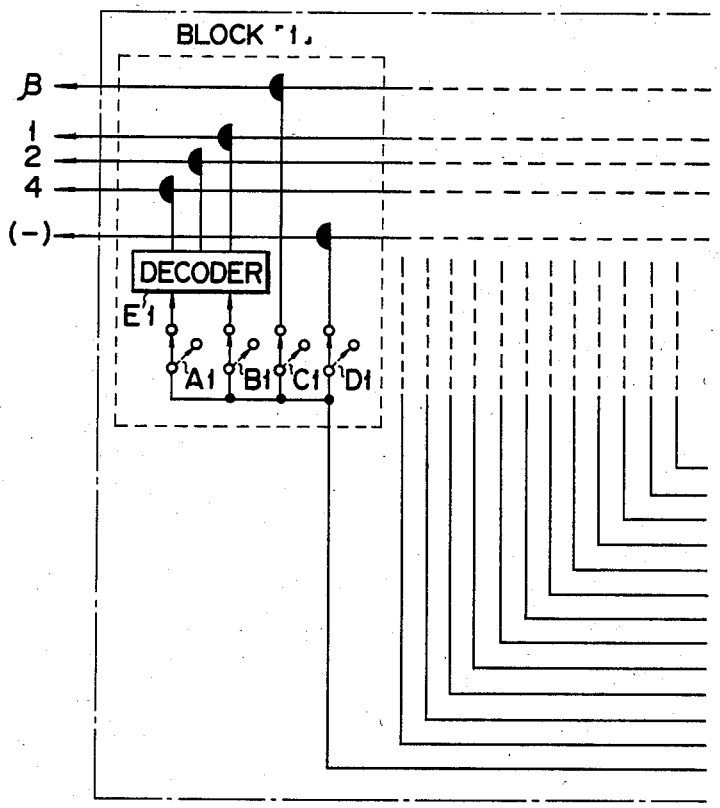
FIG. 16 shows a waveform program designating section of FIG. 7A.
Figure 16B:
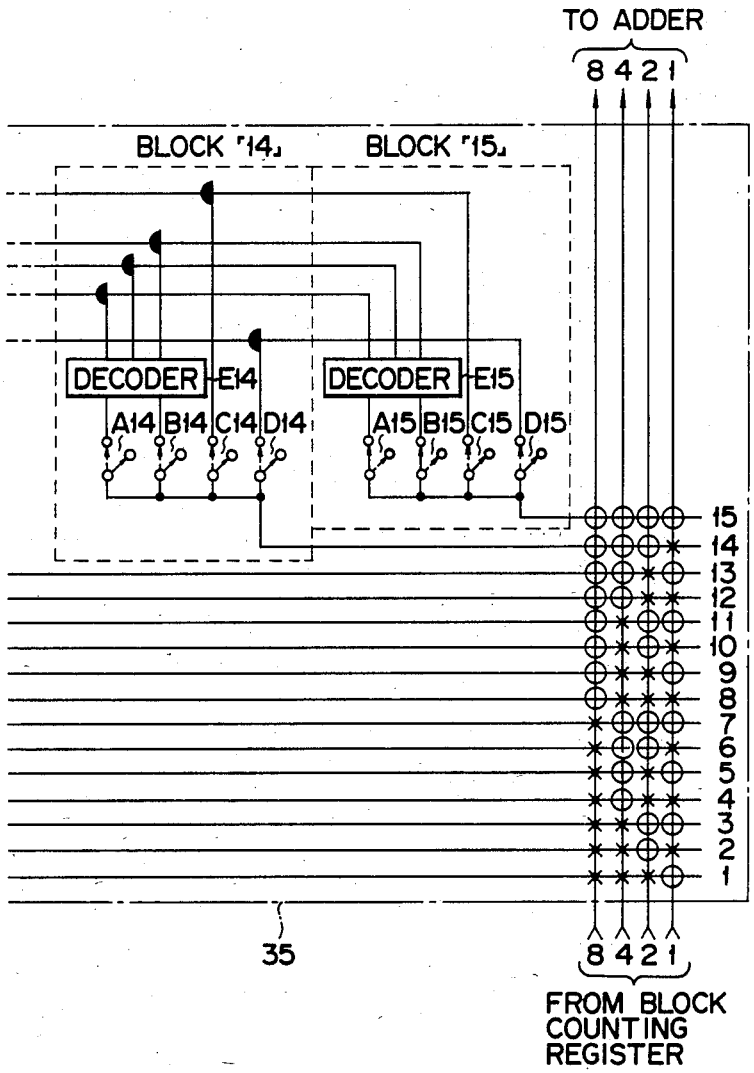

Switches $S_1$ to $S_6$ shown in FIG. 7C are used to instruct types of individual volume curves $\alpha$ and $\beta$. The group of the switches $S_1$, $S_3$ and $S_5$ indicates the attack (A), the decay (D) and the release (R) on the $\alpha$ volume curve. The group of the switches $S_2$, $S_4$ and $S_6$ indicates the states A, D and R of the $\beta$ volume curve. As shown in FIG. 13, three switches can indicate seven types of volume curves. In this example, two types of volume curves can be selected simultaneously: one type is called as an $\alpha$ volume curve (selected by the switches $S_1$, $S_3$ and $S_5$) and the other type called as a $\beta$ volume curve (selected by switches $S_2$, $S_1$ and $S_6$). The combinations of those $\alpha$ and $\beta$ curves are as shown in FIG. 14. As described referring to FIGS. 1 to 3, the waveform program designation unit 35 shown in FIG. 7A designates one period of a musical sound wave by a differential coefficient value with "+" (up) or "−" (down) of the wave rise or the wave fall at each block address of the one period. The designation unit 35 may also designate the types of the volume curve, $\alpha$ and $\beta$ curves, by producing a "0" signal for $\alpha$ curve indication and a "1" signal for $\beta$ curve indication. As example of the indication is shown in FIG. 15. As seen from the figure, the indicator indicates the differential coefficient value by numerals "1", "2" and "4" and symbols "+" and "−" and the volume curve by $\alpha$ and $\beta$. The details of the waveform program indication unit 35 are illustrated in FIG. 16. As shown, switches $A_1$ to $A_{15}$ and $B_1$ to $B_{15}$ for indicating the absolute values "1", "2" and "4", switches $C_1$ to $C_{15}$ for indicating $\alpha$ and $\beta$ volume curves, and switches $D_1$ to $D_{15}$ for indicating "+" and "−" are provided for each block address "1" to "15", respectively. A common line of the respective switch groups for each block address is coupled with block state detecting signals of counting values "1" to "15" from the block counting register 34-1. The switches $A_1$ to $A_{15}$, $B_1$ to $B_{15}$ of each block produce three indication signals of differential coefficient values "1", "2" and "4" through decoders $E_1$ to $E_{15}$. And the corresponding indication signals are taken out through an OR gate. The block address "0" is set always at "0" level and thus is not indicated by the switch and therefore the block addresses "1" to "15" are indicated by the switch. A (−) command signal indicated by the waveform program instruction unit 35 for each address is applied to the adder 52 shown in FIG. 7C, the command signal of "1", "2" or "4" is applied to the weight shift circuit 69 shown in FIG. 7C and a $\beta$ command signal is applied to exclusive OR gates 70 and 71 shown in FIG. 7B. The $\beta$ command signal generally passes through the exclusive OR gate 70 to reach the inhibit gates 72-1 to 72-3 and the AND gates 72-4 to 72-6 in an $\alpha/\beta$ volume curve control circuit 72. Accordingly, the AND gates 72-4 to 72-6 produce output signals in synchronism with a $\beta$ indication signal ("1"), the inhibit gates 72-1 to 72-3 produce output signal in synchronism with an $\alpha$ indication signal ("0"), in accordance with $\alpha$ or $\beta$ selectively indicated by the switches $S_1$ to $S_6$. The outputs of the inhibit gate 72-1 and the AND gate 72-4 are coupled with the OR gate 72-7; the outputs of the inhibit gate 72-2 and the AND gate 72-5 with the OR gate 72-8; the outputs of the inhibit gate 72-3 and the AND gate 72-6 with the OR gate 72-9. The output of the OR gate 72-7 is applied to the AND gate 72-10, the inhibit gates 72-11 and 72-12 and the AND gate 72-13. The output of the OR gate 72-8 is connected to the AND gate 72-14 and the inhibit gate 72-12, and the output of the OR gate 72-9 is supplied to the AND gate 72-15. The output of the AND gate 72-14 is applied to the inhibit gate 72-11 and the AND gate 72-13. The AND gate 72-10 and the inhibit gate 72-11 are connected to the OR gate 72-17 through the OR gate 72-16. The output of the inhibit gate 72-12 is connected through the AND gate 72-18 to an OR gate 72-19. The AND gates 72-13 and 72-15 are connected to the OR gate 72-20. The OR gates 72-17 to 72-20 are connected in series and the output of the OR gate 72-17 is supplied to the AND gate 50. A detection signal from the envelope state detection circuit 73 is coupled in supply relation with the AND gates 72-10, 72-14, 72-15, and 72-18. Ordinarily, the inverted AND gate 73-1 detects a "00" clear state of the envelope; the inhibit gate 73-2 an attack state; the inhibit gate 73-3 a steady state; the AND gate 73-4 a release state. The inhibit gate 73-2 is coupled with the AND gate 72-10; the inhibit gate 73-3 with the AND gates 72-14 and 72-18. The output signals from those gates serve as gate enabling signals. The output signal from the inverted AND gate 73-1, together with a detecting signal of all-"0" state (symbol . in FIG. 7D) from the envelope register 54, is applied to the inhibit gate 73-5. The output signal from the inhibit gate 73-5, together with the output signal from the AND gate 73-4, is applied as a gate enable signal to the AND gate 73-15, through the OR gate 73-6. Accordingly, the OR gate 72-16 in the $\alpha/\beta$ volume curve control circuit 72 produces an output signal when the envelope is in the attack state and the volume curve is indicated by (4) to (7) shown in FIG. 13 and when the former is in the steady state and the latter by (2) and (3) shown in FIG. 13. The AND gate 72-18 produces a "31" command signal in the case of (4) in FIG. 13 which indicates no decay when the envelope state is the decay state and an attack indication is given. The OR gate 72 produces a signal for indicating a complement value which is an inverted envelope coefficient value in the cases of (1), (3), (5), (6), (7) in FIG. 13 which is a down indication for the decay and release states of the envelope. The OR gate 72-17 produces signals representing attack (A), decay (D) and release (R) only when these states are indicated by the corresponding switches. The addition timing signal at that time is produced as an enable signal to the shift memory 49. The "31" command signal produced from the AND gate 72-18 is supplied to the OR gates 69-6 to 69-10 and the complement command signal from the OR gate 72-20 is supplied through the exclusive OR gate 69-11 to the exclusive OR gates 69-1 to 69-5. In the weight shift circuit 69, when the "31" command signal and the complement command signal are not present, the envelope coefficient value weighted at "1", "2", "4", "8" and "16" from the envelope register 54 passes through the exclusive OR gates 69-1 to 69-5 and is subjected to a weight shift operation (in this case, ± differential coefficient value × envelope sufficient value E) in accordance with the indicated differential coefficient values of "1", "2" and "4" for each clock address indicated from the waveform program designation unit 35, and the value of the multiplication is applied to the adder 52. An indication signal of the different coefficient value "1" is supplied to one of the input terminal of each AND gates 69-12 to 69-16; an indication signal of "2" to one of the input terminals of each AND gate 69-17 to 69-21; an indication signal of "4" to one of the input terminals of each AND gate 69-22 to 69-26. The other input terminal of each AND gate 69-12, 69-17 and 69-22 is supplied with a signal corresponding to the weight "1" of the envelope coefficient value. The other input terminal of each AND gate 69-13, 69-18 and 69-23 is supplied with a signal corresponding to the weight "2". The other input terminal of each AND gate 69-14, 69-19 and 69-24 receives a signal corresponding to the weight "4". A signal corresponding to the weight "8" is applied to the other input terminal of each AND gate 69-15, 69-20 and 69-25. A signal corresponding to the weight "16" is applied to the other input terminal of each AND gate 69-16, 69-21 and 69-26. As shown, the AND gate 69-12 is connected to the weight "1" input terminal of the adder 52; the AND gates 69-13 and 69-17 to the weight "2" input terminal through the OR gate 69-27; the AND gates 69-14, 69-18 and 69-22 to the weight "4" input side by the OR gates 69-28 and 69-29; the AND gates 69-15, 69-19 and 69-23 to the weight "8" input side by way of the OR gates 69-30 and 69-31; the AND gates 69-16, 69-20 and 69-24 to the weight "16" input side by way of the OR gates 69-32 and 69-33; the AND gates 69-21 and 69-25 to the weight "32" input side by way of the OR gate 69-34; the AND gate 69-26 to the weight "64" input side. With this connection, the weight shift circuit 69 produces multiplication values shown in FIG. 17 in accordance with the differential coefficient values "1", "2" and "4". When the $\alpha/\beta$ volume curve control circuit 72 produces a "31" command signal and feeds it to the OR gates 69-6 to 69-10, the envelope coefficient value is forced to have "31" irrespective of the output signal from the envelope register 54. When the complement command is applied to the exclusive OR gate 69-11, the envelope coefficient of 5 bits from the envelope register 54 is inverted, and the multiplication values shown in FIG. 17 become inverse values.

As seen from FIG. 15, the difference from the case shown in FIGS. 1 to 4 is that the multiplication for each block address is performed in accordance with a volume curve of $\alpha$ or $\beta$, that is to say, $\pm$ differential coefficient value$\times$envelope coefficient value E (E is E$\alpha$ when it follows the $\alpha$ volume curve and is E$\beta$ when it follows the $\beta$ volume curve). In this manner, the multiplication value inputted to the adder 52 is supplied to the shift memory 49.

Thus, by indicating two volume curves of $\alpha$ and $\beta$, the system can simultaneously indicate waveforms of $\alpha$ and $\beta$. Therefore, when waveforms are different, rises and falls of the volume curves may be changed so that a proper combination of them provides a great variety of a musical sound waveform synthesized. Accordingly, the time-variation of a harmonic structure of the waveform is remarkable to produce a musical sound wave with rich timbre. Accordingly, the musical instrument thus constructed according to the invention can produce a musical sound with features peculiar to the sound produced particularly by brasses and strings.

In FIG. 7B, switches $S_{10}$, $S_{11}$ and $S_{12}$ are used to indicate $\alpha$ and $\beta$ period modes and the output signals of those switches are supplied to the period so (called duty) control circuit 74. Through ON- and OFF states of these three switches, mode indication signals represented by 8 numerals "0" to "7" are produced from the AND function matrix circuit 74-1 through output lines and are then inputted to the OR function matrix circuit 74-2. The three-bit output (weights of "16", "32" and "64") from the cycle number register 34-3 shown in FIG. 7A which is counted every period of the waveform is also supplied to the duty control circuit 74. In accordance with the cycle counting state, the inverted AND gate 74-3 produces the output state shown in FIG. 18B and the OR gate 74-4 produces the output state shown in FIG. 18A having a condition $(\overline{16}\cdot\overline{32}\cdot16\cdot32\cdot\overline{64})$, depending on the state of the AND gate 74-5, the inhibit gate 74-6 and the inverted AND gate 74-3. The signal of $(\overline{16})$ of the cycle number register 34-3 shown in FIG. 18A is supplied to the inhibit gates 74-7 and 74-8. The output of the inverted AND gate 74-3 is supplied to the AND gates 74-9 and 74-10. The output of the OR gate 74-4 is supplied to the AND gates 74-11 and 74-12.

Figures 18, 19:
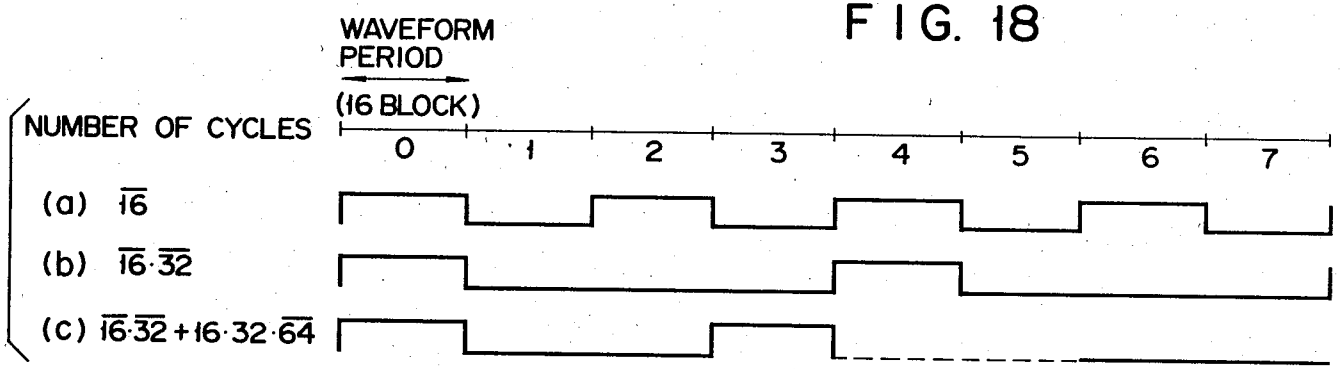
FIG. 18 is a time chart showing the operation of a counter for counting number of cycles of FIG. 7A.
FIG. 19 shows a basic relationship between number of cycles and a value of duty of FIG. 7B.
Figure 20:
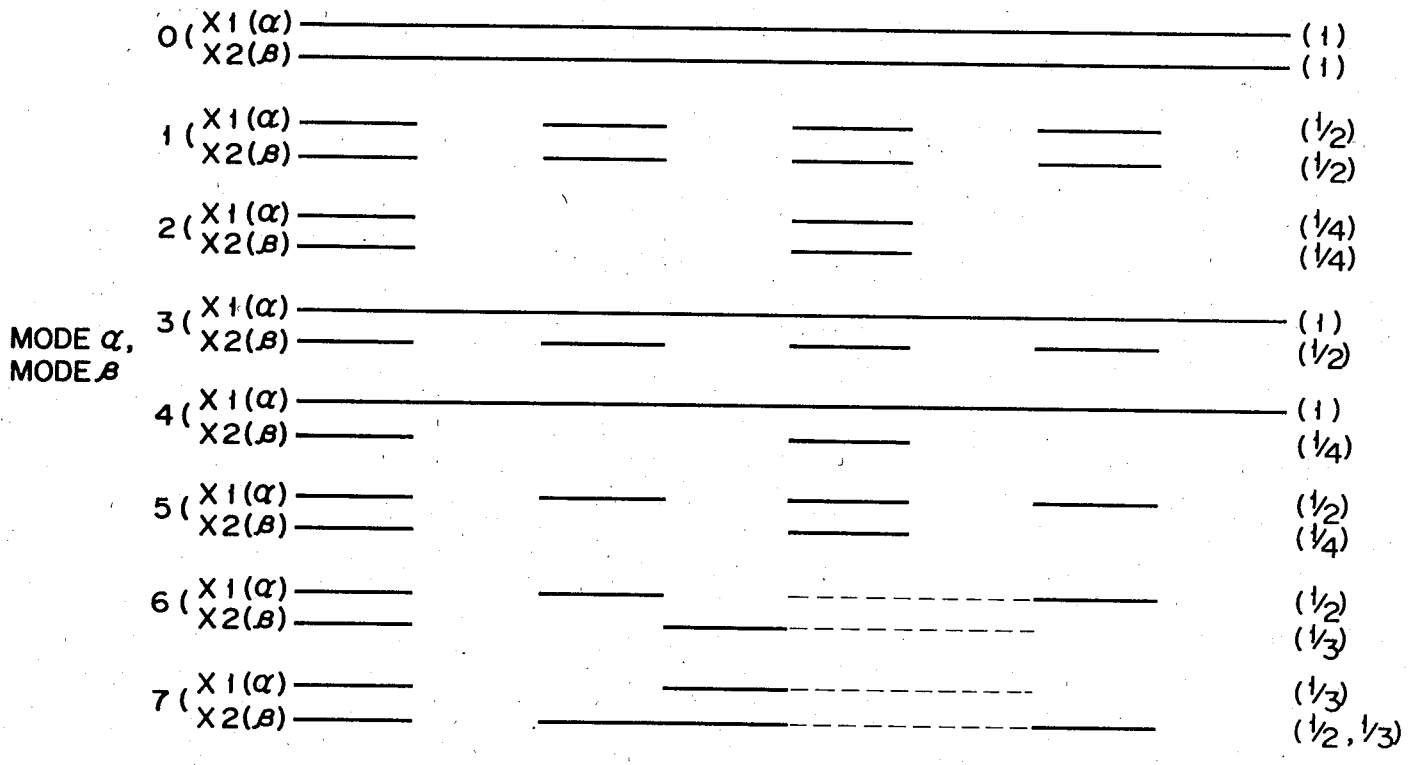
FIG. 20 shows states of designating modes $\alpha$ and $\beta$ of a period.

A basic relation between the duty and a cycle counting state will be described with reference to FIG. 19. In the figure, "0" indicates a cycle having no waveform output and "1" indicates a cycle having a waveform output. Duties "1", "$\frac{1}{2}$", and "$\frac{1}{4}$" means that a waveform output is taken out every one cycle, two cycles, and four cycles. The duty "$\frac{1}{3}$" is obtained by directly setting the cycle counting state to "6" cycle counting state without counting "4" and "5" cycles. In the mode designation of "6" and "7" in those modes specified by numerals "0" to "7" in accordance with combinations of three bits of $\alpha/\beta$ period mode designation switches $S_{10}$ to $S_{12}$, to OR function matrix circuit 74-2 produces a $K_1$ output signal which is applied, together with the output signal of the weight "64" from the adder 36, to the AND gate 74-13 of which the output signal is supplied through the OR gate 74-14 to the weight "32" of the cycle number register 34-3. Thus, the countings of the "4" and "5" cycle states are skipped. The $K_2$ output of the OR function matrix circuit 74-2 is applied to the OR gate 74-15; the $K_3$ output to the OR gate 74-16; $K_4$ output to the OR gate 74-15 through the inhibit gate 74-5; a $K_6$ output to the OR gate 74-17 through the AND gate 74-9; a $K_5$ output is applied to the OR gate 74-16 through the inhibit gate 74-8; a $K_7$ output to the OR gate 74-18 through the AND gate 74-10; a $K_8$ output is applied to the OR gate 74-19 through the AND gate 74-11; a $K_9$ output is applied to the OR gate 74-20 through the AND gate 74-12. The OR gates 74-15, 74-17 and 74-19 are connected in series to produce an output $X_1$ ($\alpha$). The OR gates 74-16, 74-18 and 74-20 are connected in series to produce an output $X_2$ ($\beta$). Accordingly, the output signals produced on the output lines $X_1$ ($\alpha$) and $X_2$ ($\beta$) correspond to the numerals "0" to "7" for $\alpha$ and $\beta$ period mode designation, as shown in FIG. 20. As shown, the line $X_1$ ($\alpha$) provides a period M on the basis of the waveform by $\alpha$ designation, and the output line $X_2$ ($\beta$) provides a period N on the basis of the waveform by $\beta$ indication. Therefore, in the period modes of "0" to "5", the periods M and N are both integers but, in the period modes "6" and "7", if one of the duties M and N is an integer, the other is not an integer. The output signals $X_1$ ($\alpha$) and $X_2$ ($\beta$) are applied to the inhibit gate 75 and the AND gate 76. Ordinarily, in synchronism with an $\alpha/\beta$ designation signal derived from the exclusive OR gate 71, the inhibit gate 75 is enabled from an indication signal ("0") and the AND gate 76 is enabled for a $\beta$ designation signal ("1"). These output signals pass through the inhibit gates 77 and 78 to be described later and the OR gate 79 to reach the AND gate 51 shown in FIG. 7C.

The switch $R_1$ is connected to the exclusive OR gate 71 and inverts and $\alpha/\beta$ designation signal for each block address outputted from the waveform program designation unit 35 by its operation, with the result that the AND gate 76 produces an output signal in synchronism with the $\alpha$ designation signal and the inhibit gate 75 produces an output signal in synchronism with the $\beta$ designation signal. Therefore, the output $X_1$ becomes a $\beta$ duty and the output $X_2$ an $\alpha$ duty. A switch $R_2$ is connected to inhibit gates 80 and 81 to which a signal P to be described later and its inverted signal $\overline{P}$ are coupled, and indicates whether $\alpha$ and $\beta$ are separated or not. In operation, the inhibit gates 80 and 81 produce no outputs and thus the inhibit gates 77 and 78 produce $X_1$ ($\alpha$) and $X_2$ ($\beta$) signals (when the switch $R_2$ is actuated, signals $X_1$ ($\alpha$) and $X_2$ ($\beta$) are taken out). When the switch $R_2$ is not operated, the inhibit gates 80 and 81 produce a signal P and a signal $\overline{P}$ (these signals are produced only in duet performance designation) and the even line memory is designated by $\alpha$ and the odd line memory by $\beta$. Those are tabulated in FIG. 21. In the preparation of the table shown in FIG. 21, no designation is made by the switch $R_2$ and a switch $R_3$ to be described. Non-separation indication by the switch $R_2$ is effective only for the duet performance. The switch $R_3$ is connected to the exclusive OR gate 70 and, when it is actuated, the $\alpha/\beta$ signal specified for each block by the waveform program designation unit 35 is inverted. That is, the relations of $\alpha$ and $\beta$ are all inverted. In this manner, the octave operation may be performed by the $\alpha$ and $\beta$ duty mode designation, and the duty of the musical sound wave changes and the timbre may also be changed for each octave. Referring to the $\alpha$, $\beta$ non-separation operation shown in FIG. 21, in the case of a mode designation "6", $\alpha$:$\beta$ is 1:15 and $\beta$ is a sound lower by a major fourth interval than $\alpha$. In the mode designation "7", $\beta$ has a duty two time as long as that of $\alpha$. The waveform of $\beta$ is conceivable to be a composite wave of waves with the $\frac{2}{3}$ and double periods of that of the $\alpha$ wave. $\beta$ is a sound including a component higher by a major fifth interval than $\alpha$ and another component lower by an octave than $\alpha$. The periods between different waveforms may be controlled to be M:N. For this, the harmonic structures of those waves may be changed and further when those waves with changed harmonic structures are combined, the harmonic structure of the combined wave is further differently changed. Therefore, such a combined or composite wave exhibits an effective music sound feeling with a more natural time-variation.

Figure 22:
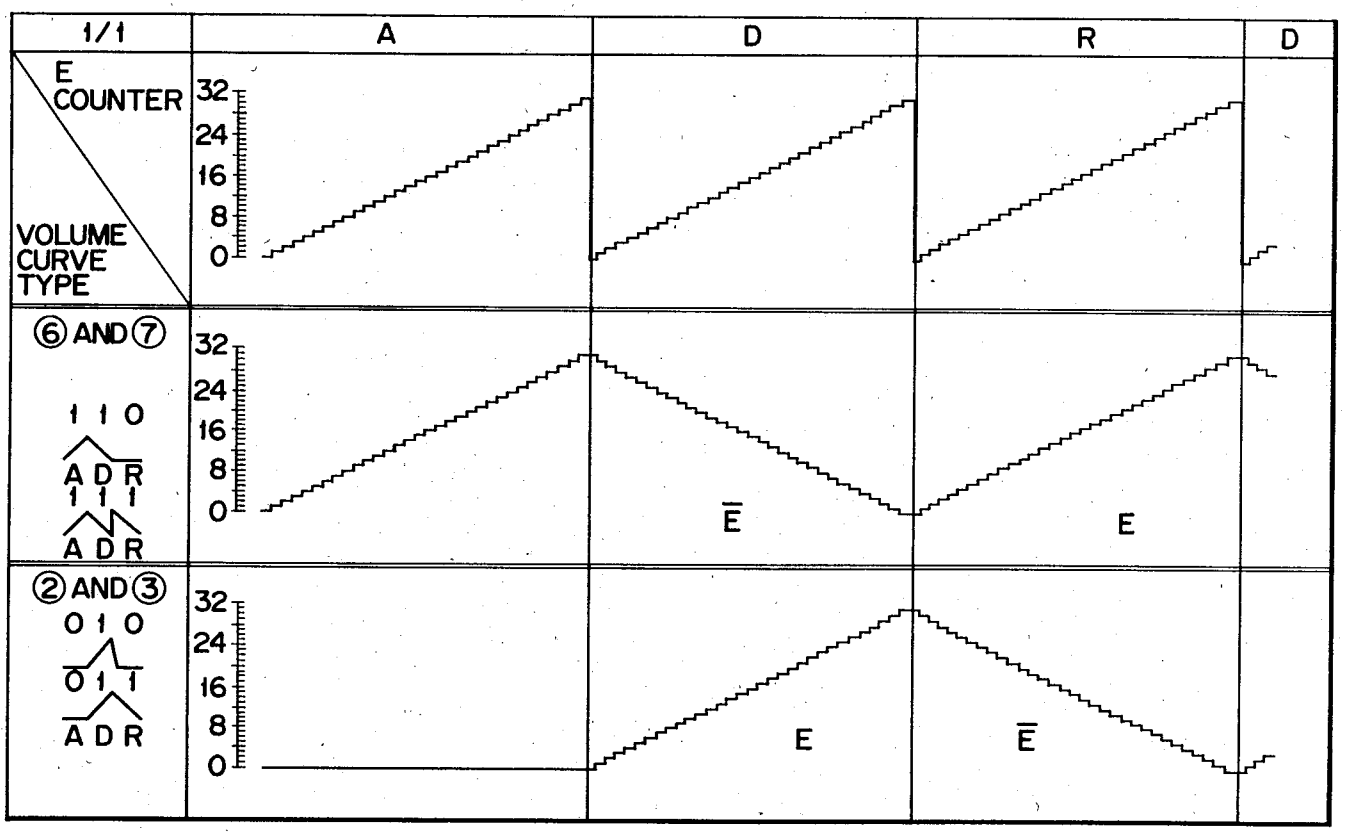
FIGS. 22, 23 and 24 show waveforms for representing the operation of tremolo control of the invention.
Figure 23:
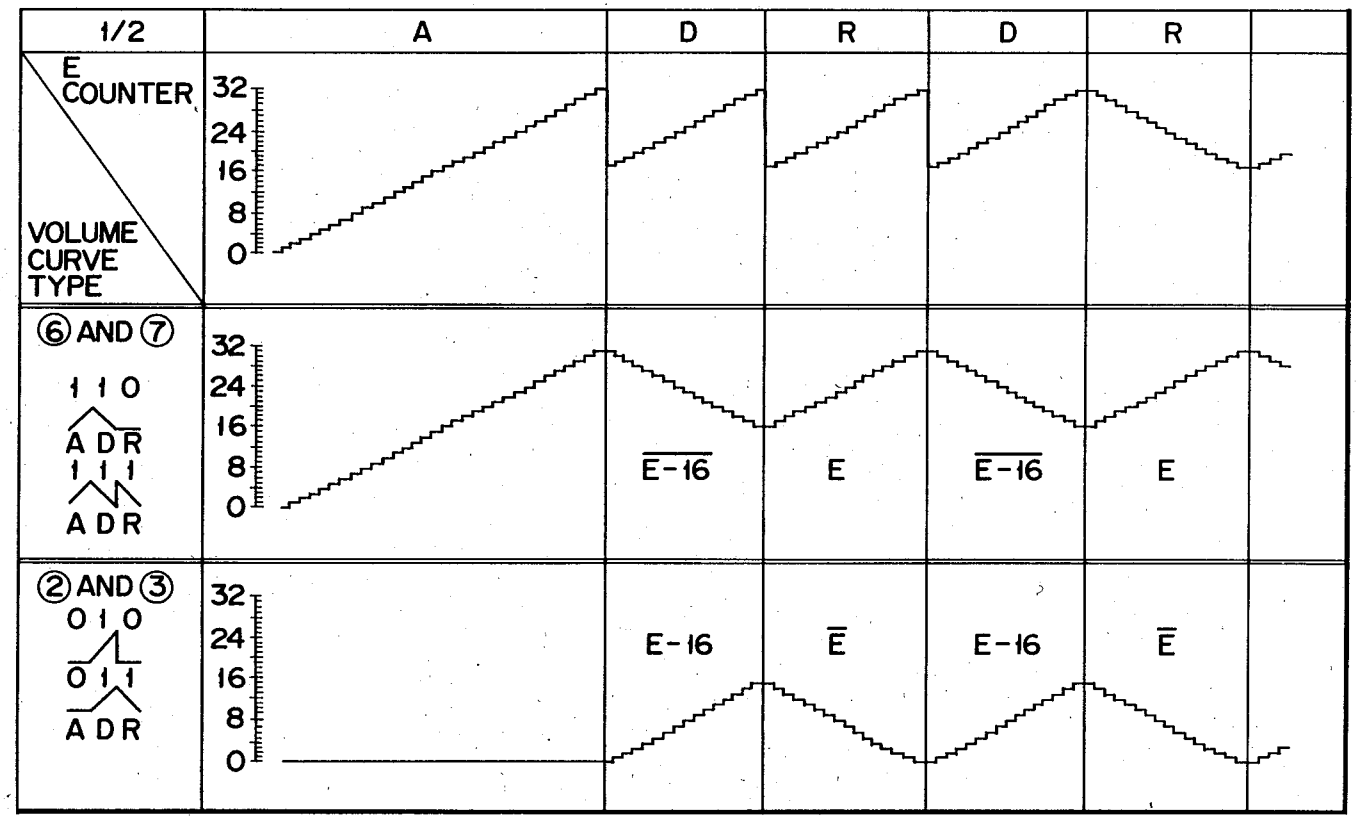
Figure 24:
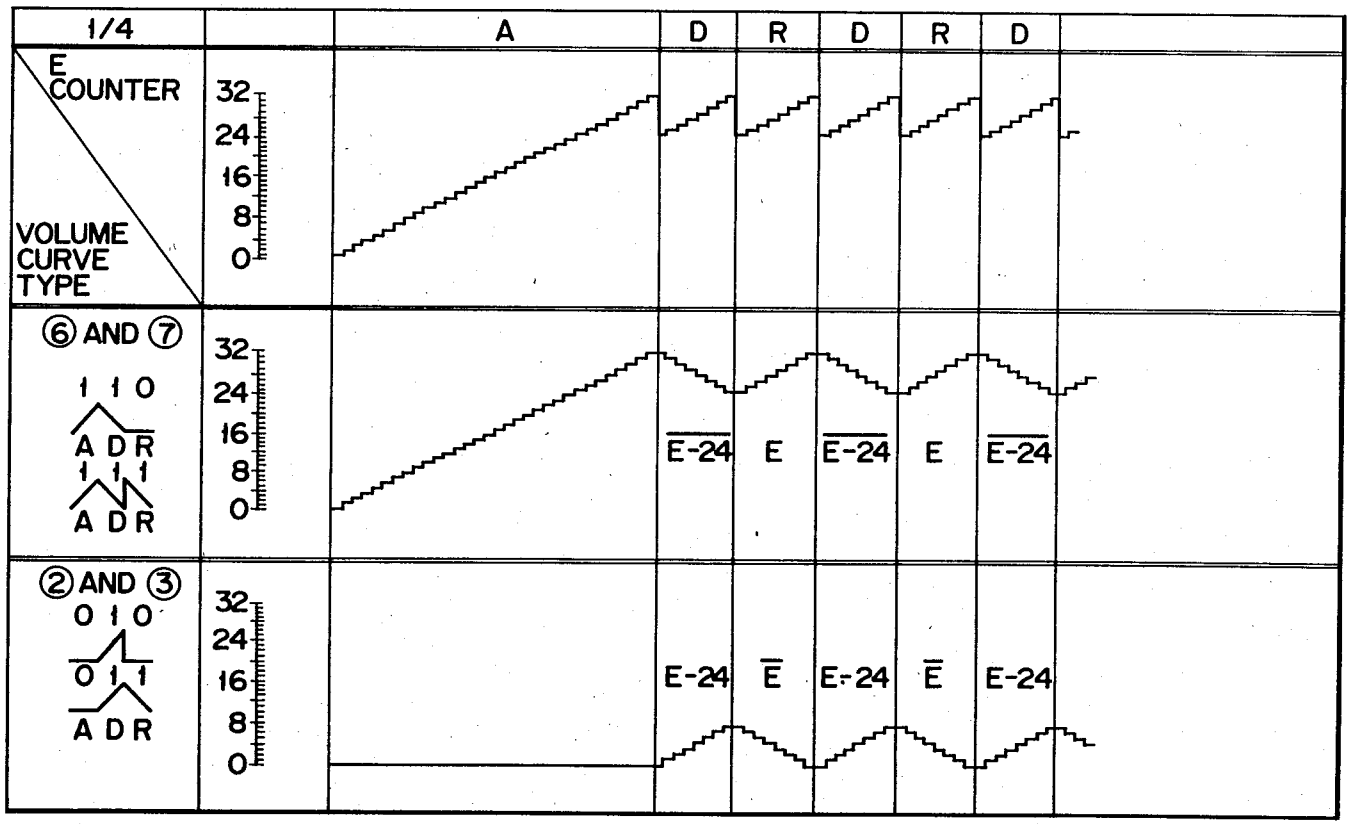
Figure 25A:
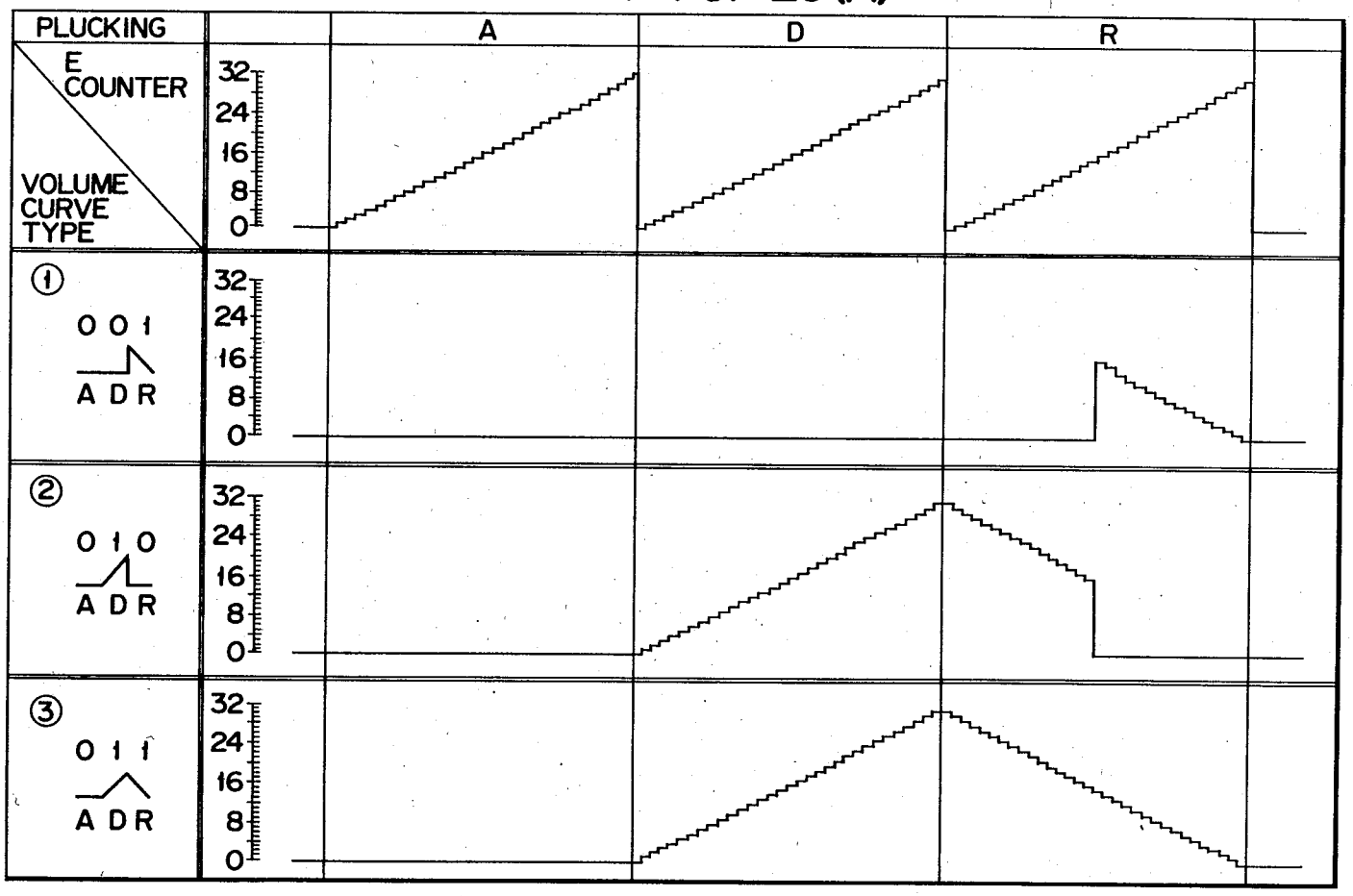
FIGS. 25A and 25B show waveforms for representing the operation of tremolo control of a plucked string.
Figure 25B:
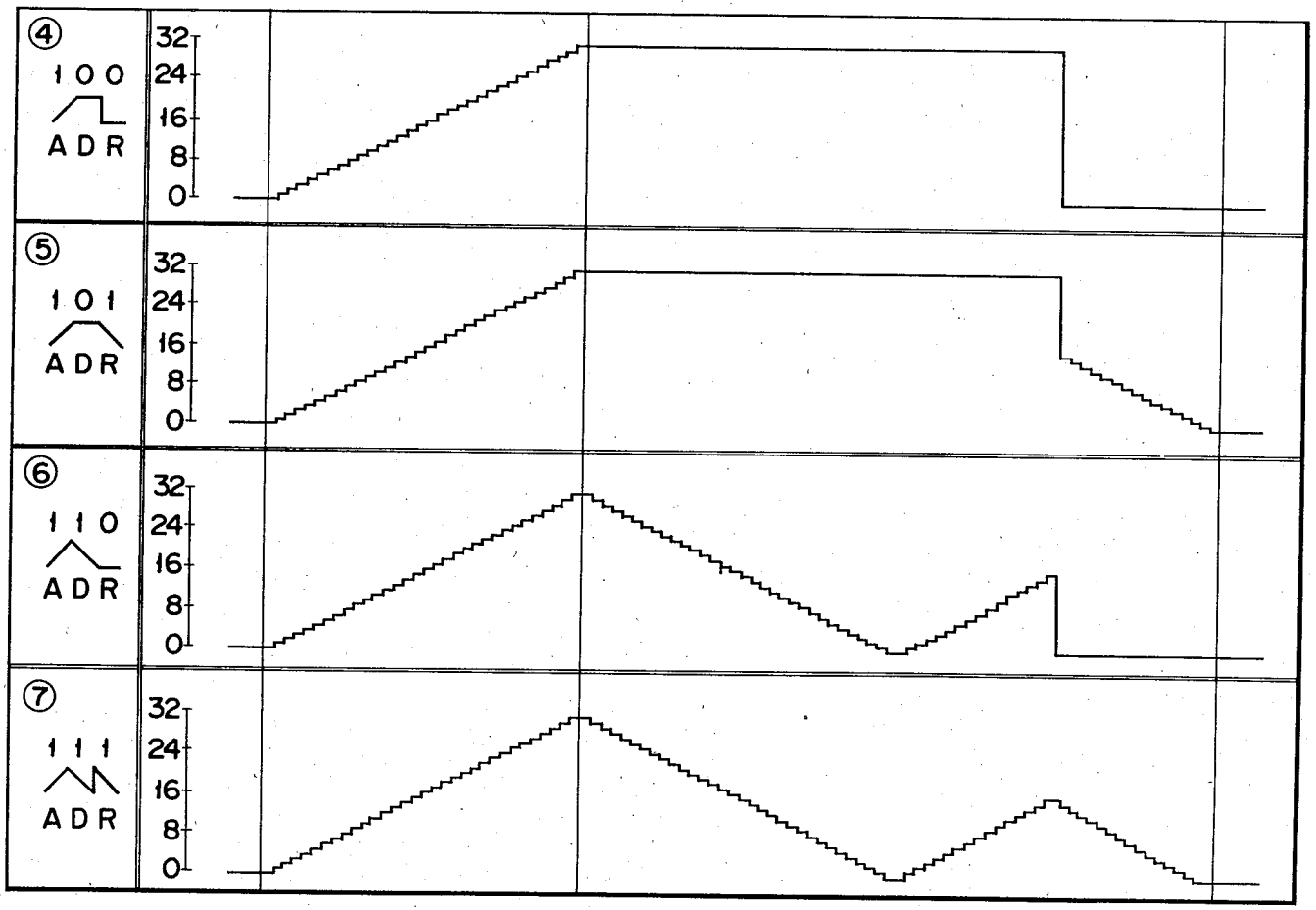

In FIG. 7, the switch $T_1$ is an ordinary tremolo designation switch (called as a tremolo flat). $T_2$ is a touch tremolo designation switch by which a tremolo is applied only in operation. For designation of a touch tremolo, the tremolo flat designation switch is released. Switches $T_3$, $T_4$ and $T_5$ designate the depth (called an amplitude) of a tremolo indicate the maximum amplitude "1" (depth of 100%), "½" (50%), and "¼" (25%), respectively. The designation signal from the switch $T_1$ or $T_2$ is applied to the AND gates 83-1 to 83-3, through an OR gate 82. Accordingly, an output indication signal with an amplitude specified is produced and is applied to a tremolo control circuit 84. The AND gates 83-1 to 83-3 are applied to the AND gate 84-3 and 84-4 via the OR gate 84-1 or 84-2. The output of the AND gate 83-2 is applied to the OR gate 84-6, and the AND gate 84-7, via the AND gate 84-5 coupled with the "64" weight output of the envelope register 54. Accordingly, in the decay state and the release state, the weight "16" of the envelope register 54 is always "1". Further, the output of the AND gate 84-8 for detecting the release state is applied to the AND gate 84-3 of which the output is taken out from the OR gate 84-10 through an inhibit gate 84-9 which is enabled by the designation other than a mandoline designation. For this, the inhibit gate 84-7 is not enabled in the release state while the inhibit gate 84-11 is ready for being enabled. In the designation of tremolo, the "64" weight output from the envelope register 54 is applied to the AND gate 84-4 and the output thereof provides always a "1" signal to the weight "69" of the envelope register 54 through the OR gate 84-12. Accordingly, the state of the envelope does not become a "00" clear state but the decay state and the release state are alternately repeated. The output of the AND gate 83-3 is applied to the OR gates 84-14 and 84-15 through the AND gate 84-13 to which the weight "64" output of the envelope register 54 is applied, and is also applied to the inhibit gate 84-16. Like the inhibit gate 84-7, the inhibit gate 84-16 is not enabled in the release state while the inhibit gates 84-17 and 84-8 are enabled. The weight "32" output of the envelope register 54 is further applied to the inhibit gate 84-21, through the inhibit gate 84-20 coupled with the AND gate 84-19 which is effective only when the tremolo string switch $T_6$ to be described later is actuated. Since the gate output inhibiting signal from the AND gate 84-4 is applied to the inhibit gate 84-21, it is not enabled by the tremolo indication and its output is always "0". Accordingly, the envelope state detecting circuit 73 produces only a decay state signal from the inhibit gate 73-3. In the tremolo designation switches $T_1$ and $T_2$, the envelope coefficient value of the envelope register 54 is as shown in FIGS. 22 to 24 in accordance with the depth indication of the amplitude 1/1, ½ or ¼ and the volume curves (FIG. 13). With respect to volume curves (1), (4), (5) shown in FIG. 13, no tremolo is applied. $T_6$ is a plucking tremolo designation switch. Upon actuation of the switch, the output signal of the inhibit gate 84-22 which is produced under a condition that the envelope is in the release state and the envelope register 54 is above "16", passes through the AND gate 84-19. When the "00" clear state of the envelope register 54 is detected by the inverted AND gate 73-1 in the state detection circuit 73, a release designation signal is applied to the AND gate 72-15 through the inhibit gate 73-5 and the OR gate 73-6. Therefore, in the first half of the release state, it operates by a decay clock signal to be described later, and a string plucking like tremolo along the volume curve as shown in FIGS. 25A and 25B (in this case, the tremolo depth designated is 1/1) is obtained.

The tremolo designation switch $T_2$ is effective when the tremolo designation switch $T_1$ is previously turned off, and the tremolo is effective only in operation.

In accordance with output states at "32" and "64" weights of the envelope register 54, the inhibit gate 85 produces an attack state detection signal (a); the inhibit gate 86 produces a decay state detection signal (d); a series-circuit produces a release detection signal (r); the inhibit inverted gate 66-6 produces a high release detection signal (hr); a series circuit of the AND gates 89 and 90 produces a slow release detection signal (sr). A synchronizing set register 91 designates a high release which is provided with 8 line memories of one bit. These memories each shifts in operation in response to the shift pulse $\phi_0$. The high release (hr) means a relative rapid damping of the envelope for preventing clock sound occurring when a performance key is turned off (particularly when a stationary sound is designated like an organ sound). Therefore, when an hr set signal to be described later is outputted, the signal is applied through an OR gate 92 to an inhibit gate 93 which is enabled when no input indication signal exists, and is applied to a high release synchronizing set register 91 through an inhibit gate 94 which is enabled by an inverted signal from the AND gate 62. The output signal from the inhibit gate 93 sets the synchronizing set register 53 for the envelope clock, through an AND gate 95, an inhibit gate 96 which is enabled in a state other than the "00" envelope state, an OR gate 64 and an OR gate 65, in synchronism with the output signal (an addition timing when a "0" block address signal is generated) from the AND gate 62. Upon the setting, the register 53 performs a high release operation.

Figures 1, 27A:
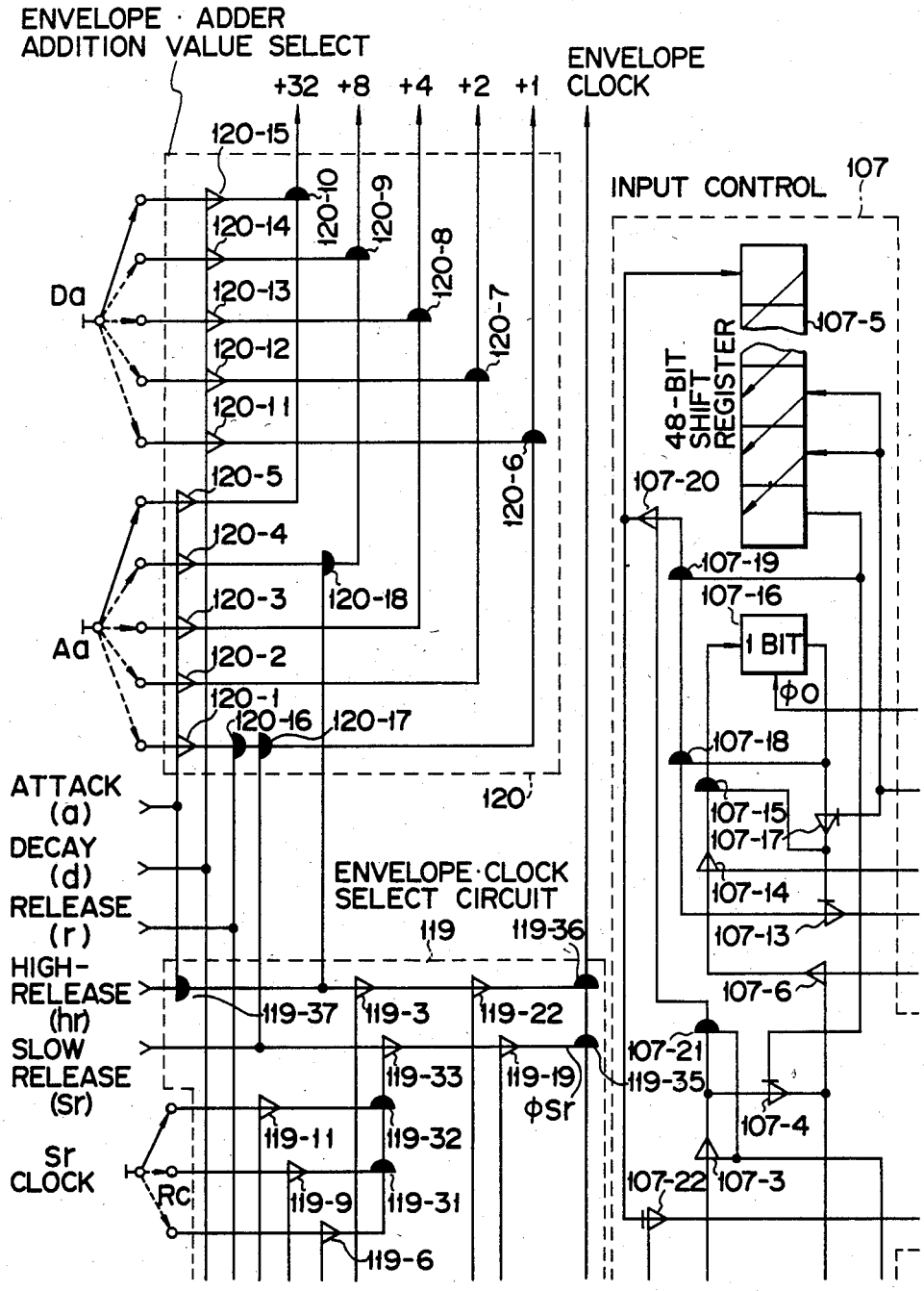
FIGS. 27A and 27B show a circuit diagram of one example of a concrete control section for controlling the circuitry shown in FIGS. 7A, 7B, 7C and 7D.
Figures 2, 27A:
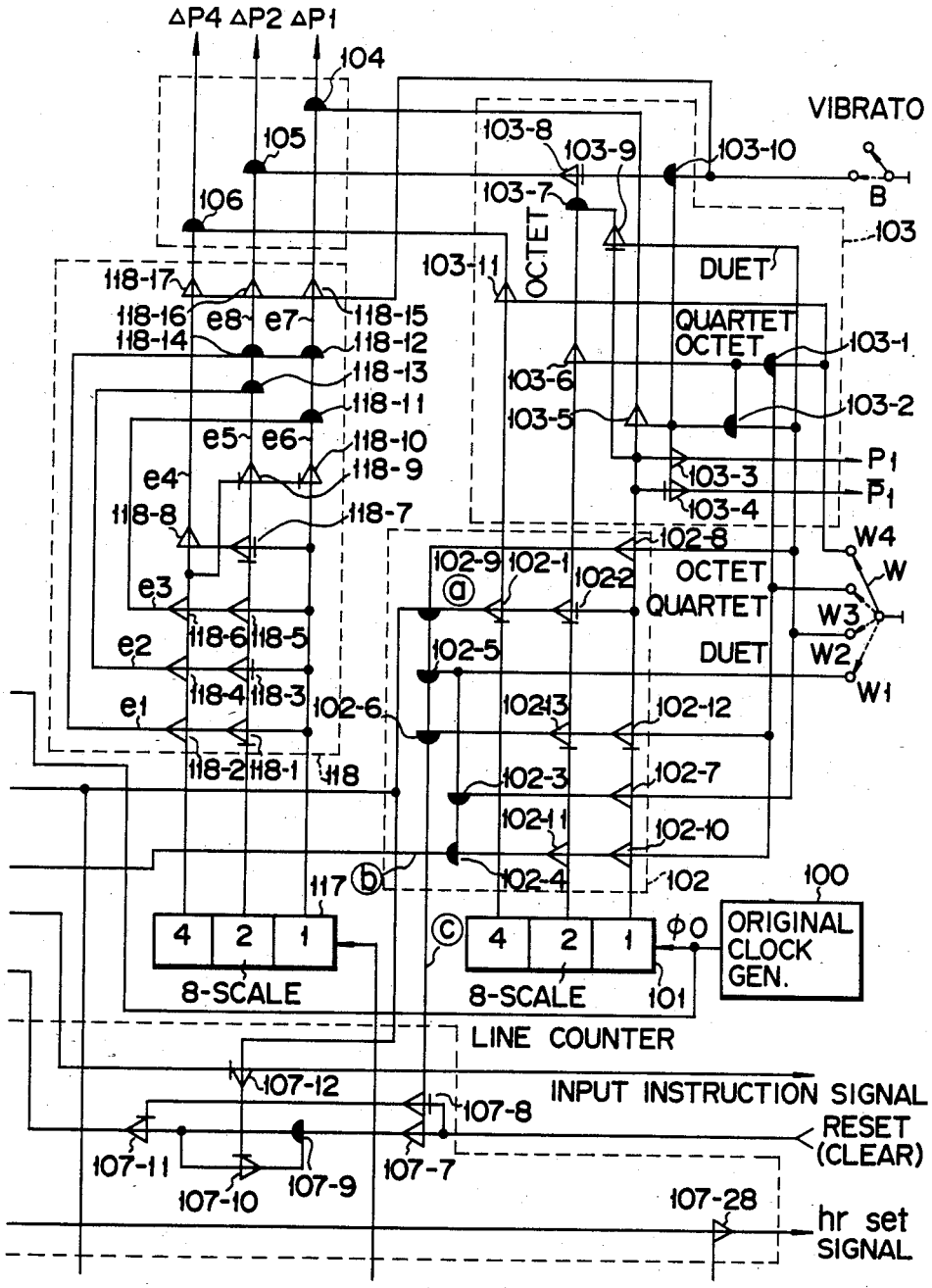
Figures 1, 27B:
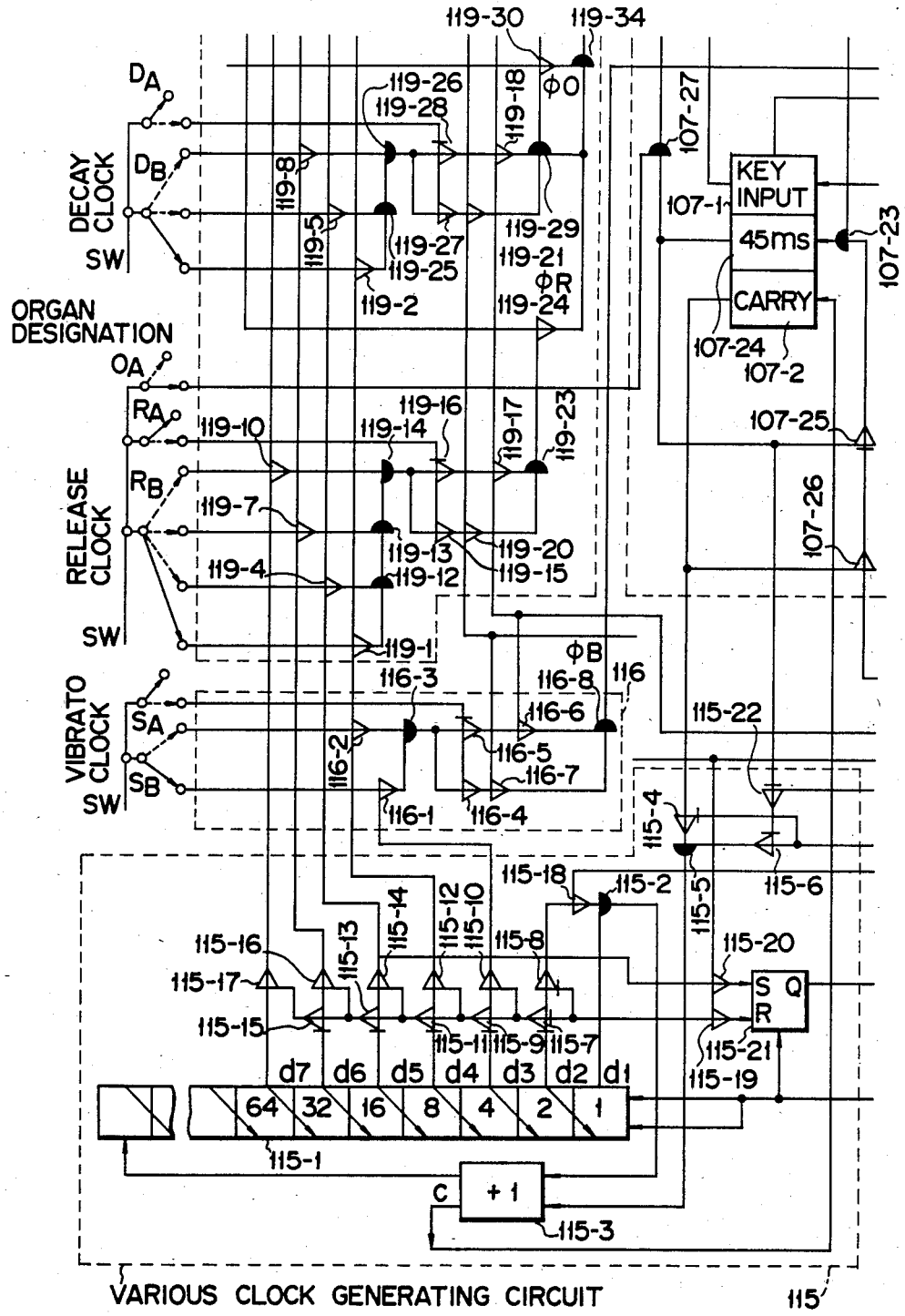
Figures 2, 27B:
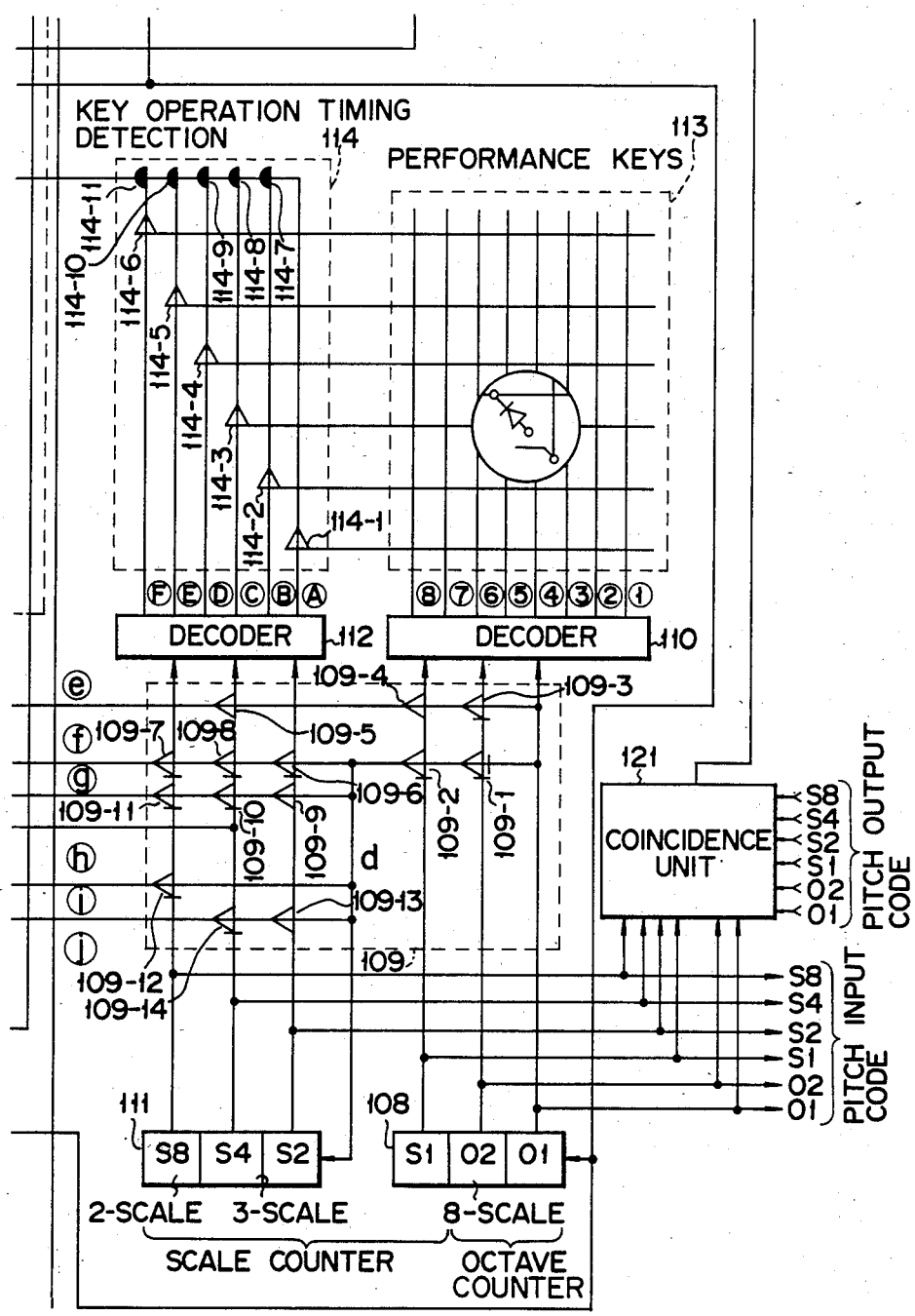

The description thus far made relates to a major part of the electronic musical instrument according to the invention. Timing signals for controlling the circuit construction shown in FIGS. 7A, 7B, 7C and 7D, various clock signals for controlling the envelope, multiple performance control signals such as duct control signals, performance keys, key input controls will be described by using circuit diagrams shown in FIGS. 27A and 27B which are combined as shown in FIG. 26 to form a complete circuit diagram.

Figure 28A:
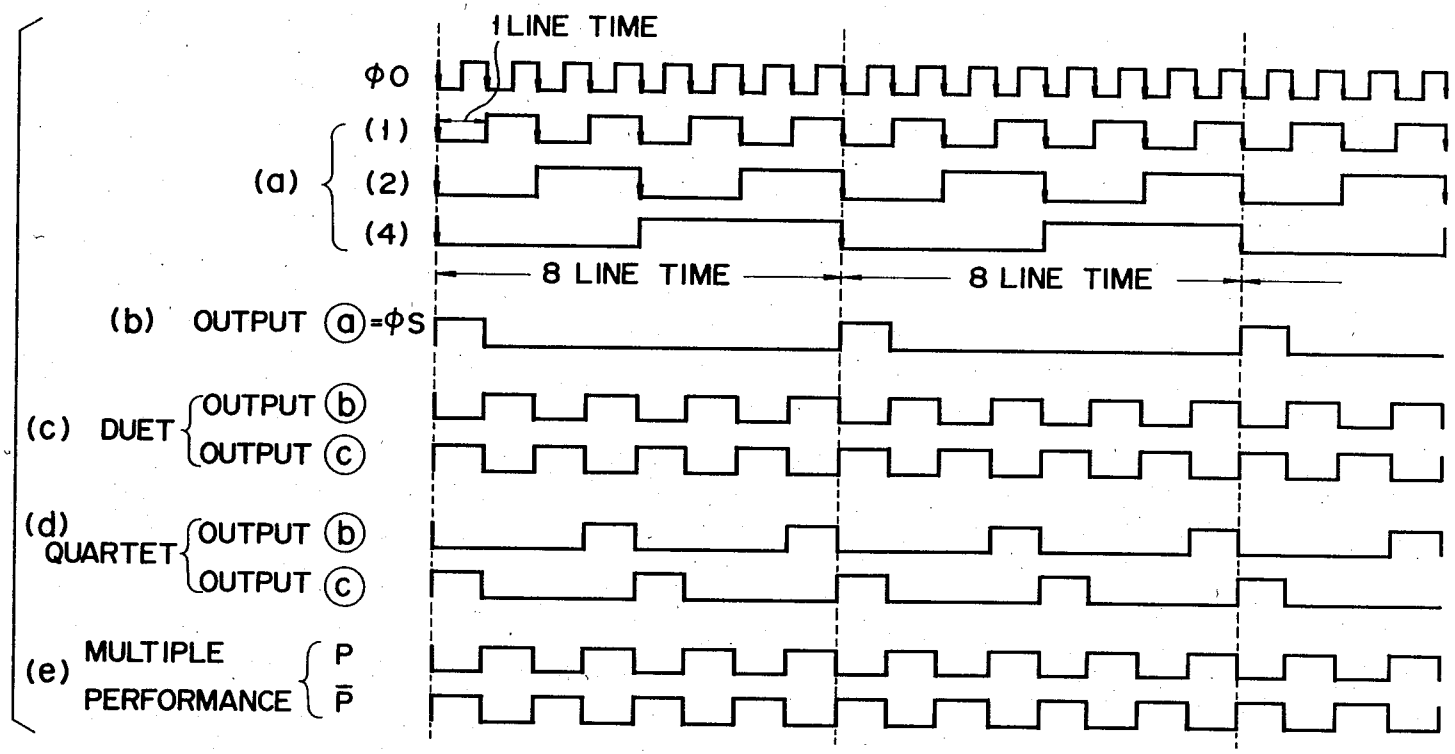
FIGS. 28A and 28B show a time chart repesenting the operation relating to duet, quartet and the like with respect of the circuit shown in FIG. 27A.
Figure 28B:
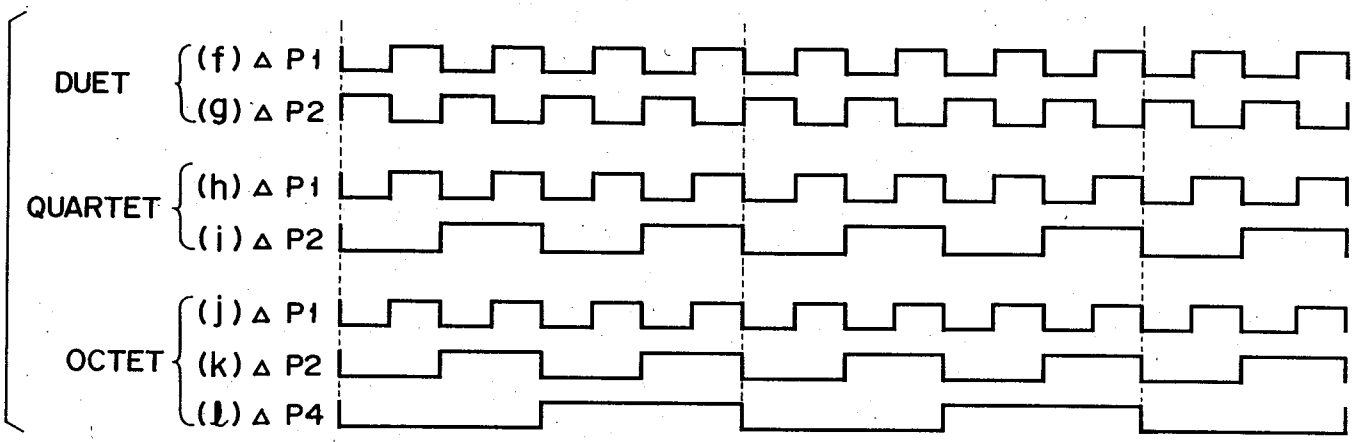
Figure 29A:
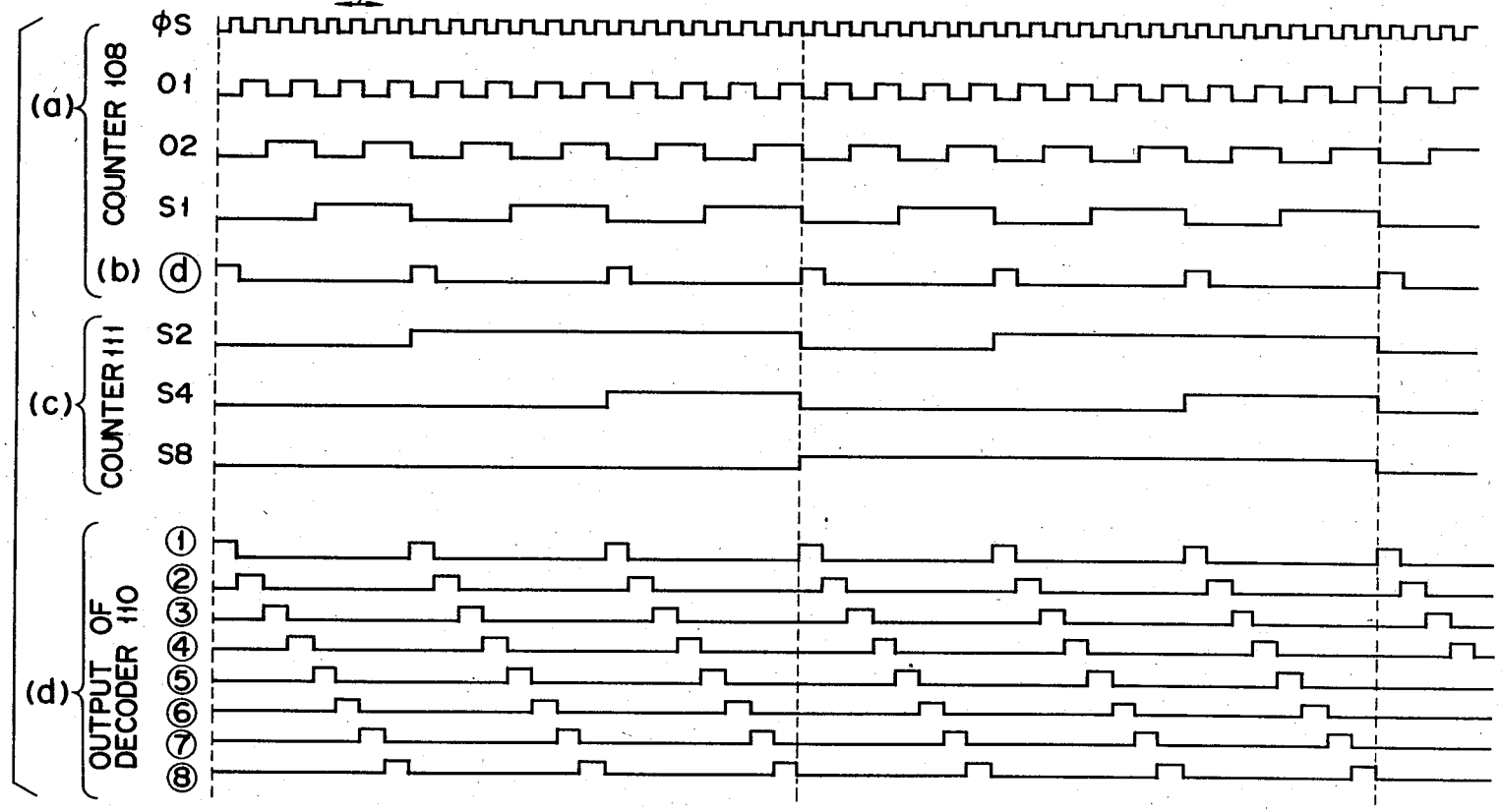
FIGS. 29A and 29B is a time chart showing the relation between input timing of performance keys and a synchronizing signal.
Figure 29B:
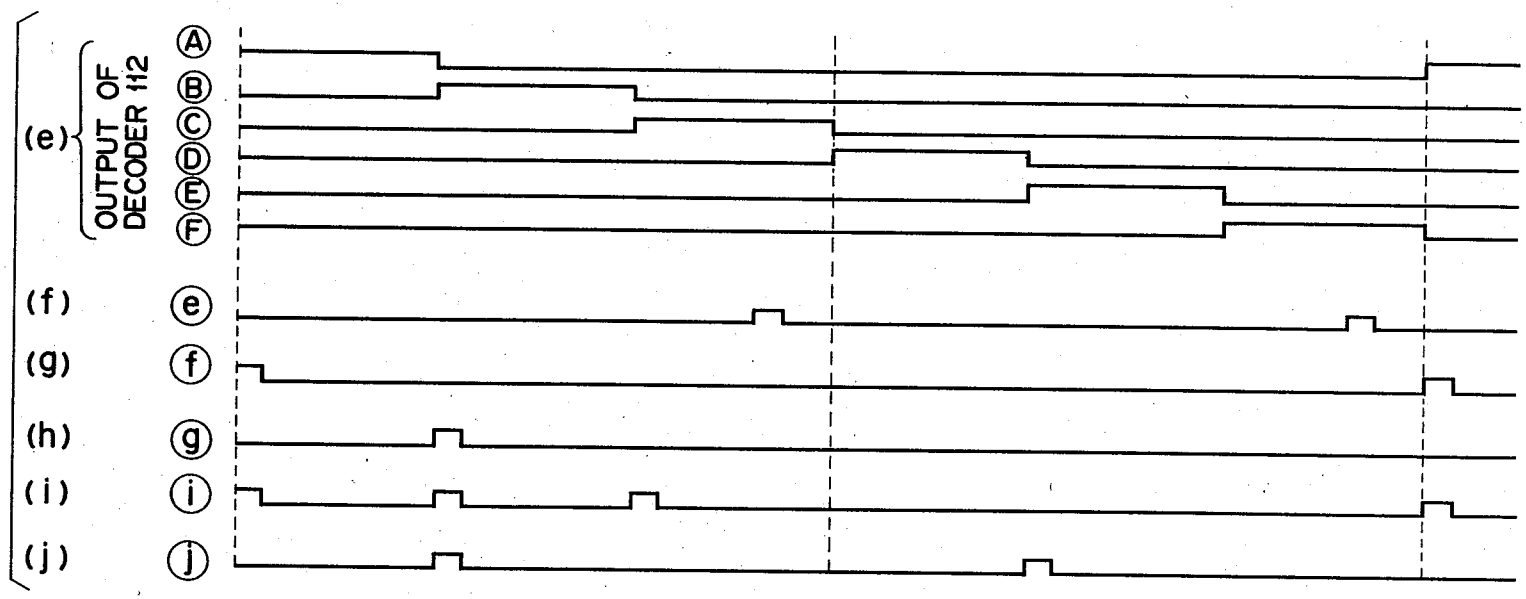

A basic clock signal $\phi_0$ (for example, 272,510 Hz) outputted from an original clock generator 100 is applied to a line counter 101 which performs counts corresponding to one circulation of 8 line memories which constitute each of registers 20, 21, 34, 53 and 54 shown in FIGS. 7A to 7D. The counter 101 is an 8-scale counter. The control timing generating circuit 102 is supplied with indication signals at contact positions $W_1$ (no multiple performance indication), $W_2$ (duet indication), $W_3$ (quartet indication) of a multiple performance indication switch W. Accordingly, an output signal shown in FIG. 28B is outputted to the output line (a), through an inhibit gate 102-1 and inhibit AND gate 102-2. In the case of no multiple performance indication, a "1" signal is outputted to an output line (b) through OR gates 102-3 and 102-4. A "1" signal is outputted to an output line (c) through OR gates 102-5 and 102-6. In the case of a duet indication, an output signal shown in FIG. 28(*c*) is outputted to an output line (b) through AND gates 102-7, and OR gates 102-3 and 102-4. An output signal shown in FIG. 28(c) is outputted to an output line c through an inhibit gate 102-8, and OR gates 102-9, 102-5 and 102-6. In the case of a quartet indication, an output signal shown in FIG. 28(d) is outputted from an output line (b) through AND gates 102-10 and 102-11 and an OR gate 102-4. An output signal shown in FIG. 28(c) is outputted from an output line (c) through inhibit gates 102-12 and 102-13, and an OR gate 102-6. The respective bit stage outputs of an octet indication signal, a quartet indication signal, a duet indication signal at the contact $W_4$ of the indication switch W and the line counter 101 are supplied to a timing signal generator for multiple performance 103. With this connection, an OR gate 103-1 produces a quartet indication signal or a octet indication signal and an OR gate 103-2 produces a multiple performance signal (which is produced in response to duet, quartet, or octet indication). The signal from the AND gate 103-2 is supplied to an AND gate 103-3 and an inhibit gate 103-4. Accordingly, the weight "1" output signal of the line counter 101 is outputted as signals P and $\overline{P}$ from the respective gates and is applied to inhibit gates 80 and 81 of FIG. 7C. The signal from the OR gate 103-2 is supplied to an AND gate 103-5 from which an output signal of weight "1" of the line counter 101 is taken out and is outputted as a "+1" command signal through an OR gate 104. The output from the OR gate 103-1 is supplied to an AND gate 103-6 so that the weight "2" of the line counter 101 provides an output signal which in turn is applied to an OR gate 103-8 through an OR gate 103-7. A duet indication signal is supplied to an inhibit gate 103-9 from which an inverted signal of the line counter 101 is taken out and is applied through an OR gate 107 to an OR gate 103-8. The multiple performance signal outputted from the OR gate 103-2 is applied as an inverted signal to the OR gate 103-8 through an OR gate 103-10. The OR gate 103-10 is supplied with an operation signal of a vibrato designation switch B. The output of the OR gate 103-8 provides output signals shown in FIGS. 28(b),(g) and (i) by duet and quartet indications, through an OR gate 105. When an octet indication signal is applied to an AND gate 103-11, the output signal of weight "4" from the line counter 101 is outputted from the AND gate 103-11 and is outputted as a signal shown in (k) in FIG. 28B through an OR gate 106. Timing signals shown at (f) and (g) in FIG. 28B are produced from the OR gates 104 and 105 when duet is indicated. The timing signals shown in (h) and (i) of FIG. 28B are produced from OR gates 104 and 105 when a quartet is indicated. Timing signals shown in (j), (k) and (l) of FIG. 28B are produced from OR gates 104 to 106 when an octet is designated, and applied to AND gates 97-1 to 97-3 and then supplied to an adder 40 in synchronism with a "0" block address signal. The additional value in the multiple performance such as the duet indication is used to provide frequency fine differences to the respective line memories. The timing signals on the lines (a), (b) and (c) outputted from the control timing generator 102 are supplied to an input control circuit 107 and the timing signal from the output line a is supplied to an octave counter 108 shown in FIG. 27B. The octave counter 108 is a three-bit 8-scale counter which is driven every 8-line time of $8\phi_0$. The lower two bits in the counter (weights "1" and "2") serve as an octave input code shown in FIG. 7A of a code state of fourth octave. See (a) of FIG. 29A. The respective three-bit output stages of the octave counter 108 are supplied to a synchronizing signal generator 109 and to a decoder 110. All-"0" state of three bits are detected by an inverted AND gate 109-1 and an inhibit gate 109-2. As a detection output (d), the timing signal shown in (b) of FIG. 29A is taken out and is applied as a count step signal to the scale counter 110. The scale counter 111 has a construction that two lower bits operates as a 3 scale counter and its carry drives a binary counter of upper one bit ((c) of FIG. 29A). In actuality, a scale counter is constructed by 4 bits obtained by combining it with the most significant bit of the counter 108, accordingly the 4-bit output serves as a scale input code shown in FIG. 7A. The counter 111 is supplied to the output of the synchronizing signal generator 109 and to a decoder 112. Eight outputs (1) to (8) of the decoder 110 provide different timing signals, as shown in FIG. 29B(d) and are applied to eight column lines of performance keys 113. The performance key group 113 includes 48 performance keys arranged in matrix fashion, with six output lines connecting to AND gates 114-1 to 114-6 of a key operation timing detecting circuit 114. The AND gates 114-1 to 114-6 are supplied with six different timing signals ((e) of FIG. 29B) produced from the output lines (A) to (F) of a decoder 112. From the AND gates 114-1 to 114-6, key input timing signals corresponding to the performance keys actuated of those 48 are taken out by a series circuit of OR gates 114-7 to 114-11 and are applied to a key input F/F 107-1 of an input terminal control circuit.

The timing signals outputted from the synchronizing signal generator 109 are detected in accordance with the counters 108 and 111. The timing signals shown in (f) of FIG. 29B from the output (e) are detected by inhibit gates 109-3 to 109-5. Timing signal shown in (g) of FIG. 29B from an output line (t) is detected by an inverted AND gate 109-1 and inhibit gates 109-2 and 109-5 to 109-8. A timing signal shown in (h) of FIG. 29B from an output (g) is detected by an AND gate 109-9 and inhibit gates 109-10 and 109-11. The output signal of $S_4$ of the counter 111 from an output (h) and a timing signal shown in (i) of FIG. 29B from an output (i) are detected by an inhibit gate 109-12. A timing signal shown in (j) of FIG. 29B from an output (j) is detected by using an AND gate 109-13 and an inhibit gate 109-14. A shift register 115-1 of a clock signal generator 115 operates dynamically with 24 bits and is shifted by a clock signal produced every 8 line times from the output line (a) of the control timing generator 102. Accordingly, one circulation of the shift register 115-1 synchronizes with a total of 24 scales which is the sum of 8 scales of the counter 108 and 3 scales of the counter 111. The shift register 115-1 includes first to third counting parts each with 8 bits. The first and second counting parts are used for generating time clock signals of vibrato and envelope. The third counting part is used to count a given time when a new performance key is present to be described later. Basically, the first counting part is an 8-bit binary counter operating by the timing signal from an output line (1) of the synchronizing signal generator 109 (FIG. 29B). The second counting part is an 8-bit binary counter with lower two bits for three scale counting, which operates in response to a timing signal delivered from the output line (h). The third counting part is a binary counter operating by a timing signal from the output line (e). The output signal from an output $d_1$ of the shift register 115-1 is supplied to an adder 115-3 through an OR gate of which the output is recirculatingly applied to the input side of the shift register 115-1. The carry signal from the adder 115-3 is applied to an inhibit gate 115-4 through a carry F/F 107-2. The output signal of the inhibit gate 115-4 is inhibited at the generation of the timing signal from the output (i) of the synchronizing signal generator 109. The output signal also is applied to the adder 115-3 through an OR gate 115-5. The timing signal from the output (i) also is applied to the OR gate 115-5 through an inhibit gate 115-6. The output $d_2$ of the shift register 115-1 is applied to an inverted AND gate 115-7 and an inhibit gate 115-8; the output $d_3$ to an inhibit gate 115-9 and an AND gate 115-10; the output $d_4$ to an inhibit gate 115-11 and an AND gate 115-12; the output $d_5$ to an inhibit gate 115-13 and an AND gate 115-14; the output $d_6$ to an inhibit gate 115-15 and an AND gate 115-16; the output $d_7$ to an AND gate 115-17. The inverted AND gate 115-7 and inhibit gates 115-9, 115-11, 115-13 and 115-15 are coupled with AND gates 115-10, 115-12, 115-14, 115-16 and 115-17. The output signals from the respective AND gates are taken out as one-shot pulses (each with an $8\phi_0$ width). The output $d_1$ is applied to the inhibit gate 115-8 of which the output is coupled with an AND gate 115-18. A timing signal from the output (1) of the synchronizing signal generating circuit 109 is applied to an AND gate 115-18, and also to an adder 115-3 through an OR gate 115-2. That is to say, it controls a three scale counter of the lower two bits in the second counting part. The output $d_1$ from the shift register 115-1 is applied to an AND gate 115-19 and the output of the AND gate 115-14 is applied to an AND gate 115-20. The outputs of those are applied as reset and set signals to a flip-flop 115-21 (with no delay) for determining a time for chattering prevention in synchronism with a timing signal from the output (g).

Figures 1, 7D:
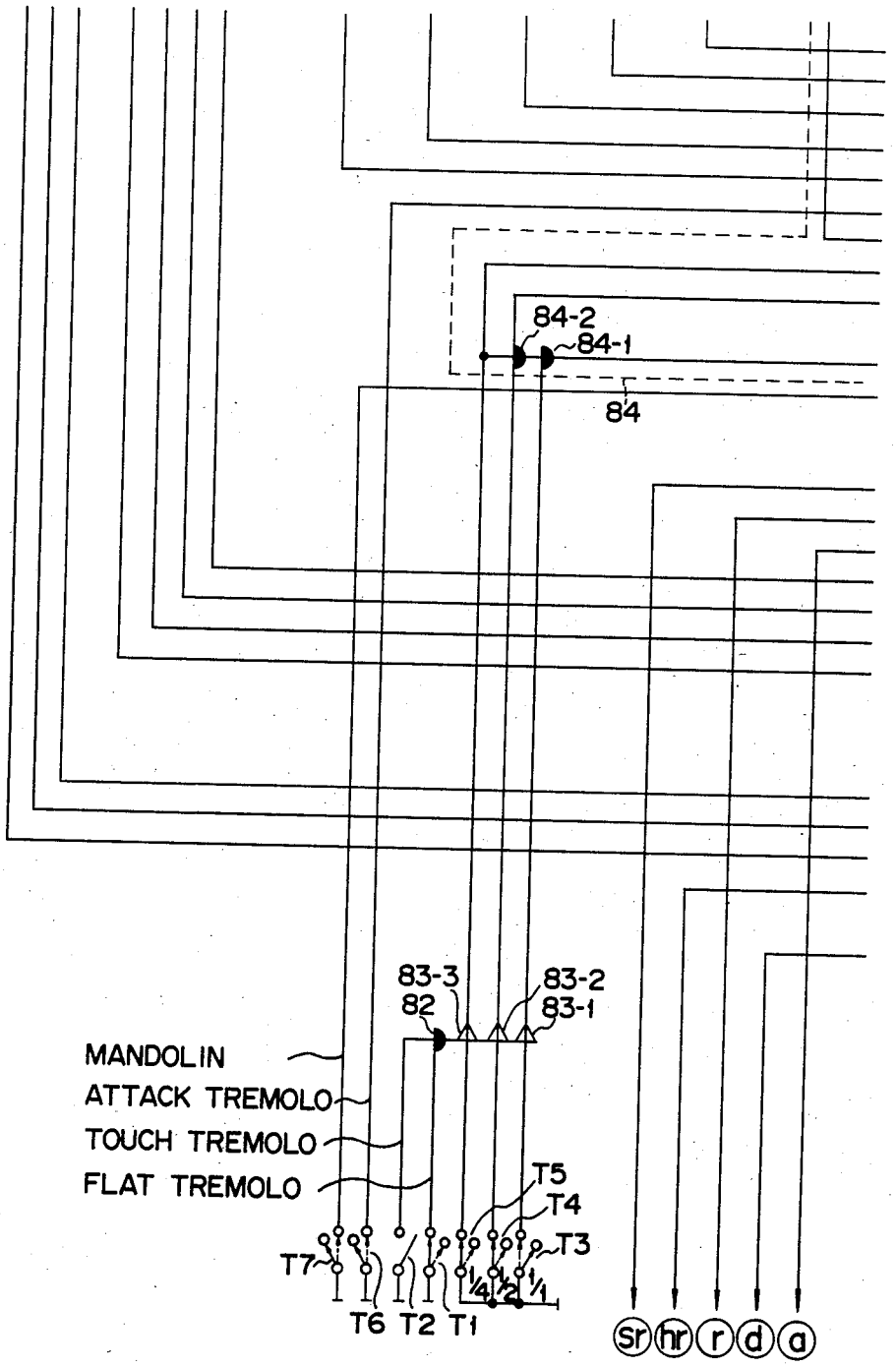
Figures 2, 7D:
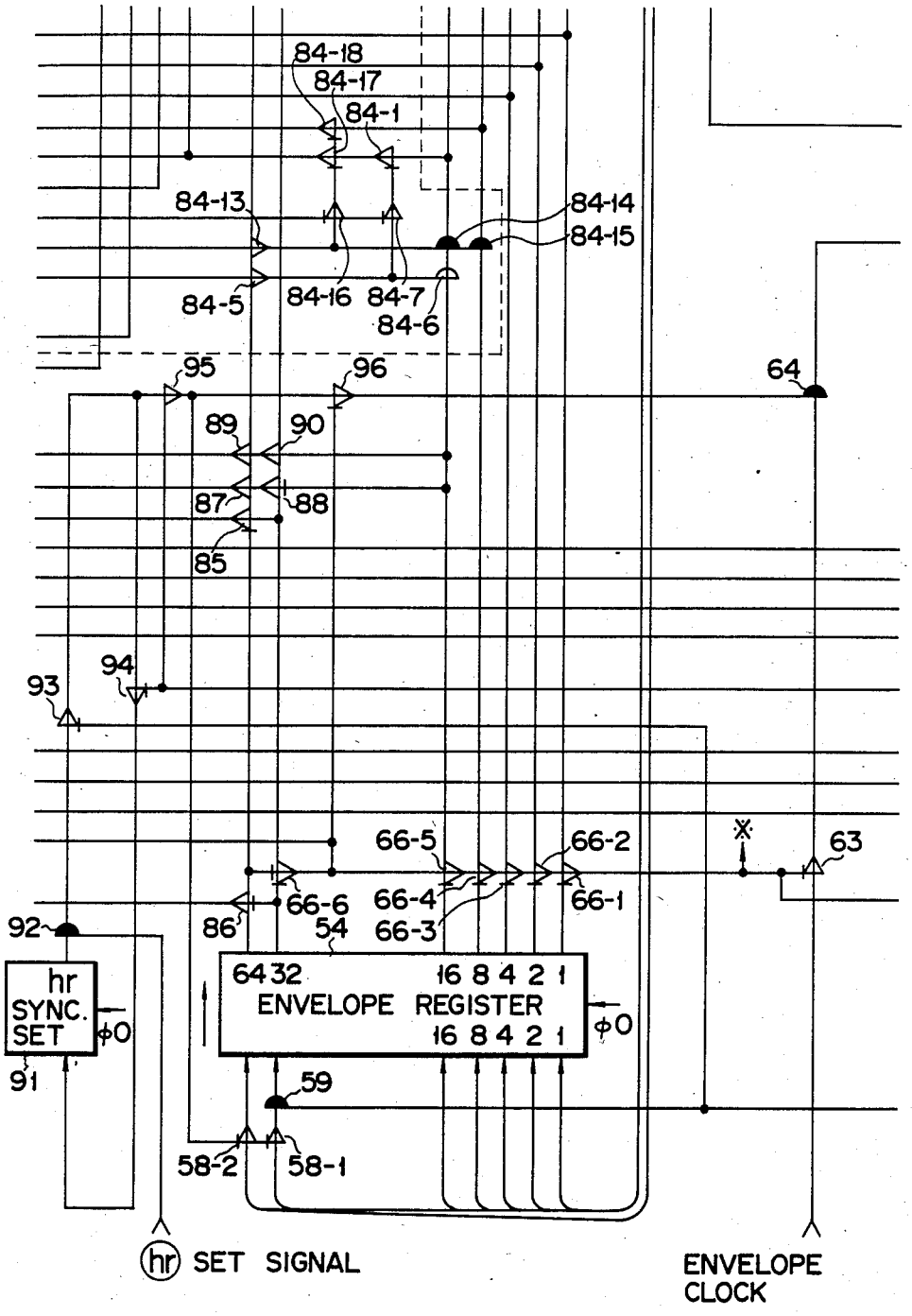

Reference numeral 116 designates a vibrato clock selection circuit. In the circuit, a time clock signal from the AND gate 115-10 is applied to an AND gate 116-1; a time clock signal from the AND gate 115-12 to an AND gate 116-2. The output signals from those AND gates 116-1 and 116-2 are applied through an OR gate 116-3 to an AND gate 116-4 and an inhibit gate 116-5. The output of the inhibit gate 116-5 is applied to an AND gate 116-6 to which a timing signal from the output (1) of the synchronizing signal generator 109. The output from an AND gate 116-4 is supplied to an AND gate 116-7 to which a timing signal from the output (g) is applied. The outputs of the AND gate are outputted as a vibrato clock signal $\phi_B$, through an OR gate 116-8. The vibrato clock signal $\phi_B$ becomes different time clock signals depending on vibrato clock selection switches $S_A$ and $S_B$ selected. As seen from FIG. 30, the switch $S_A$ indicates whether a time clock signal determined by the first counting section of the shift register 115-1 is taken out or the time clock signal determined by the second counting part is taken out. The vibrato clock signal $\phi_B$ is applied as a count signal to the counter 117 of 8-scale. The counter 117 produces signals shown in (a) in FIG. 31 at the respective stages which in turn is applied to a vibrato control circuit 118. In accordance with this counting state, a timing signal shown in FIG. 31B is detected by an inhibit gate 118-1 and an AND gate 118-2 onto an output $e_1$. A timing signal shown in FIG. 31C is detected by an inhibit gate 118-3 and an AND gate 118-4 onto an output $e_2$. A timing signal shown in FIG. 31D is detected by AND gates 118-5 and 118-6 onto an output $e_3$. A timing signal shown in FIG. 31E is detected by an inverted AND gate 118-7 and an AND gate 118-8 onto an output $e_4$. A timing signal shown in FIG. 31F is detected by an inhibit gate 118-9 onto an output $e_5$. A timing signal shown in FIG. 31G is detected by an inhibit gate 118-10 onto an output $e_6$. A series circuit of OR gates 118-10 and 118-11 for obtaining a logical sum of outputs $e_1$, $e_3$ and $e_6$ detects a timing signal shown in FIG. 31H and provides it onto an output $e_7$. A series circuit including OR gates 118-13 and 18-14 for obtaining a logical sum of outputs $e_1$, $e_2$ and $e_5$ detects a timing signal shown in (i) of FIG. 31 and provides it onto an output $e_8$. Accordingly, the timing signals $e_7$, $e_8$ and $e_4$ are outputted onto AND gates 97-1 to 97-3 to which a "0" block signal shown in FIG. 7A is applied through AND gates 118-15 to 118-17 and OR gates 104 and 105 when an operation is designated by vibrato designation switch B. That is, at the vibrato designation time, outputs $\Delta P_1$, $\Delta P_2$, $\Delta P_4$ are outputted in accordance with the contents of the counter 117. An envelope clock select circuit 119 selects an envelope clock applied to an inhibit gate 63 shown in FIG. 7D. $R_A$ and $R_B$ are switches for selecting a time clock signal in the release state. $D_A$ and $D_B$ are switches for selecting a time clock in the decay state. $R_C$ is a switch for selecting a slow release clock signal. $O_A$ is a switch for designating an organ like (stationary sound) envelope. A time clock signal outputted from the AND gate 115-12 is applied to AND gates 119-1 to 119-3. A time clock signal from an AND gate 115-14 is applied to AND gates 119-4 to 119-6. A time clock signal outputted from an AND gate 115-16 is applied to AND gates 119-7 to 119-9. A time clock signal outputted from an AND gate 115-17 is applied to AND gates 119-10 and 119-11. A selection contact output signal from the switch $R_B$ is applied to AND gates 119-1, 119-4, 119-7 and 119-10. The outputs of those AND gates are applied to a series circuit of OR gates 119-12 to 119-14. The output signal from the series circuit is coupled with an AND gate 119-15 and an inhibit gate 119-16. The timing signal from the output (f) of the synchronizing signal generator 109 is applied to AND gates 119-17 to 119-19; a timing signal from the output (g) to AND gates 119-20 to 119-22. The AND gate 119-15 and an inhibit gate 119-16 are coupled with the AND gates 119-20 and 119-17. The outputs of these gates go out as a release clock signal $\phi_R$ through an AND gate 119-24 to which a release state detecting signal shown in FIG. 7D is applied through an OR gate 119-24. As seen from FIG. 30, a switch $R_A$ indicates whether a time clock signal determined by the first counting part of the shift register 115-1 is taken out or a time clock signal determined by a second counting part is taken out. A selection contact output of a $D_B$ switch is applied to AND gates 119-2, 119-5 and 119-8. The outputs from these AND gates are supplied to a series circuit of OR gates 119-25 and 119-26. The output of the series circuit is applied to an AND gate 119-27 and an inhibit gate 119-28. The outputs of the AND gate 119-27 and the inhibit gate 119-28 are applied through AND gates 119-21 and 119-18 and an OR gate 29 to an AND gate 119-30 which produces a decay clock signal when the decay state detecting signal shown in FIG. 7D appears. A selection contact output signal of the switch $R_C$ is applied to AND gates 119-6, 119-9 and 119-11 of which the outputs are applied to a series circuit of OR gates 119-31 and 119-32. The output signal from the series circuit causes AND gates 119-33 and 119-19 to produce a slow release clock signal $\phi_{sr}$ at the time that the slow release state signal supplied from the circuit in FIG. 7D is generated. The AND gate 119-3 produces an output at the time that a high release state detecting signal or an attack state detecting signal supplied from the circuit in FIG. 7D through an OR gate 119-37 is generated and, upon receipt of the output from the gate 119-3, AND gate 119-22 produces a high release clock signal $\phi_{hr}$ or an attack clock signal $\phi_A$. A release clock signal $\phi_B$ outputted from the AND gate 119-24, a decay clock signal $\phi_D$ outputted from the AND gate 119-30, a slow clock signal $\phi_{sr}$ outputted from the AND gate 119-19, a high release clock signal outputted from the AND gate 119-22 are applied, as an envelope clock signal outputted from a series circuit of OR gates 119-34, 119-35 and 119-36, to the inhibit gate 63 shown in FIG. 7D.

An addition value designation circuit 120 designates an addition value to an adder 55 for envelope shown in FIG. 7C in attack, decay, release, slow release and high release states. A rise time and a fall time of an envelope with respect to time may be rapidly controlled by adding (+) or subtracting (−) an addition value with an envelope coefficient value specified. A switch Aa is a selecting switch with five contacts. The contact output signals cause AND gates 120-1 to 120-5 to produce addition command signals "+1", "+2", "+4", "+8" and "+32" through OR gates 120-6 to 120-10. Da denotes a selecting switch with five contacts. The contact output signals cause AND gates 120-11 to 120-15 and OR gates 120-6 to 120-10 to produce addition value command signals "+1", "+2", "+4", "+8" and "+32". When a release state detecting signal is produced, a "+1" additional command signal is produced through an OR gate 120-16. When a slow release state detecting signal is produced, a "+1" addition value command signal is produced through an OR gate 120-17. When a high release state detecting signal is generated, a "+8" addition command signal is produced through an OR gate 120-18. Those addition value signals are supplied to an adder 55 shown in FIG. 7C, through AND gates 67-1 to 67-5.

Figure 30:
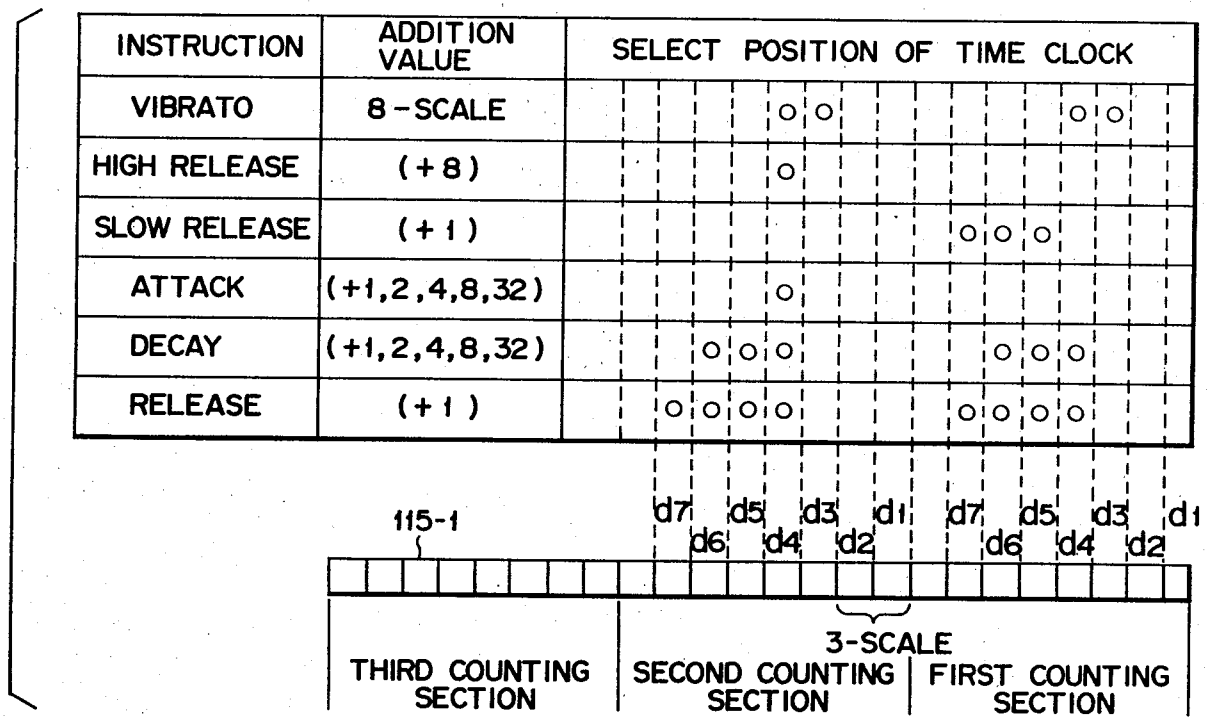
FIG. 30 shows an operation of a time clock selection based upon a variety of clock time generating circuit.
Figure 31:
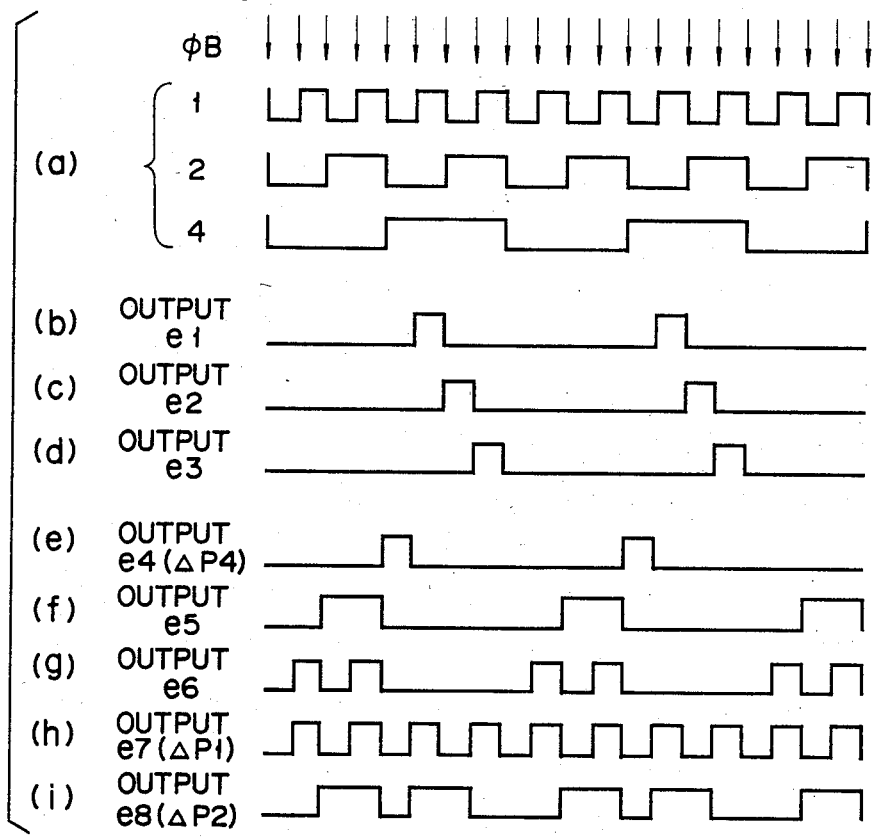
FIG. 31 is a time chart for explaining the operation of vibrato control of the invention.

The time clock signals in the first and second counting sections outputted from the AND gates 115-10, 115-12, 115-14, 115-16 and 115-17 are selected, as indicated by circular symbols ◯ in FIG. 30, in accordance with indications by the vibrato clock selection circuit 116 and the envelope clock selecting circuit 119. Further, an addition value to the adder 55 for envelope may be selected in synchronism with the time clock signal selected.

Figure 32:
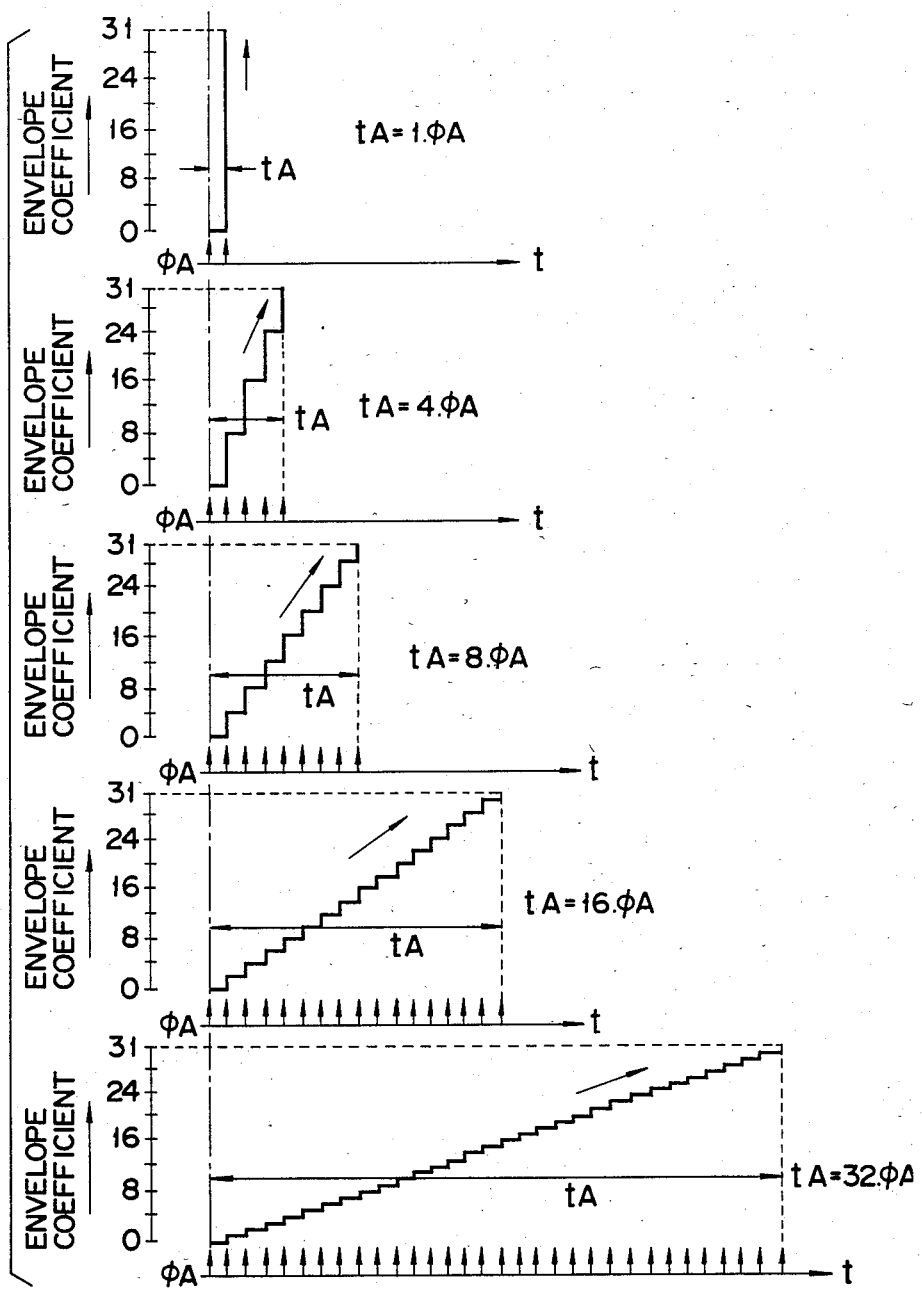
FIG. 32 shows graphs of volume envelopes representing variations with respect to lapse of time at a time of the attack.
Figure 33:
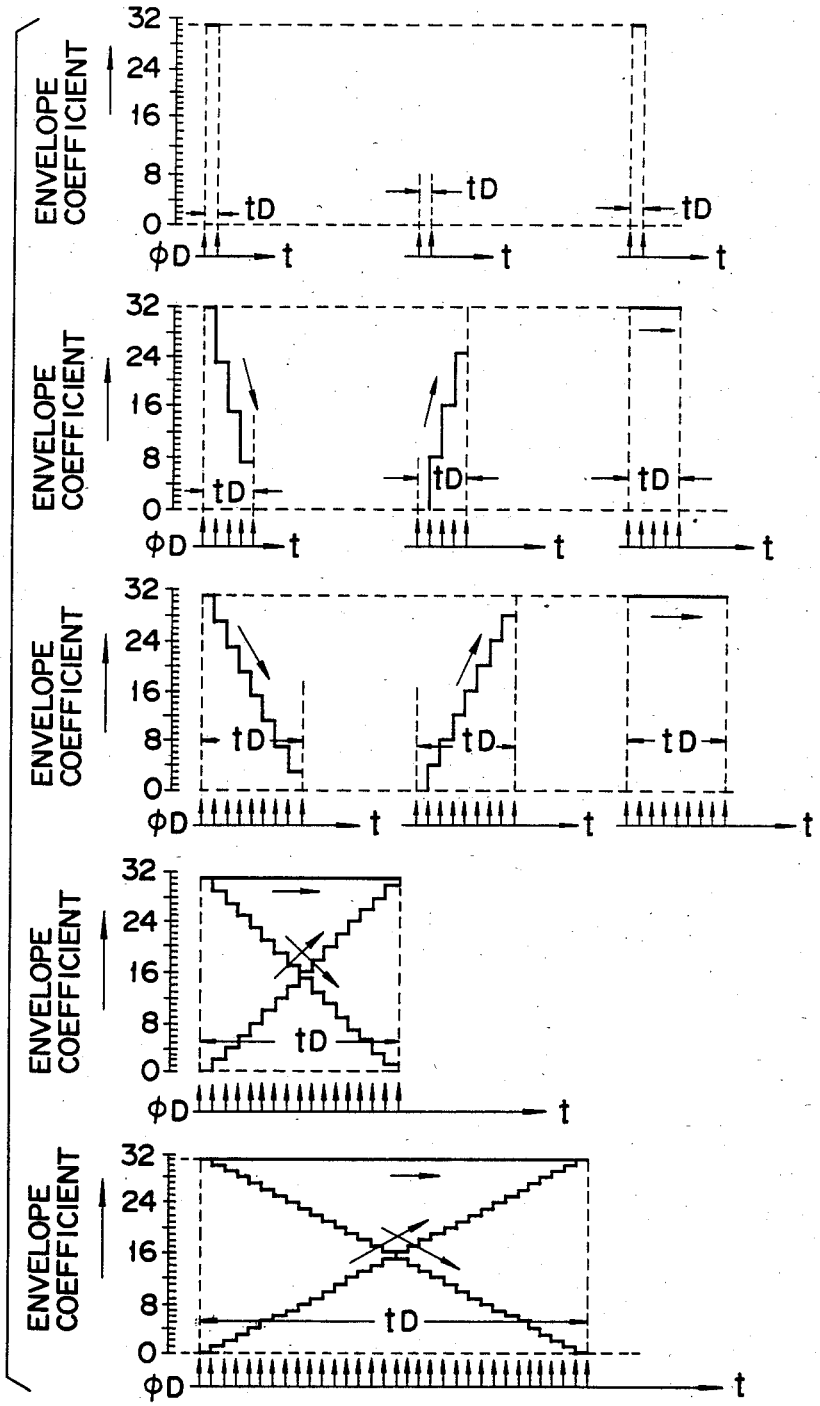
FIG. 33 shows variations of volume envelopes with respect to lapse of time at the time of decay.
Figure 34:
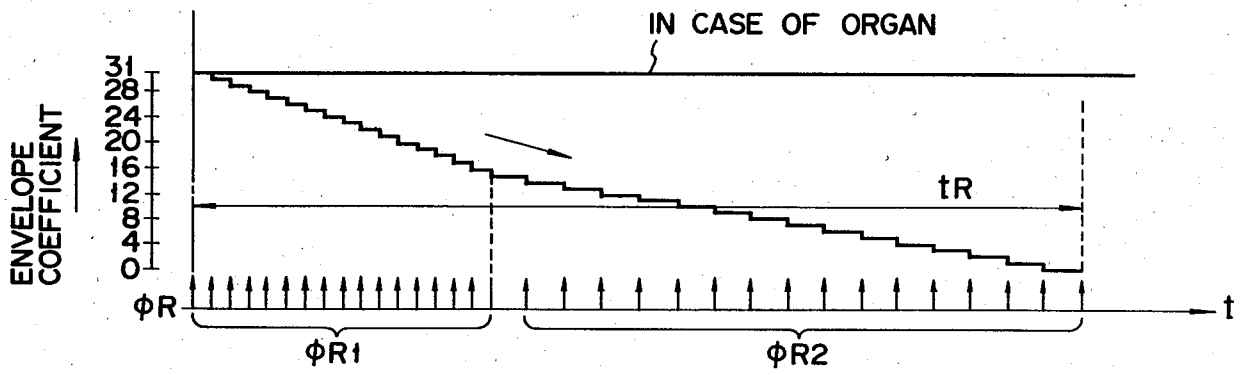
FIG. 34 shows change of volume with respect to lapse of time at the release operation.

FIGS. 32, 33 and 34 show time-variations of envelope coefficient values in attack, decay and release state.

The timing signal (with an $8\phi_0$ width) corresponding to a performance key actuated outputted from the key operation timing detecting circuit 114 is applied to a key input synchronizing F/F 107-1 of which the output is coupled with an AND gate 107-3. The AND gate 107-3 produces an output signal in synchronism with a set output signal from a flip-flop 115-21 for chattering prevention and is applied to the inhibit gate 107-4 which in turn produces a key-on signal. The inhibit gate 107-4 provides an output signal to an AND gate 107-6, when receiving a first and one-shot key-on signal by a new key operation when the output signal from a 48-bit shift register 107-5 corresponding to the number (48) of performance keys is "0", as will be described later. The AND gate 107-6 responds to a reset signal (representing a vacant line memory in the envelope register 54) outputted from the inhibit gate 68 shown in FIG. 7A and produces an input indication signal mentioned above for setting a pitch input data of a new key and an attack state of an envelope in the vacant memory. The input indication signal also designates a plurality of line memories in accordance with a multiple performance designation state. The reset signal outputted from the inhibit gate 68 shown in FIG. 7A is applied to the AND gate 107-7 and the inhibit gate 107-8 of the input control circuit 107. The output of the AND gate 107-7 is held through the OR gate 107-9 and the inhibit gate 107-11 gate 107-10 and is coupled with an inhibit of which the outputting is inhibited by the inhibit gate 107-8. The AND gate 107-7 and the inhibit gate 107-8 are supplied, as a gate signal, the output (c) the duet signal designation from the control timing generating circuit 102, the signal indicated by (c) and (d) shown in FIG. 28A which is for a quartet designation and a constant "1" signal with no multiple performance designation, and a signal shown in (b) of FIG. 28A which is for an octet designation. The signals shown in FIGS. 28A (b) inhibit the outputting of an inhibit gate 107-10 through an inhibit gate 107-12 from the output (a) and releases the hold. Accordingly, the inhibit garte 107-11 produces a signal in synchronism with the output (c) signal corresponding to the multiple performance designation and the AND gate 107-6 produces an output signal at the generation of the key-on signal. The output signal from the AND gate 107-6 is supplied to the inhibit gate 107-13 and the AND gate 107-14. The AND gate 107-14 produces an output signal in synchronism with the output (d) signal from the control timing generating circuit 102. The output is then applied to the flip-flop 107-16 for providing a one bit delay (delay time of 1 $\phi_0$) through the OR gate 107-15. The output of the flip-flop is applied through the inhibit gate 107-17 to the gate 107-15. Through this connection, it recirculates. The recirculation is held until the inhibit gate 107-17 is inhibited by an output signal ((b) of FIG. 28A) from the output (a) of the control timing generating circuit 102. Accordingly, the output signal from the inhibit gate 107-13 continues its outputting from the output generation of the AND gate 107-6 until it is inhibited by the output signal from the inhibit gate 107-17. Thus, the inhibit gate 107-13 produces input designation signals with a 1 $\phi_0$ width (in the case of no multiple performance designation), a 2 $\phi_0$ width (in the case of a duet designation), a 4 $\phi_0$ width quartet designation) and an 8 $\phi_0$ width (octet designation). In the case of the duet designation, four combinations, memory lines $L_0$ and $L_1$, $L_2$ and $L_3$, $L_4$ and $L_5$ and $L_6$ and $L_7$ are used; in the case of the quartet designation, two memory line combinations $L_0$ to $L_3$ and $L_4$ to $L_7$ are used; in the case of the octet designation, a single combination $L_0$ to $L_7$ is used. The same pitch input code is applied to a plurality of line memories of the scale code register 20 and the octave code register 21, and at the same time a plurality of line memories of the envelope register 54 shown in FIG. 7D is in attack state, and the respective registers are in an operation ready condition. Thus, the output signal of the AND gate 107-6, together with the output signal of the flip-flop 107-16 with one bit delay, is applied to the AND gate 107-20 through the OR gate 107-18 and the OR gate 107-19 to which the output signal from the shift register 107-5 is applied. The OR gate 107-18 produces an output signal in synchronism with the input designation signal, and its output signal is supplied as a write signal to the shift register 107-5 by the timing signal corresponding to the key depressed and outputted from the OR gate 107-21. When receiving a "1" signal, the shift register 107-5 is shifted in synchronism with the timing signal ((b) in FIG. 28A) from the output (a) from the control timing generator 102. The loaded signal is recirculatingly held so long as a performance key is depressed, but the circulation ceases when the key is released. The output of the AND gate 107-20 is supplied as a gate inhibit signal to the inhibit gate 107-22.

Upon the depression of the performance key, a key-on signal outputted from the inhibit gate 107-4 sets the flip-flop 107-24 by way of the OR gate 107-23. The set output is recirculated through the inhibit gate 107-25. The circulation holding is released at the generation of the output signal from an AND gate 107-26 for logically summing the timing signal ((f) in FIG. 29) from the output (e) of the synchronizing signal generating circuit 109 and the output signal from a carry flip-flop (F/F) 107-2. The set output of the flip-flop 107-24 is applied to the inhibit gate 115-22 in the clock time generating circuit 115, thereby to cause the third counting section in the shift register to start its counting operation. Therefore, the holding time can be obtained from the third counting section. In this system, the holding time is selected to be approximately 45 ms after a performance key is depressed. The set output signal of the flip-flop 107-24, together with the output signal from the switch $0_A$ for organ like volume designation, is applied to the inhibit gate 107-22 through the OR gate 107-27. The output signal from the gate 107-22 is applied to the AND gate 107-28. The AND gate 107-28 has been supplied with a coincident signal from a coincident circuit 121. The AND gate 107-28 produces a high release set ((hr) set) which in turn is set in a high release synchronizing set register 91 through the OR gate 92 shown in FIG. 7D. The coincident circuit 121 is used to check whether a pitch input code outputted from the respective stages $0_1$, $0_2$, $S_1$, $S_2$, $S_4$ and $S_8$ of the counters 108 and 111 coincides with a pitch output code outputted from the scale code register 20 and the octave code register 21 shown in FIG. 7A. When the switch $0_A$ designates OFF, a pitch code is loaded into line memories of the scale code register 20 and the octave code register 21, within the holding time (approximately 45 ms) of the flip-flop 107-24. In case where a performance key is released, the AND-gate 107-28 produces a high release set signal and it is in high release state. As described above, the high release state indicates a state that, when a performance key is released, a sound rapidly disappears. In case where the switch $0_A$ designates ON, if the performance key is released (AND gate 107-20 produces no output), the line memory with the same pitch output code as that of the released performance key is set to be in a high release state. Through this operation, a satisfactory key off state is realized.

As described above, according to the construction of the invention, a plurality of waveforms may be simultaneously designated and composed, and, in different waveforms, rises and falls of volume may be made different. Therefore, a musical sound obtained has natural and rich timbre. In the example mentioned above, two kinds of volume curves $\alpha$ and $\beta$ are designated. However, two or more volume curves may be designated within the scope of the invention.

In the scale period control system according to the invention, a period setting control value of the period setting means for setting the period of counting means, corresponding to the scale, is divided into coarse and fine values, taking account of one dynamic shift circulation of each of a plurality of line memories (a total of 8). With such divided values, the counting up (+) of a counter may be digitally controlled in accordance with the respective scales. Additionally, the control value is stored by a matrix circuit so that the circuit construction is very simple and is suitable for LSI fabrication. In the embodiment, the counting control of the counter is described relating to only an advance control. However, a delay (−) control may be permitted by pulling clocks of the counter means counted by a given clock frequency, in accordance with the scale.

Also in the above embodiment, the waveform program designation unit 35 for each block shown in FIG. 7A is of switch designation as shown in FIG. 16. Alternatively, designation states previously selected are permanently stored in a fixed memory stored in a fixed memory such a read only memory (ROM). The designation states may be stored in a magnetic card and, in use, those are read out and stored in a temporary memory such as a flip-flop. The number of blocks of one period of a musical sound wave is not limited to 16. The differential coefficient values for each block are not limited in number to "1", "2", "4". A filter circuit may be added at the succeeding stage of the D-A converter. In this case, a plurality of filters may be used for switch selection thereof. This scheme provides sound effects with different resonance characteristics and echo characteristics of musical instruments with acoustic or brasses, or different transmission characteristics of brasses. Further, the scale code register 20, the octave code register 21, the period counting register 34, and the envelope register 54 may be constructed by a random access memory (RAM). Many and various other modifications of the described circuit constructions may be permitted within the spirit of the invention.

What we claim is:

1. An electronic musical instrument, comprising:

a single key board having a plurality of performance keys;

means coupled to said single keyboard for detecting a single operated performance key to generate a key code data corresponding thereto;

musical sound generating means including a plurality of tone generating channels, each channel for producing a musical tone signal, said channels being switchable on the basis of a time division process whereby said musical sound generating means can simultaneously produce a plurality of musical tone signals;

channel assigning means coupled to said musical sound generating means for assigning the respective tone generating channels to a musical note to be produced in response to said generated key code data corresponding to said single detected operated performance key, said channel assigning means assigned at least two of said tone generating channels to the same note to be produced responsive to operation of a single performance key of said single keyboard;

said musical sound generating means including a memory for assigning a musical note to respective time division tone generating channels, said memory having memory areas which correspond in number to the number of said tone generating channels, and said channel assigning means being operative to assign at least two of said memory areas to the same note to be produced in accordance with a relationship between the memory areas and the tone generating channels;

control means coupled to said musical sound generating means and to said channel assigning means for controlling at least two tone generating channels assigned to the same musical tone so as to produce different musical sound wave signals corresponding to the same note in each of said at least two tone generating channels, whereby an ensemble performance of at least two sounds are carried out responsive to inputting of a single key code data by said keyboard.

2. The electronic musical instrument of claim 1, wherein said control means is operative to control at least two channels assigned to the same musical note to produce musical sound wave signals which have substantially the same waveform and a relatively small frequency difference.

3. The electronic musical instrument of claim 1, wherein said channel assigning means is connected to changeover switch means for controlling the number of channels for assigning the same musical note.

4. The electronic musical instrument of claim 3, wherein said changeover switch means includes means for selecting an ensemble performance corresponding to one of a duet, quartet and octet.

* * * * *